US012570381B2

(12) United States Patent
Newgent

(10) Patent No.: US 12,570,381 B2
(45) Date of Patent: Mar. 10, 2026

(54) AIR WATER SUBMARINE

(71) Applicant: Michael Newgent, Kapaa, HI (US)

(72) Inventor: Michael Newgent, Kapaa, HI (US)

( * ) Notice: Subject to any disclaimer, the term of this patent is extended or adjusted under 35 U.S.C. 154(b) by 547 days.

(21) Appl. No.: 18/108,577

(22) Filed: Feb. 10, 2023

(65) Prior Publication Data

US 2023/0264795 A1 Aug. 24, 2023

Related U.S. Application Data

(60) Provisional application No. 63/313,001, filed on Feb. 23, 2022.

(51) Int. Cl.

| | |
|---|---|
| ***B63G 8/00*** | (2006.01) |
| ***B63G 8/18*** | (2006.01) |
| ***B63G 8/22*** | (2006.01) |
| ***B63G 8/36*** | (2006.01) |

(52) U.S. Cl.

CPC ..... *B63G 8/001* (2013.01); *B63G 8/18* (2013.01); *B63G 8/22* (2013.01); *B63G 8/36* (2013.01)

(58) Field of Classification Search

CPC . B63G 8/00; B63G 8/001; B63G 8/08; B63G 2008/002; B63G 8/18; B63G 8/22; B63G 8/36; B63J 2003/046

USPC ..... 114/312, 313

See application file for complete search history.

(56) References Cited

U.S. PATENT DOCUMENTS 3,943,869 A * 3/1976 Frechette ..... B63C 11/46 114/330

6,536,366 B1 * 3/2003 Zilliacus ..... B63B 3/13 114/382

* cited by examiner

*Primary Examiner* — Daniel V Venne

(74) *Attorney, Agent, or Firm* — L/O ALEXIS J SAENZ

(57) ABSTRACT

A submarine apparatus includes an internal bellows pipe that compresses and decompresses as the apparatus descends into and ascends within a water current. When the device is in a rising pressure process, water may condense inside a tube which may be collected in a tank. Water may also be condensed due to cold temperatures of the surrounding water and relative warmer air inside the AWS. The water may be used as a fresh source of water for drinking. Some embodiments include a generator assembly that generates electricity from a propellor move within the current. The electricity may be routed to powered components in the apparatus.

18 Claims, 52 Drawing Sheets

AIR WATER SUBMARINE

CROSS-REFERENCE TO RELATED APPLICATIONS

This application claims benefit under 35 U.S.C. § 119 (e) of U.S. Provisional Application having Ser. No. 63/313,001 filed Feb. 23, 2022, which is hereby incorporated by reference herein in its entirety.

FIELD

The subject disclosure relates to vehicles, and more particularly, to an air water submarine.

BACKGROUND

When voyaging aboard a ship, whether large or small, having a supply of fresh water and available energy is an ongoing concern. Many ships are fitted with holding tanks. Some tanks hold fossil fuels for energy production. Some holding tanks store fresh water. This approach presents several challenges one of which is the space requirement. Once these tanks are depleted, ships may have to go into port to restock. Another ongoing concern is electrical safety in the wet environments aboard a ship.

SUMMARY

In one aspect of the disclosure, an apparatus provides restocking of fresh water or compressed air. The apparatus includes a buoyant submersible housing. A dive plane is attached to the submersible housing. A propellor system is attached to an end of the submersible housing. A bellows pipe is positioned inside the submersible housing and coupled to the propellor system. The bellows pipe changes from an expanded state to a contracted state in response to a change in pressure on the submersible housing. A first tube is connected to the bellows pipe. Air inside the bellows pipe is inhaled from ambient air above the surface of the water in the expanded state, and expelled from the bellows pipe in the contracted state. A second tube is connected to the bellows pipe for collecting condensation that forms in response to the bellows pipe changing between the expanded state and the contracted state.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the dive planes and detailed description are to be regarded as illustrative in nature and not as restrictive.

DETAILED DESCRIPTION

The detailed description set forth below is intended as a description of various configurations of the subject technology and is not intended to represent the only configurations in which the subject technology may be practiced. The appended dive planes are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for ease of understanding.

In general, a submarine type apparatus is disclosed that uses movement in water to generate energy from an internal bellows element. Diving and ascents experienced by the apparatus cause the bellows to compress air. That compressed air can be used to create for example, rotational energy for electricity production. Compressed air in itself can be used to operate pneumatic equipment. Embodiments may include a pressure tank connected to the release of compressed air. The apparatus can operate autonomously using only the relative water current and water pressure to operate the actuator systems. In one illustrative operation, two forces act on the system to create water; (1) Compression of air and (2) difference in relative temperature. The compression of air will also increase the water content of air in a given space which can cause condensation. Also, the temperature of water bodies (for example, an ocean) tends to be colder at depth. Warmer air from a base station 114 can be drawn into the submersible portion of apparatus 100. Colder water at depth can chill the warmer air below the dew point which causes water to condensate. The water may be collected for other uses including a fresh water supply.

Figure 1:
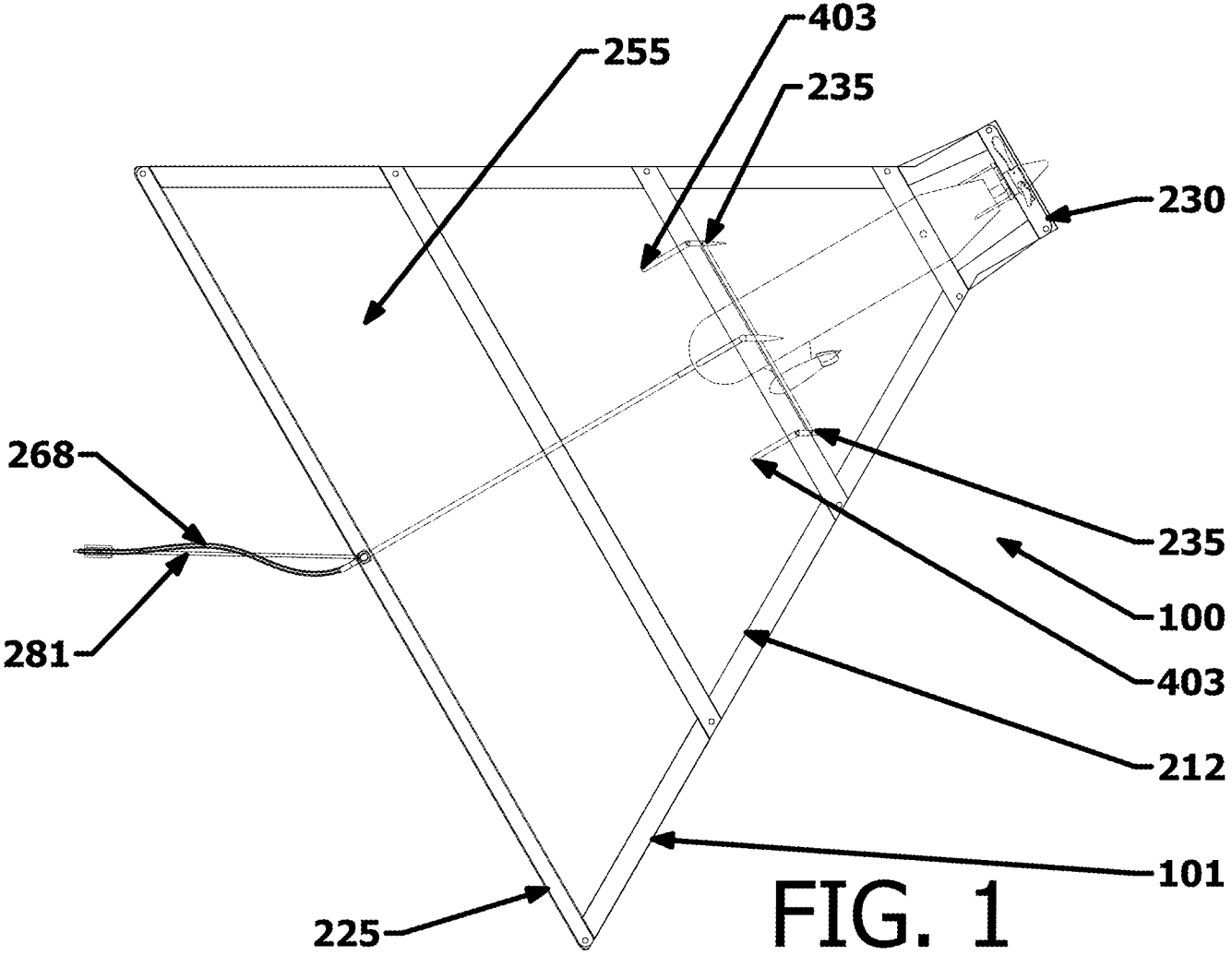
FIG. 1 is a side view of an air-water submarine system with partial cross-sectional view of a submarine assembly in accordance with embodiments of the subject apparatus.
Figure 2:
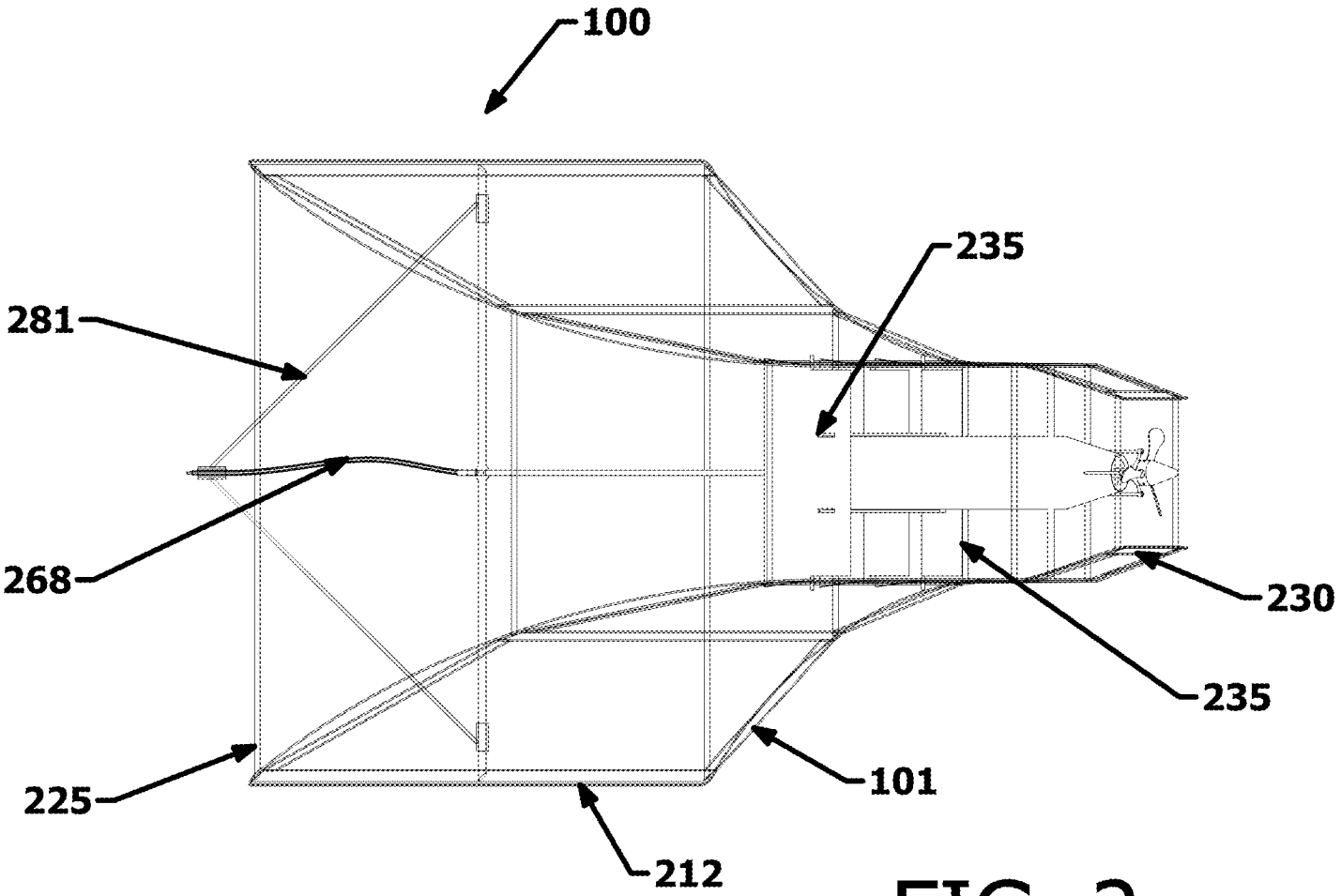
FIG. 2 is a perspective front, top view of the system of FIG. 1.

Referring to FIG. 1, exemplary embodiments of the subject technology provide an apparatus 100 for sea faring. In some embodiments, the apparatus 100 maybe part of a system. The apparatus 100 or system may be towed by a sea faring vessel (not shown) to provide an auxiliary source of fresh water and/or energy. In an illustrative embodiment, the apparatus 100 is an air-water submarine ("AWS"), and in the disclosure that follows, the apparatus 100 may be interchangeably referenced as the "AWS 100". As will be appreciated, the AWS addresses the concerns related to fresh water supply and energy while being out at sea or on land near a body of water. The AWS 100 can create sources of energy and/or water using the ocean, a river, an irrigation canal, or any body of water in motion relative to the AWS 100. Operation of the AWS 100 may be assisted by the difference in pressure existing vertically in a water column. The creation of water by the AWS 100 may be assisted when the air above the water is humid and the air temperature is warmer than the water below. The AWS can operate by being towed, for example, behind a boat. In some embodiments, the AWS 100 may operate while attached to a stationary object for example, a buoy or anchoring object near a shore, using the current to activate the control surfaces. For example, the AWS may operate when anchored to a river bed or canal where water can move over the AWS control surfaces.

In an illustrative embodiment, energy is created in the form of compressed air which can be used for pneumatic equipment eliminating the chance for shock or electrocution. A number of shipboard systems can run on pneumatics such as winches and bilge pumps. Compressed air from the system and apparatus embodiments disclosed may also be used for rotational energy needed to make electricity. The AWS 100 may collect condensation, as a form of fresh water, from the compressed air in the system, to provide a fresh water supply.

In some embodiments, the AWS 100 may incorporate electrical components and sensors but does not require them. In some embodiments, the AWS 100 may run on mechanical energy alone with no electricity required to run the system.

The AWS 100 may also capture energy from the ocean. There are three known methods for capturing energy from the ocean (per the Department of Energy website):

ocean currents
wave action
evaporative method

The AWS 100 collects energy in another way by collecting energy from the ocean pressure itself. In some embodiments, that pressure at depth can be transferred to the surface in a pressure vessel and used to rotate for example, a hydro-electric powered turbine system. as may be appreciated, the features described in more detail below have not been arranged before to provide fresh water, generate compressed air, and generate energy by leveraging the pressure in a body of water.

Referring back to the Figures, in FIGS. 1-5, an illustrative embodiment of the AWS 100 is shown. The AWS 100 includes a submarine assembly 400. In some embodiments, a plenum frame 101 (sometimes referred to colloquially as the "kite") is attached to the submarine assembly 400. In some embodiments, sea faring vessels might opt for a lower drag version of the AWS that does not include the kite (plenum frame 101). In general, as the submarine 400 is towed (or disposed within a current), the fluid flow through the plenum frame 101 creates a pressure differential increasing the speed of fluid over the AWS 100, which is used by the AWS 100 for movement.

Figure 74:
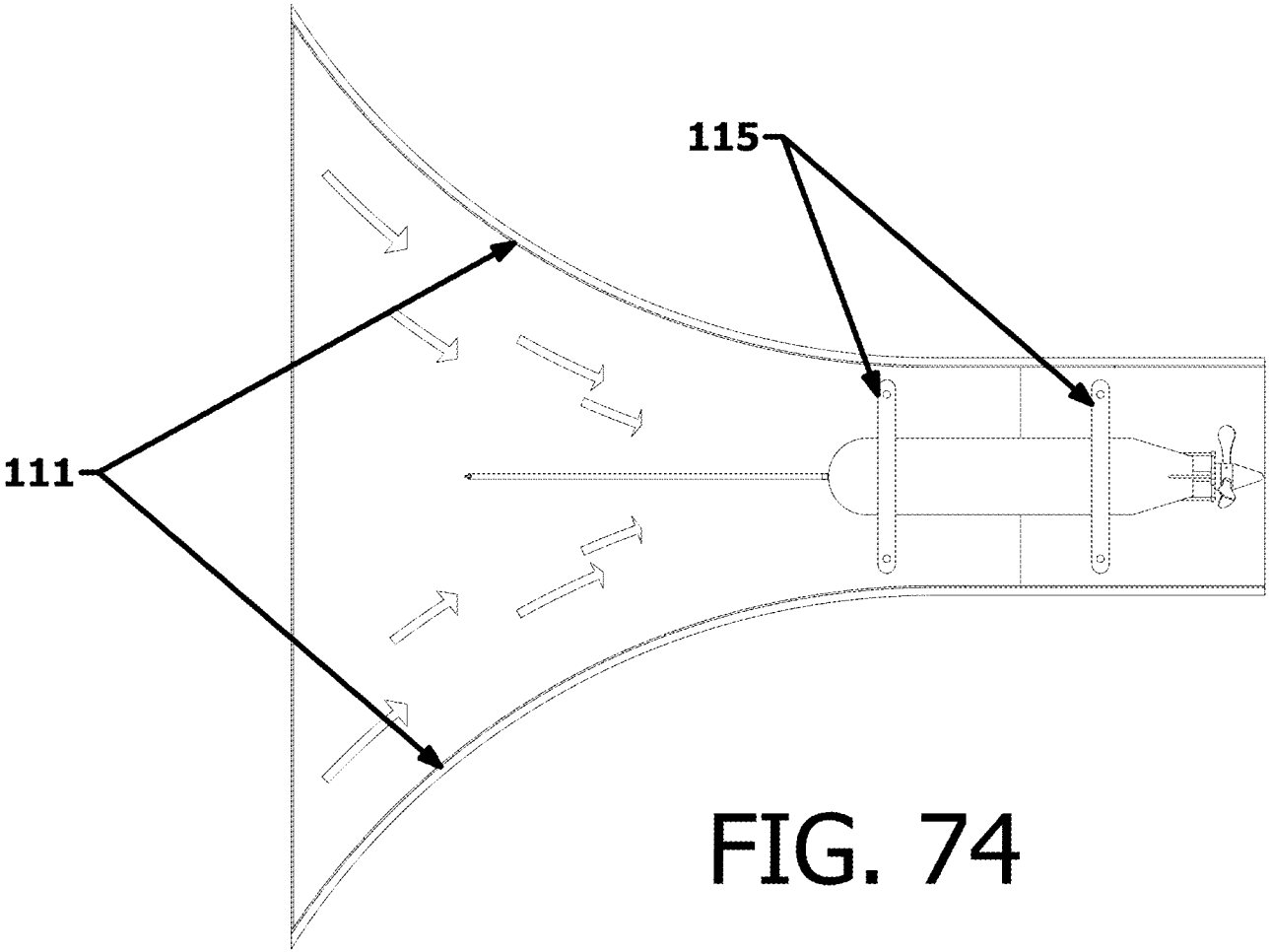
FIG. 74 is a diagrammatic top view of the air water submarine depicting a flow of water through the system consistent with an embodiment.

FIG. 1, with concurrent reference to FIGS. 7-9 and 74 show details of the plenum frame 101. The plenum frame 101 includes framing 212 that defines a double open ended enclosure of a hollow body. A first or forward end 225 may be wider than a second or aft end 230 of the framing 212. The submarine 400 may move in the direction of the forward end 225 and fluid may flow from the forward end 225 to the aft end 230 as illustrated in FIG. 74. The framing 212 may support sheet material 255 in place to define the plenum enclosure space. The framing 212 may be structured in a way that increases fluid flow over the AWS control surfaces 103, 235, 278, 260, 276, and 403. In some embodiments, the framing 212 tapers in volume from the forward end 225 to the aft end 230. As will be appreciated by one of skill in the art, the framing 212 may take advantage of Bernoulli's Principle by funneling the movement of water from the lower pressure, wider forward end 225 towards the submarine assembly 400 that may positioned adjacent the aft end 230. The funneling effect increases the speed of water over the submarine assembly 400 which assists in increasing the system performance. In some embodiments, a snorkel tube 268 may be coupled to the framing 212 (or the submarine assembly 400). The snorkel tube 268 may be coupled to a storage tank so that compressed air generated by the submarine assembly 400 and/or the fresh water extracted from condensation, can be stored. A swivel bracket 281 connected to the snorkel tube 268 may help prevent the snorkel tube 268 attached to the housing 402 from kinking.

Figure 3:
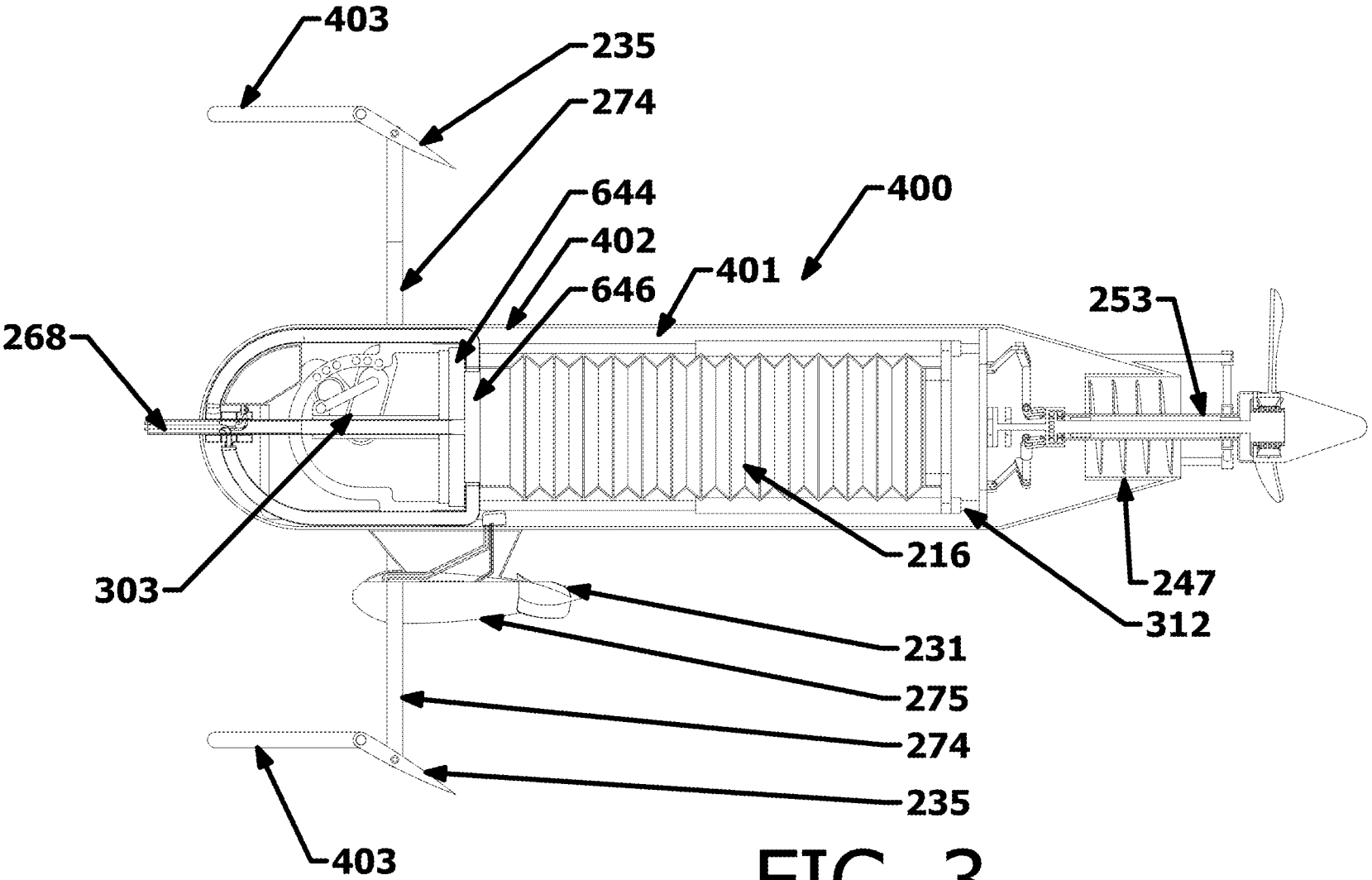
FIG. 3 is a side view, cross-sectional view of an air-water submarine, with control surfaces and dive planes in a first position in accordance with embodiments of the subject apparatus.
Figure 4:
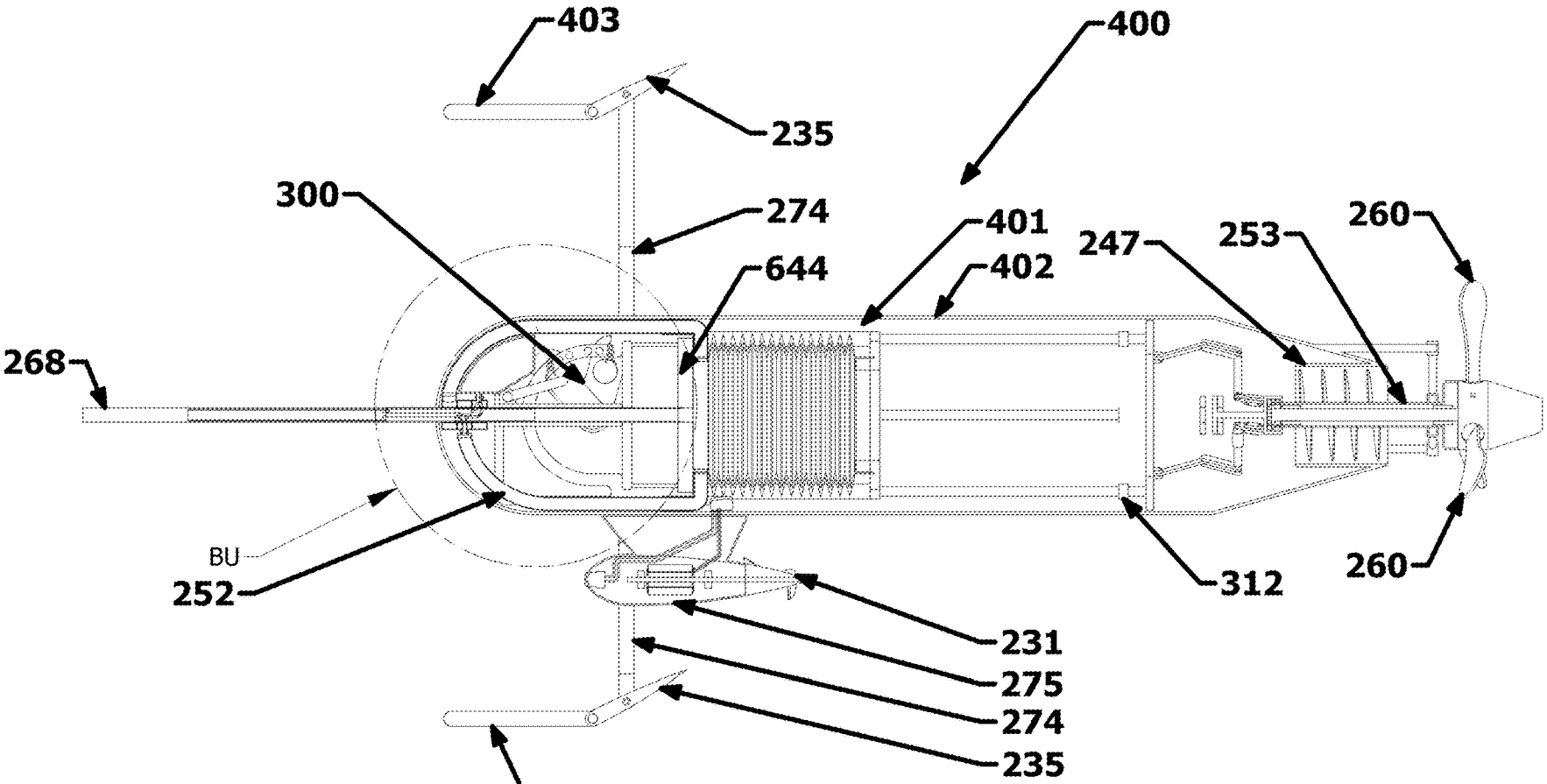
FIG. 4 is the side cross-sectional view of the submarine of FIG. 3 with the control surfaces and dive planes in a second position.
Figure 5:
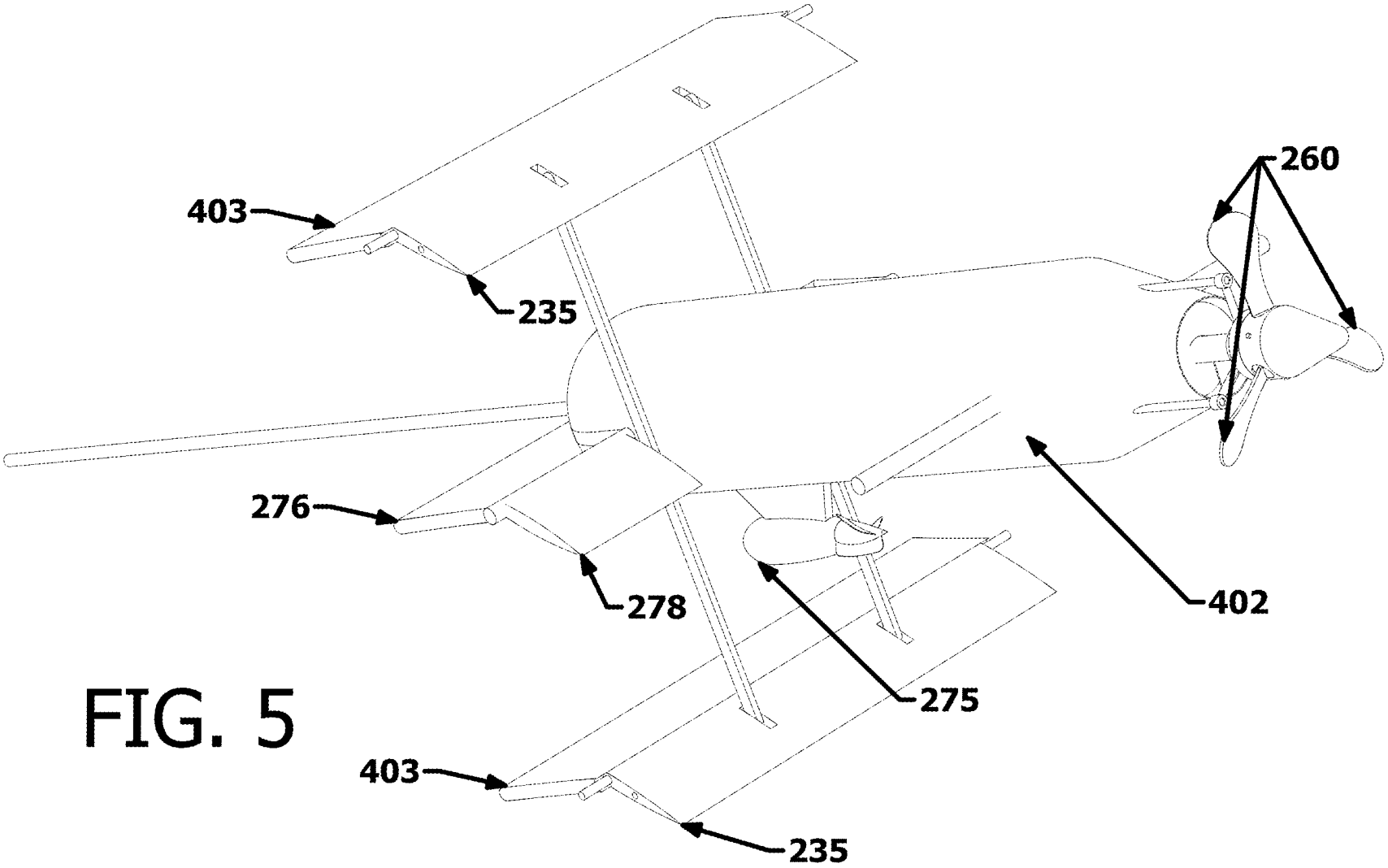
FIG. 5 is a perspective, rear view of the submarine of FIG. 3.
Figure 6:
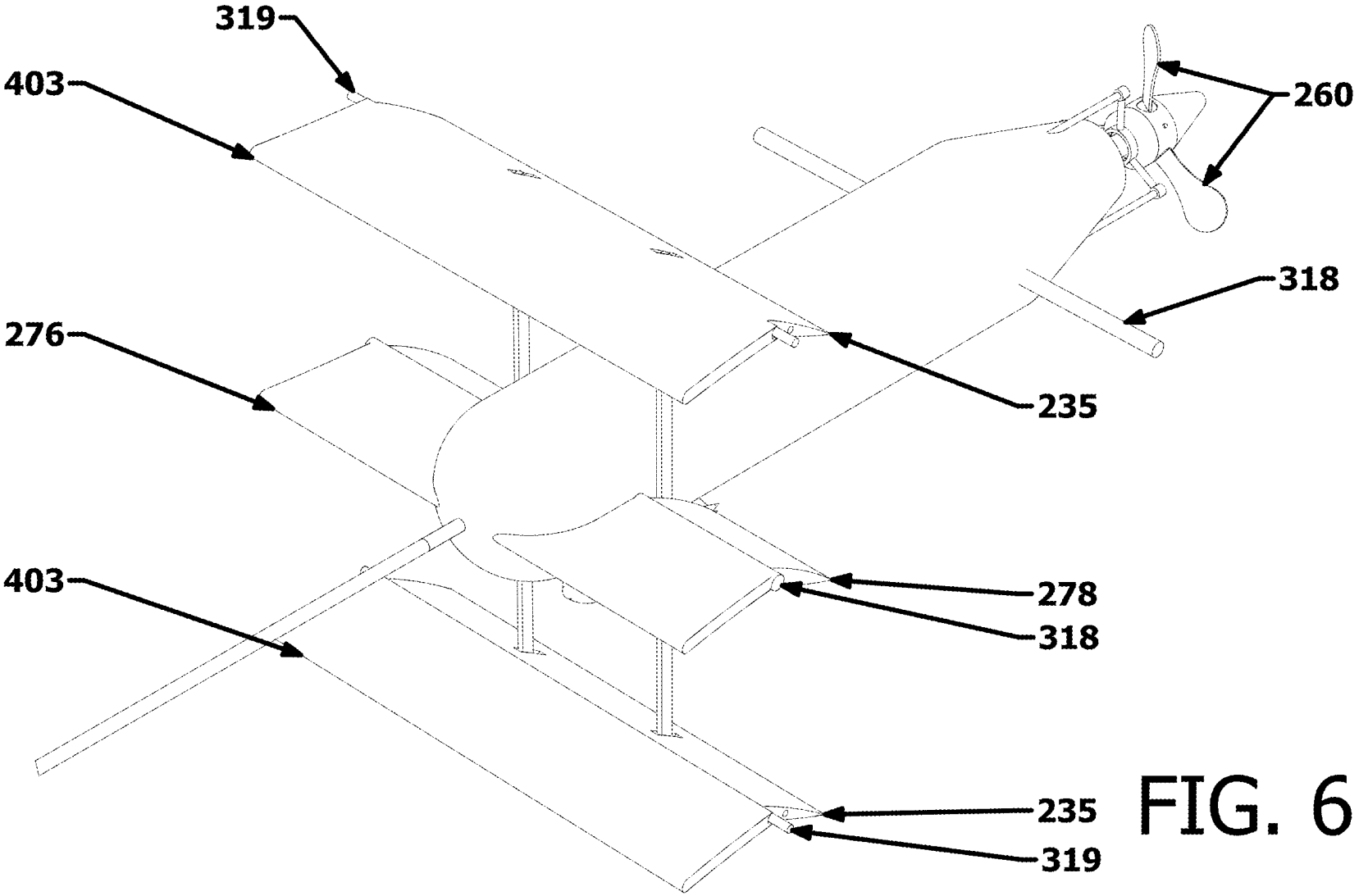
FIG. 6 is a perspective, front view of the submarine of FIG. 3.
Figure 7:
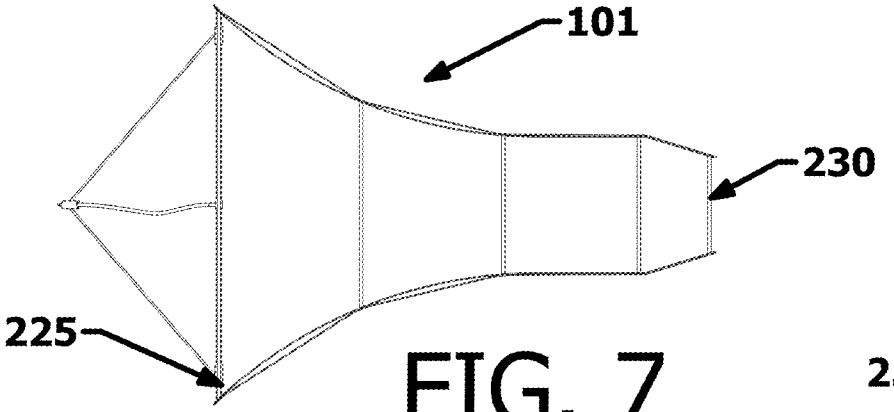
FIG. 7 is a top view of a kite in accordance with an embodiment.
Figure 8:
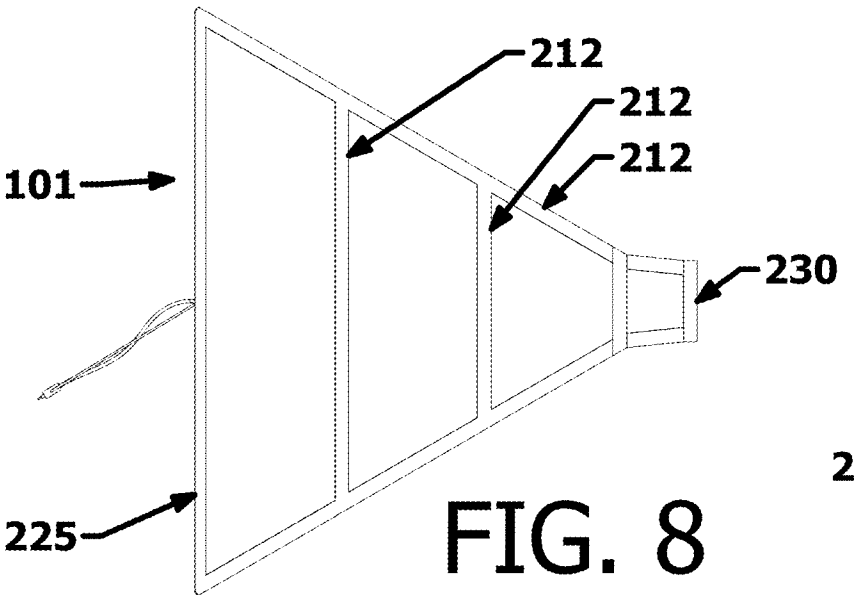
FIG. 8 is a side view of the kite of FIG. 7.
Figure 9:
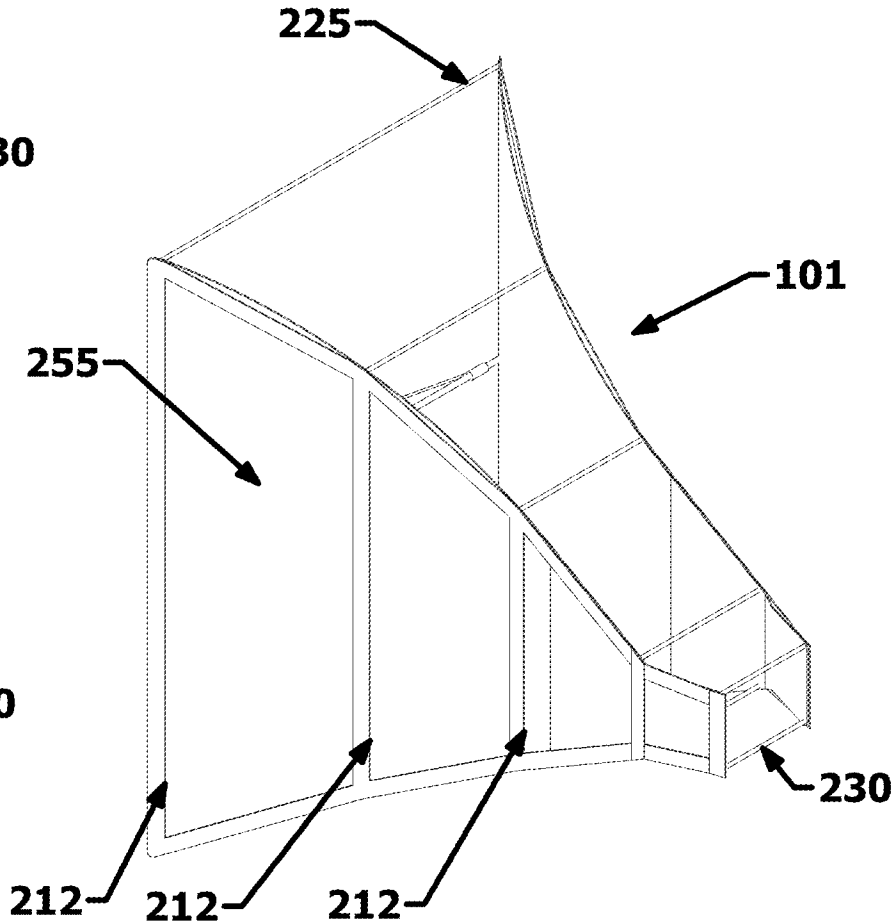
FIG. 9 is a perspective view of the kite of FIG. 7.
Figures 10, 11, 12:
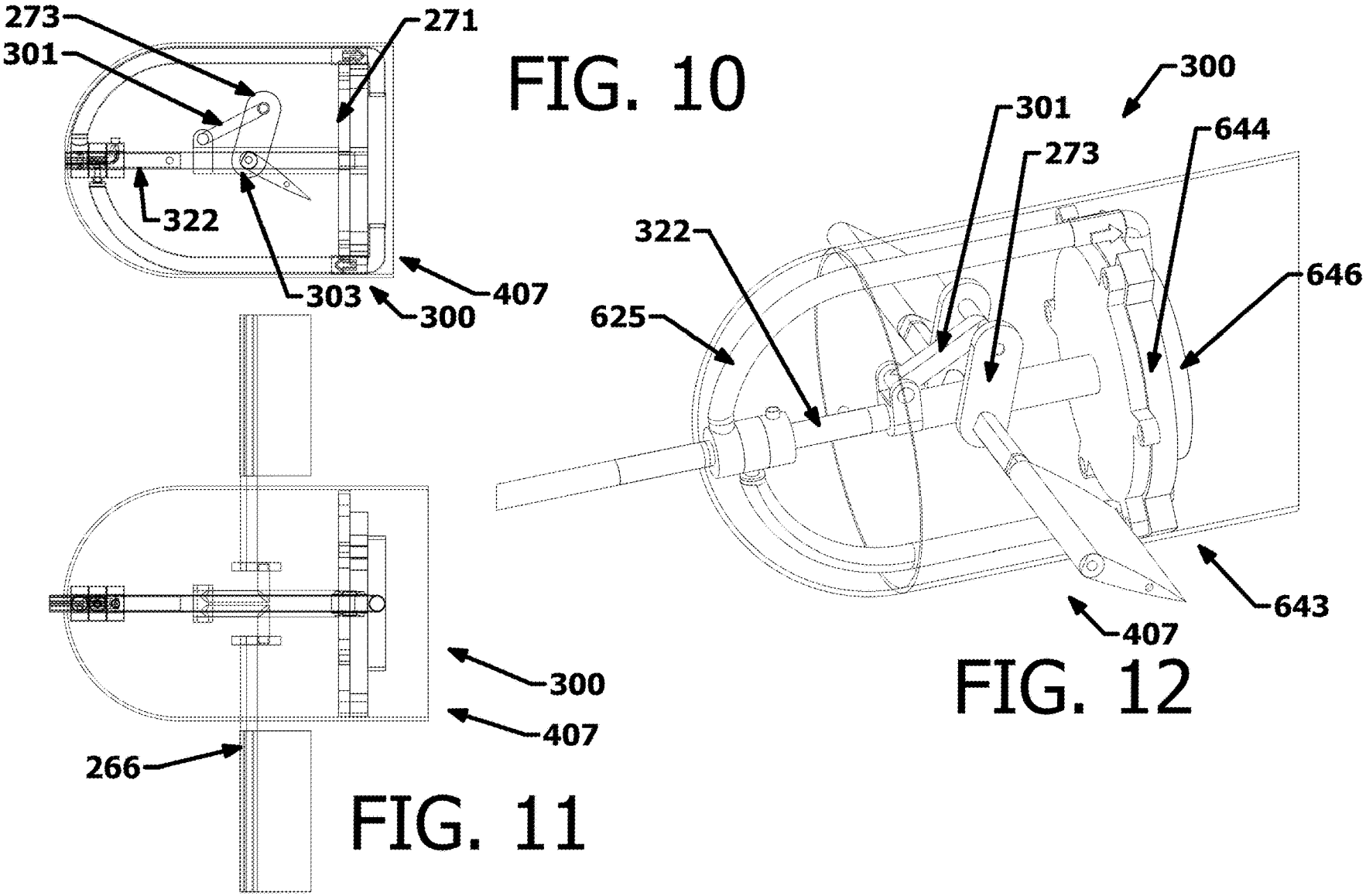
FIG. 10 is a side view of an actuator module in accordance with an embodiment.
FIG. 11 is a top view of the actuator module of FIG. 10.
FIG. 12 is a perspective view of the actuator module of FIG. 10.
Figure 15:
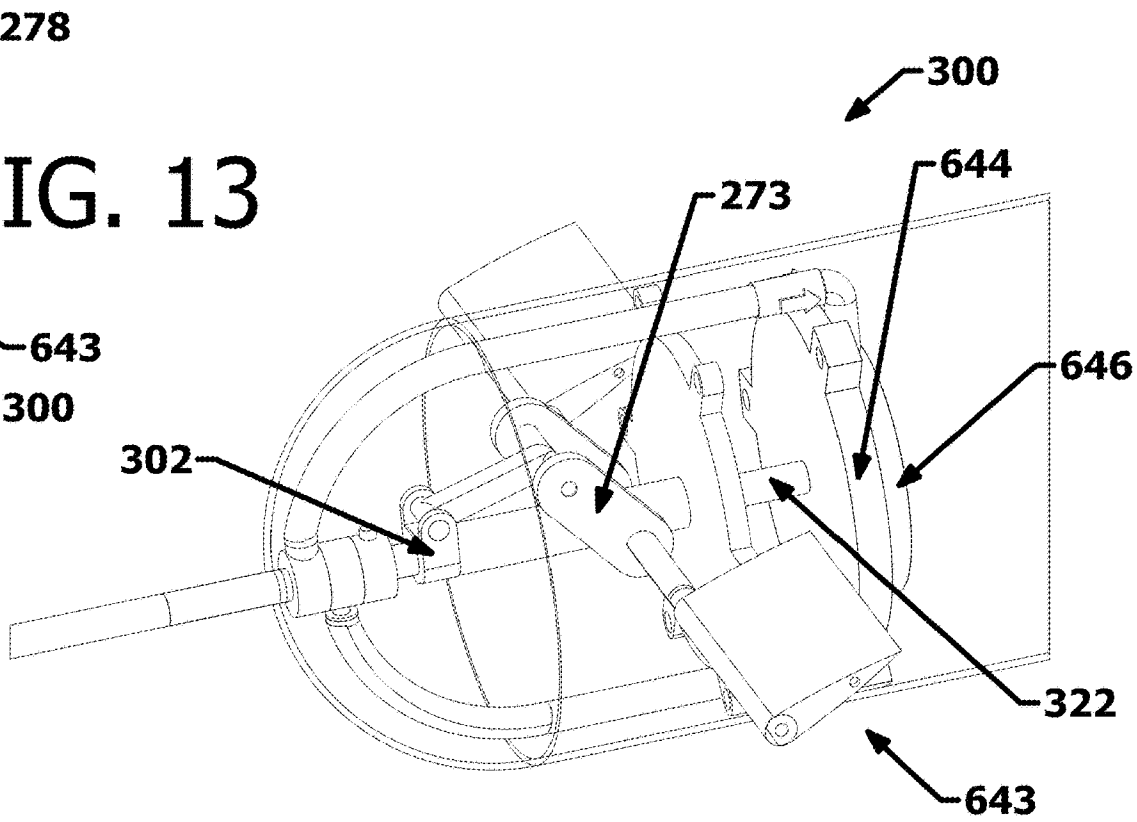
FIG. 15 is a perspective view of the actuator system of FIG. 13.
Figure 13:
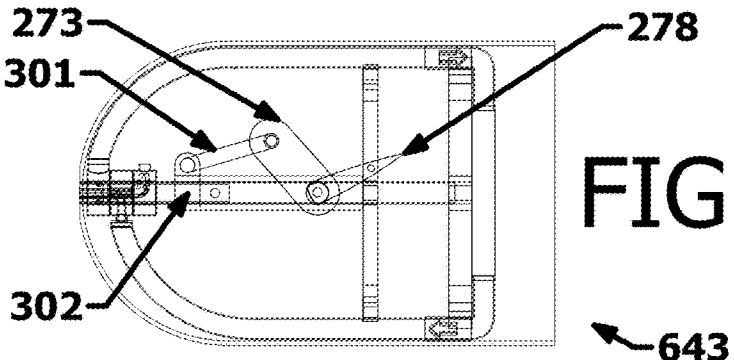
FIG. 13 is a side view of an actuator system in accordance with an embodiment.
Figure 14:
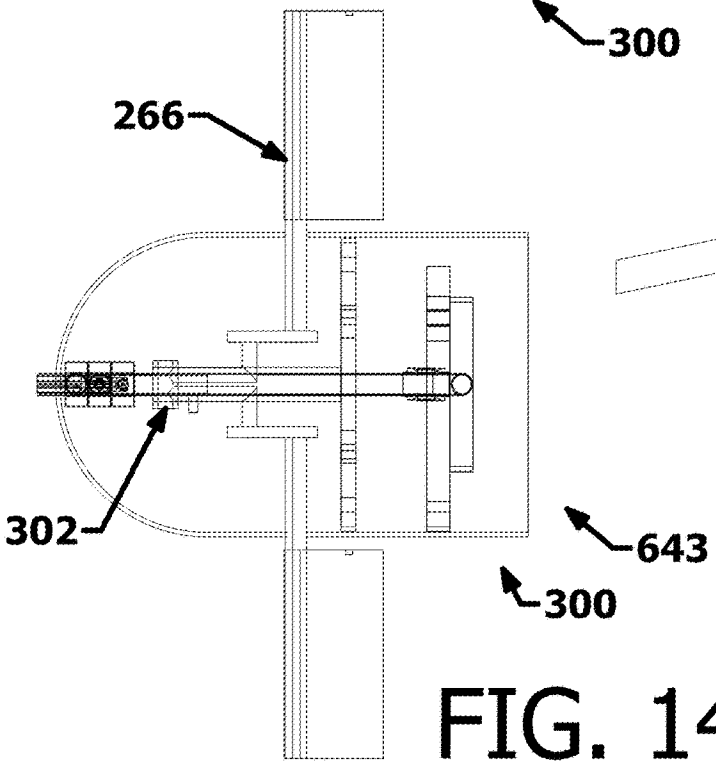
FIG. 14 is a top view of the actuator system of FIG. 13.
Figure 17:
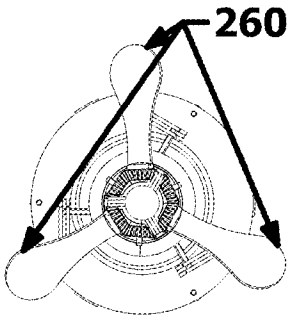
FIG. 17 is a rear view of the propellor module of FIG. 16.
Figure 16:
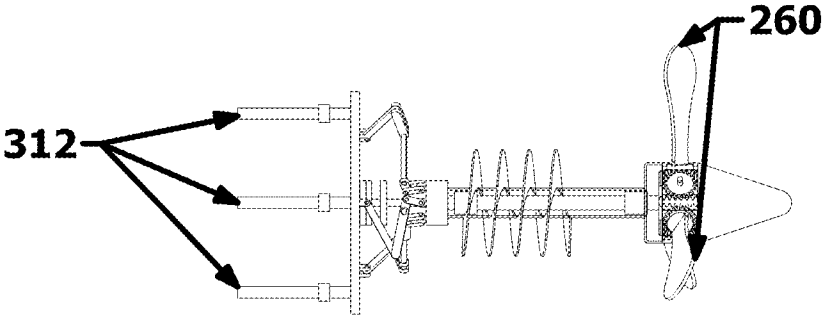
FIG. 16 is a side view of a propellor module in a first mode in accordance with an embodiment.
Figure 19:
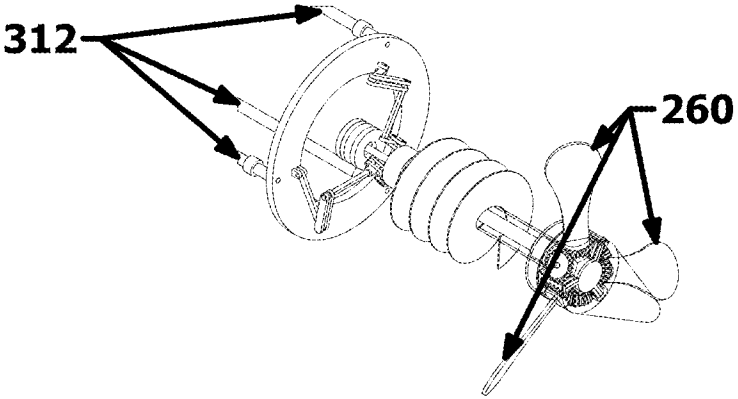
FIG. 19 is a rear perspective view of the propellor module of FIG. 16.
Figure 18:
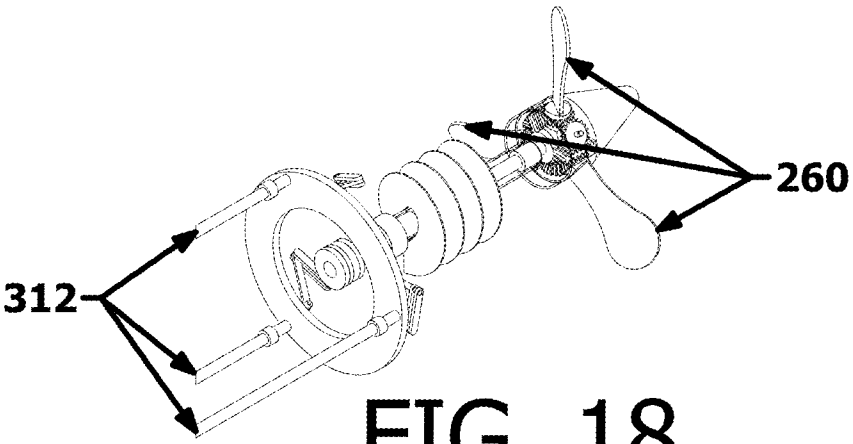
FIG. 18 is a front perspective view of the propellor module of FIG. 16.
Figure 21:
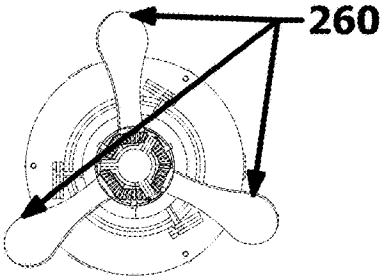
FIG. 21 is a rear view of the propellor module of FIG. 20.
Figure 20:
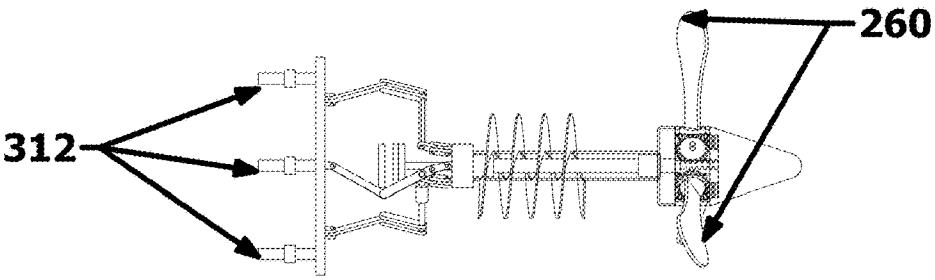
FIG. 20 is a side view of a propellor module in a second mode in accordance with an embodiment.
Figure 23:
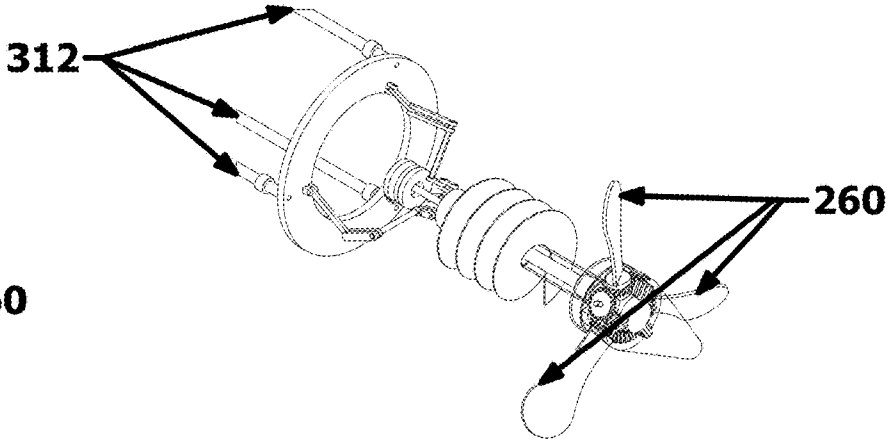
FIG. 23 is a rear perspective view of the propellor module of FIG. 20.
Figure 22:
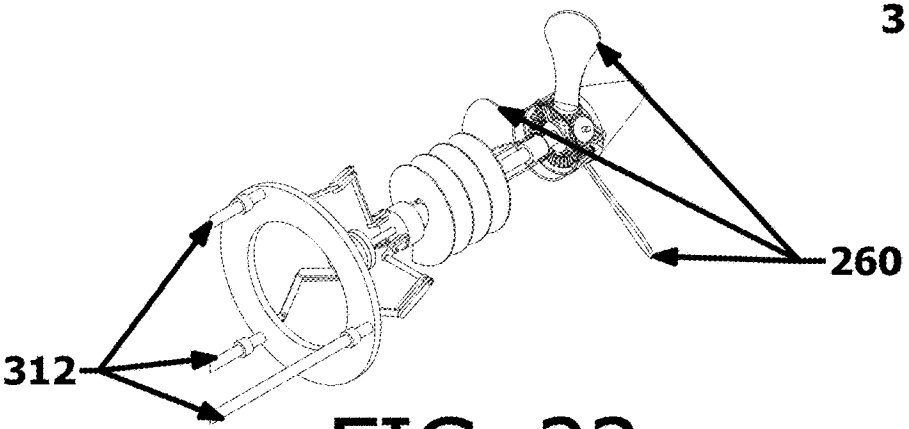
FIG. 22 is a front perspective view of the propellor module of FIG. 20.
Figure 25:
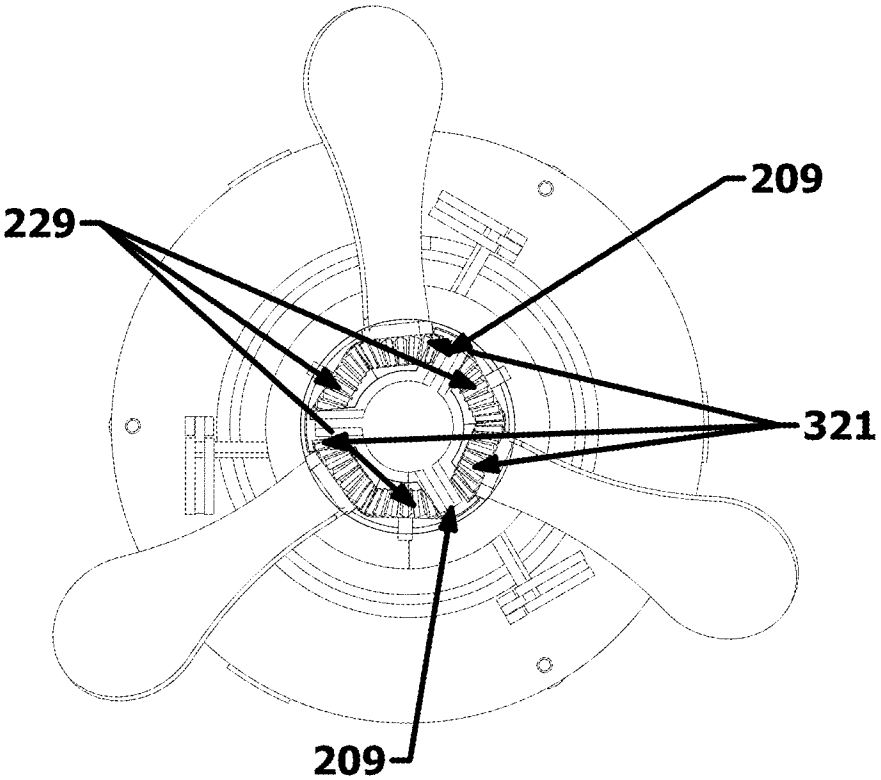
FIG. 25 is a rear view of the propellor of FIG. 24.
Figure 26:
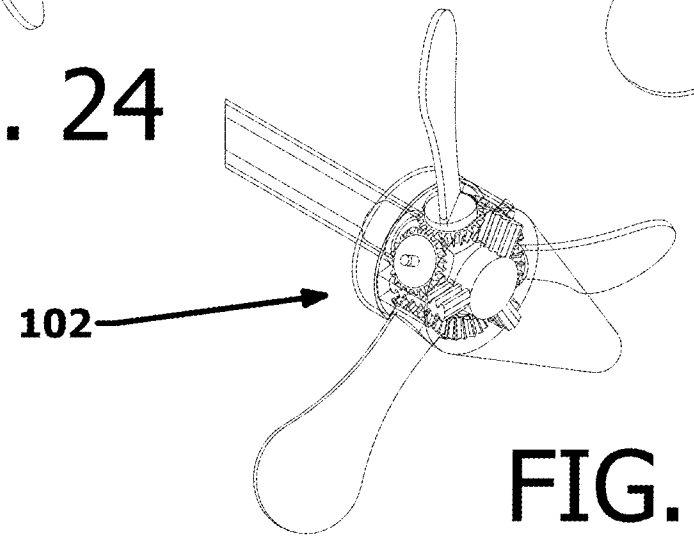
FIG. 26 is a perspective view of the propellor of FIG. 24.
Figure 24:
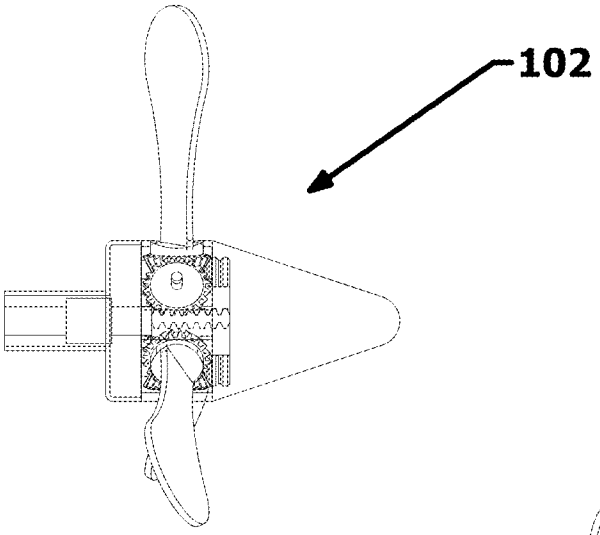
FIG. 24 is a side view of a propellor in a first mode in accordance with an embodiment.
Figure 28:
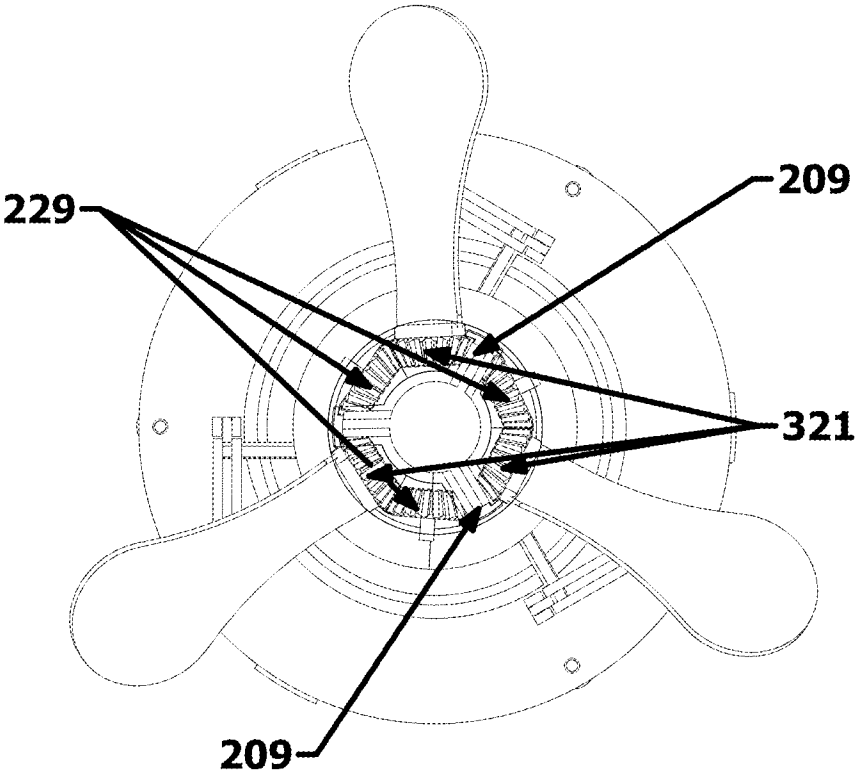
FIG. 28 is a rear view of the propellor of FIG. 27.
Figure 27:
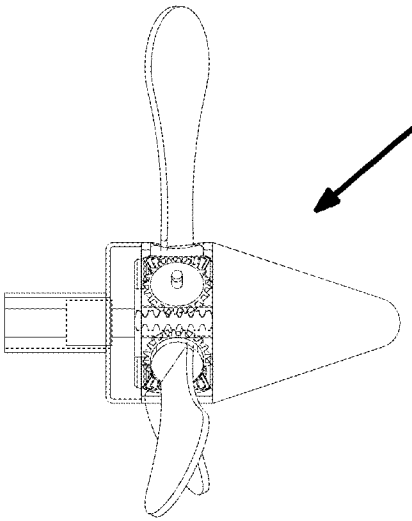
FIG. 27 is a side view of a propellor in a first mode in accordance with an embodiment.
Figure 29:
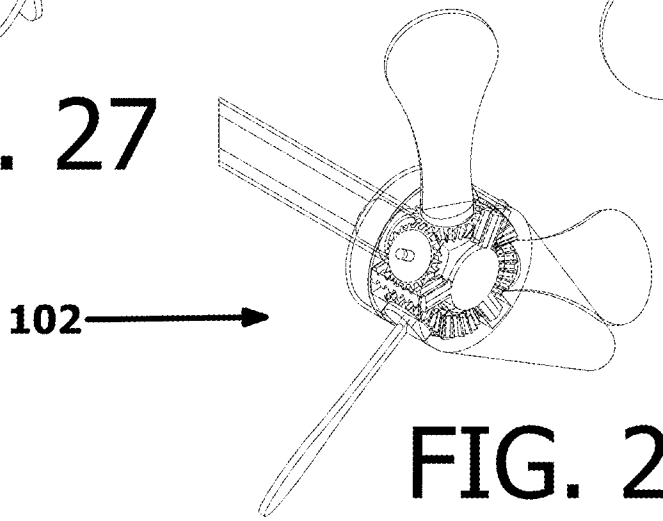
FIG. 29 is a perspective view of the propellor of FIG. 27.
Figure 30:
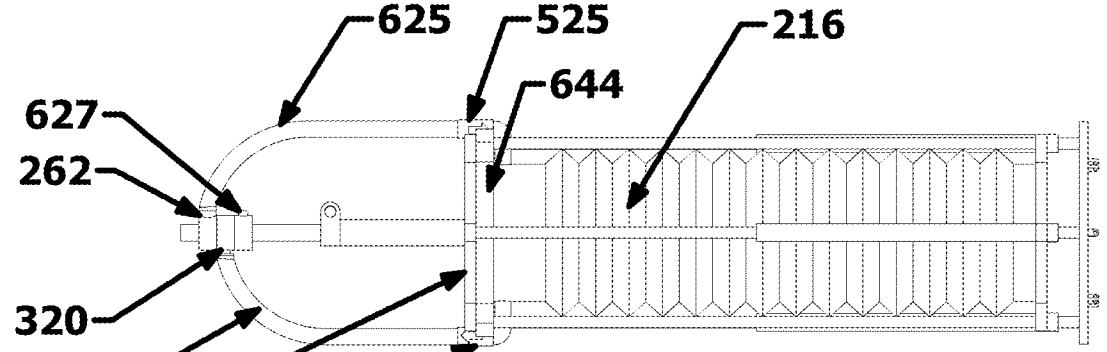
FIG. 30 is a side view of a compressible pipe module in accordance with an embodiment.

Referring now to FIGS. 1-6, the submarine assembly 400 will be discussed in further detail. The submarine assembly 400 may have a housing 402 with a generally ballistic shape. Propellor blades 260 may be attached to the aft of the housing 402. In the embodiment shown, the dive planes 403 may be positioned above and below the housing 402 with the leading edges of the dive planes 403 facing into the direction of current flow or movement of the apparatus 100. Some embodiments may include the dive plane 276 may be attached to the nose of the housing 402. The dive plane 276 may include elevators 278 to help with ascending or descending of the submarine assembly 400. One or more dive planes 403 may be attached to the housing 402 by control arms 274 that are linkages that keep the elevator 278 and elevator 235 on the same protocol. FIG. 3 shows a state of the elevators 235 and 278 being lowered or down, which may be used to help the submarine assembly 400 dive in the water. FIG. 4 shows a state of the elevators 235 being up, which may help the submarine assembly 400 rise in the water. In the embodiment depicted in FIG. 4, elevator 278 is the driving force behind the movement of elevator(s) 235.

The propellor blades 260 may be coupled to a shaft 253. Some embodiments include an impeller 247 coupled to the shaft 253 within the aft section of the housing 402. The impeller 247 may be for example, an Archimedes screw.

Figure 55:
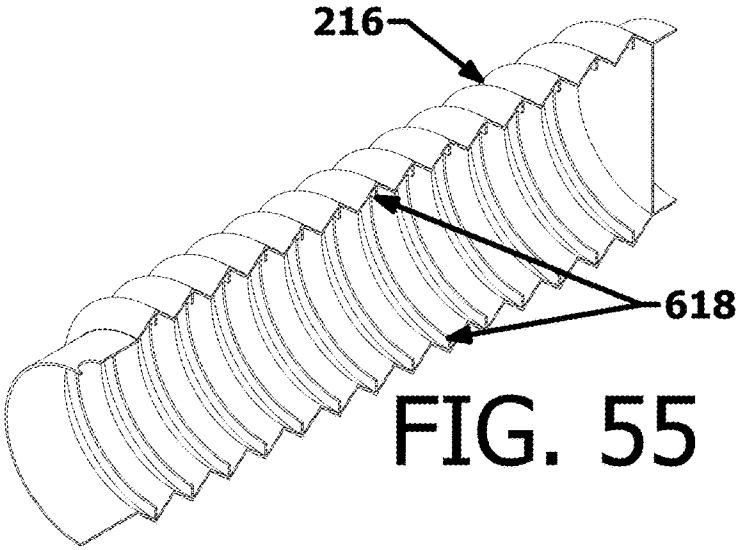
FIG. 55 is a cutaway view of a bellows pipe in accordance with an embodiment.
Figure 88:
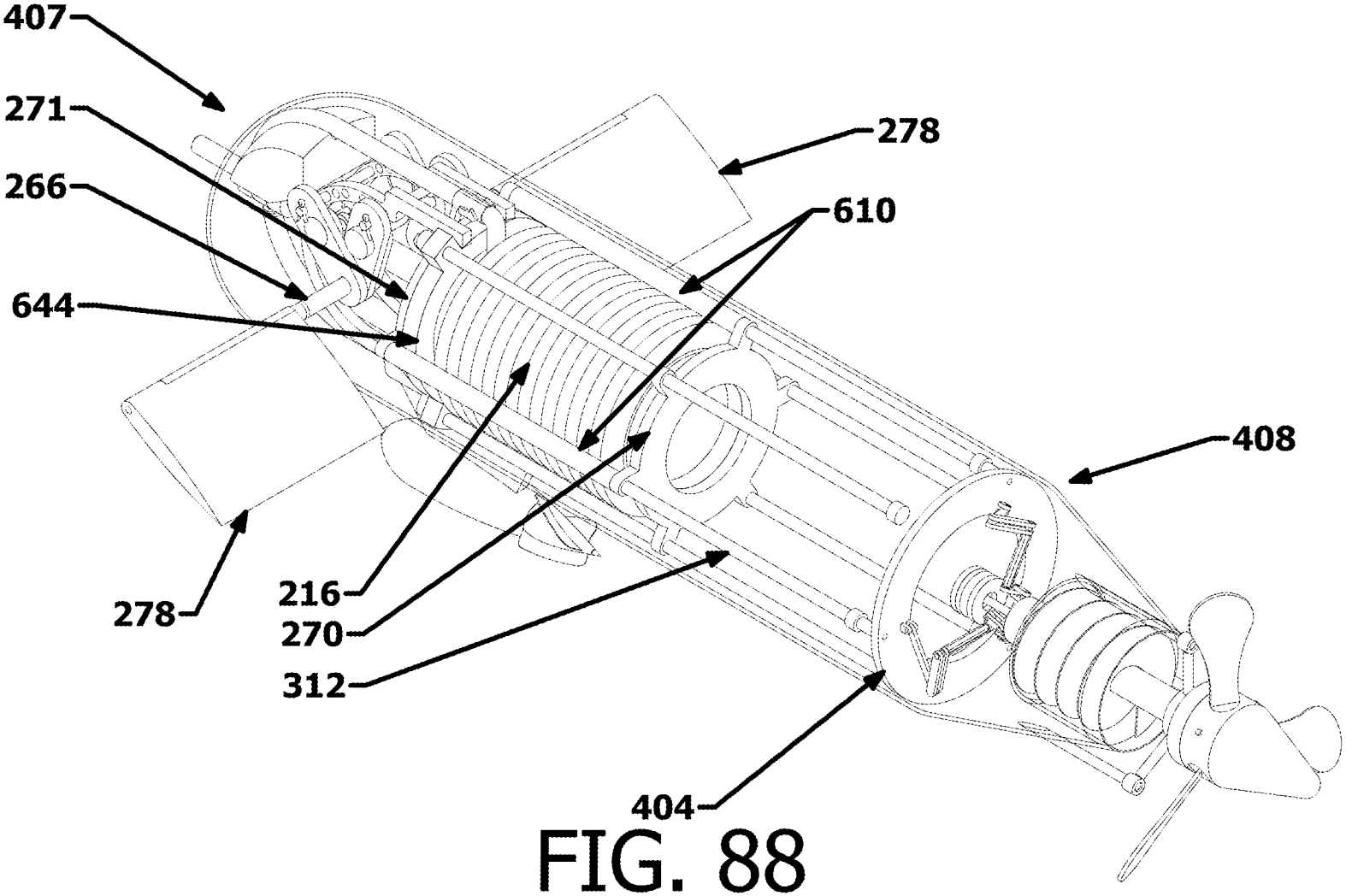
FIG. 88 is a rear, internal perspective view of the bellows system prior to reaching a compressed state and initiation of an actuation process, consistent with embodiments.

As shown in FIGS. 3, 4, and 88, in an exemplary embodiment of the AWS 100, a pleated bellows pipe 216 is situated inside the housing 402. The bellows pipe 216 may be a flexible material, for example a plastic polymer with a rigid internal structure. That rigid internal structure can be comprised of metallic rings 618 as depicted in FIG. 55, that will withstand the changes in pressure as the submarine assembly 400 dives and rises in water. The bellows pipe 216 may be positioned longitudinally inside the housing 402. The bellows pipe 216 may be linearly aligned with the nose of the housing 402 and with the propellor blades 260.

In some embodiments, the bellows pipe 216 may be attached to a set of carriage shafts 312 and 313 that extend from the aft of the housing 402 to adjacent the nose of the housing 402. One end of the bellows pipe 216 may be attached to an actuator plate 270. The actuator plate 270 may include peripheral vias for receipt of the carriage shafts 312 and 313 so that actuation of the bellows pipe 216 is supported by the actuator plate 270 travelling back and forth along the carriage shafts 312 and 315. The bellows pipe 216 chamber 401 is surrounded by ambient water that enters housing 402. The impeller 247 chamber may include an open end so that ambient water may be present, surrounding the impeller 247 allowing ambient water to enter and exit housing 402. A first tube, for example, the snorkel tube 268 may be attached to the opposite end of the bellows pipe 216. The snorkel tube 268 may be in fluid communication with the interior of the bellows pipe 216. A check valve 245 attached to bellows collar 269 allows gravity to route condensed water to a second tube, for example, conduit 252 (FIG. 4).

The Snorkel Tube

Figure 89:
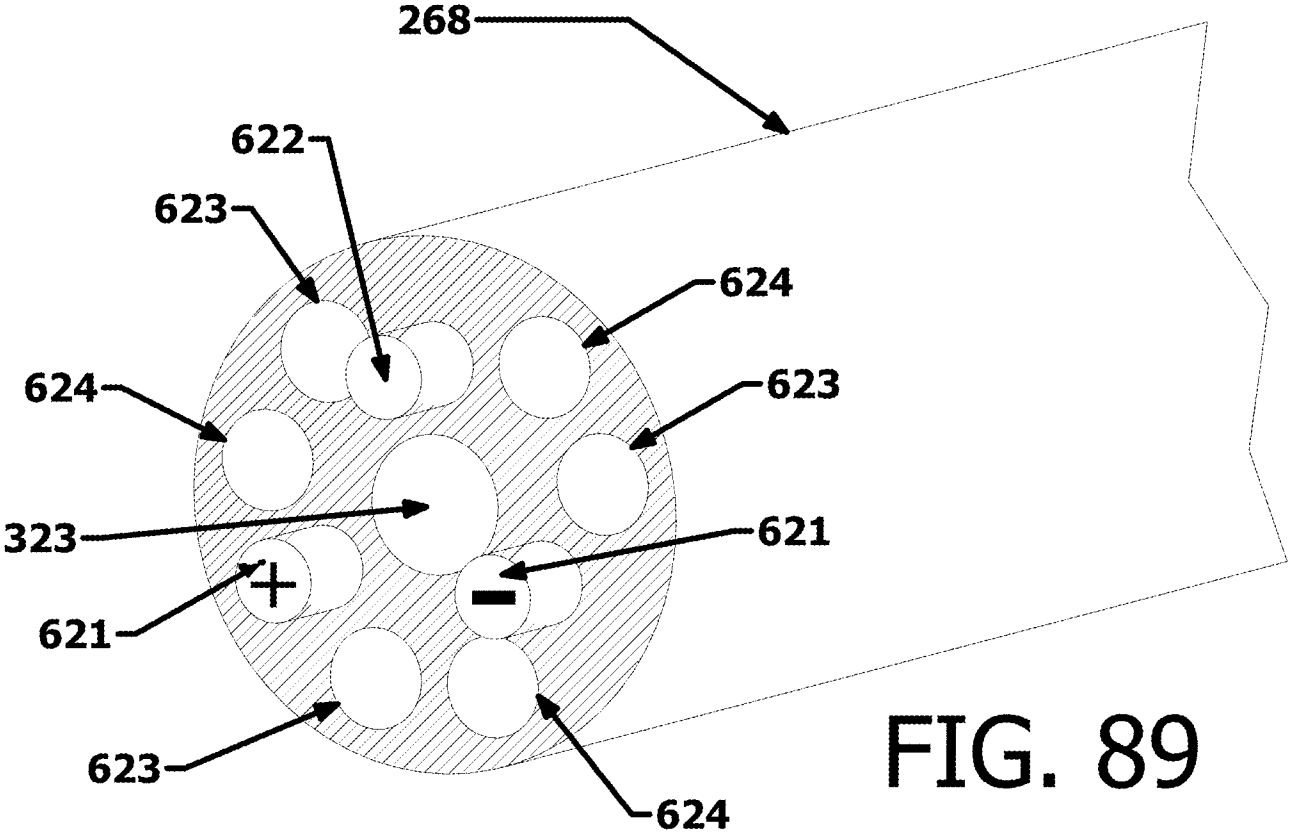
FIG. 89 is a cross-sectional end, perspective internal view of a snorkel tube according to an embodiment.

FIG. 89 depicts an embodiment of the snorkel tube 268. Snorkel tube 268 allows fluid, electrical and data communication between the submersible side of AWS 100 with base station 114. Snorkel tube 268 may be comprised of a flexible polymer and reinforced with metallic strands that can be embedded and/or wrapped around snorkel tube 268. In some embodiments, the snorkel tube 268 may include an inner conduit 323 that allows for the extraction of fresh water from bellows pipe 216. Inner conduit 323 can exit the snorkel tube via elbow fitting 320. Elbow fitting 320 may connect to lower conduit 252. Lower conduit 252 may connect to lower check valve 245. Lower check valve 245 may be connected to lower part bellows 216. Snorkel tube 268 may have one or more fill conduit(s) 623 that allows ambient air to enter bellows 216. Fill conduit 623 may be connected to fill conduit manifold 262. Fill conduit manifold 262 may connect upper fill conduit 625. Upper fill conduit 625 may be connected to upper check valve 525. Upper check valve 525 may be connected to the upper part of bellows 216. Snorkel tube 268 may have one or more compressed air conduit(s) 624. Compressed air conduits 624 may allow compressed air to escape bellows 216. Central air pipe 322 may act as a manifold to connect multiple compressed air conduits 624. Central air pipe 322 may pass through the center of sliding pipe 303 and connect to the center of bellows 216 to allow for the exit of compressed air from bellows 216. Snorkel tube 268 may have electrical conduits 621 (which may transmit positive and negative signals) to allow power from generator assembly 635 to provide electrical power to base station 114. The electrical conduits 621 may exit snorkel tube 268 via an electrical elbow fitting 627. Snorkel tube 268 may have one or more data lines 622 so that the submersible side of AWS 100 may be monitored from GUI 629 at base station 114. Data lines 622 may exit the snorkel tube 268 via the electrical elbow fitting 627. Where snorkel tube 268 connects to base station 114, a base station inner conduit 323 may exit snorkel tube 268 via elbow fitting 649. Where snorkel tube 268 connects to base station 114, a base station fill conduit 623 may exit via fill conduit manifold 650. Where snorkel tube 268 connects to base station 114, electrical conduits 621 and data conduit 622 may exit snorkel tube 268 via electrical elbow fitting 648.

In a general operation of the AWS 100, diving and rising of the AWS in a body of water causes a change in internal pressure of the housing 402. The changes in pressure cause the bellows pipe 216 to compress and decompress (depending on whether pressure is increasing or decreasing). As bellows pipe 216 contracts, air inside bellows 216 is compressed and routed up snorkel tube 268 towards for example, the base station 114. One check valve 513 (seen in FIG. 84) allows that compressing air to enter the compression tank 223. The check valve 245 blocks the water from going back into bellows pipe 216 when the submarine body 402 is in a nose high attitude. When bellows pipe 216 starts to expand, air will be drawn in from snorkel tube 268. When that happens the check valve 513 that previously let air into the compression tank 223 will remain closed. The check valve 525 that previously did not let air out of snorkel tube 268 will instead let air into the bellows pipe 216 via snorkel tube 268.

On the aft side of the AWS 100, as water passes over propeller blades 260, the shaft 253 will rotate. Propeller blades 260 turns in response to water flow around the submarine assembly 400. That flowing water deflects off propeller blades 260 causing shaft 253 to rotate. Shaft 253 is connected to impeller 247. The impeller 247 pumps water into or out of the rear open area of the submarine assembly 400. The impeller blade 247 may turn, pumping water into or out of the rear of housing 402 depending on the direction of the impeller's rotation. Water enters and exits the rear of housing 402 via the open end from which the propellor blades 260 projects out from. The propellor blades 260 chamber part of the housing 402 may surround the impeller 247. The water passes around and is driven by impeller 247. When water is pumped into submarine housing 402 via the action of impeller 247, the bellow pipe 216 will compress. When water is pumped out of submarine housing 402 via the action of impeller 247, the bellows pipe 216 will expand.

The direction of rotation of shaft 253 depends on the angle of propeller blades 260. The angle of the propeller blades 260 can be controlled by a system of actuator components which will be later explained. In some embodiments, the blade angle may change due, in part, to operation of shaft 310 which is inside shaft 253 (See FIG. 39). Shaft 310 rotates with 253 but it is also configured to slide forward and aft. This forward and aft motion, in part, is what is responsible for changing the blade angle of blades 260 (See also FIG. 67 and related description). As the submarine assembly 400 dives, water pressure will increase with depth. This pressure assists in compressing the bellows 216. Conversely, as the submarine assembly 4010 ascends, pressure levels within the housing 402 will lessen and the bellows pipe 216 will expand. The expansion of bellows pipe 216 may be assisted by rotational assembly 102 (see for example, FIGS. 24, 26, 27, and 29). Rotational assembly 102 pumps water outside of housing 402 via rotating impeller 247 blade.

Figure 54:
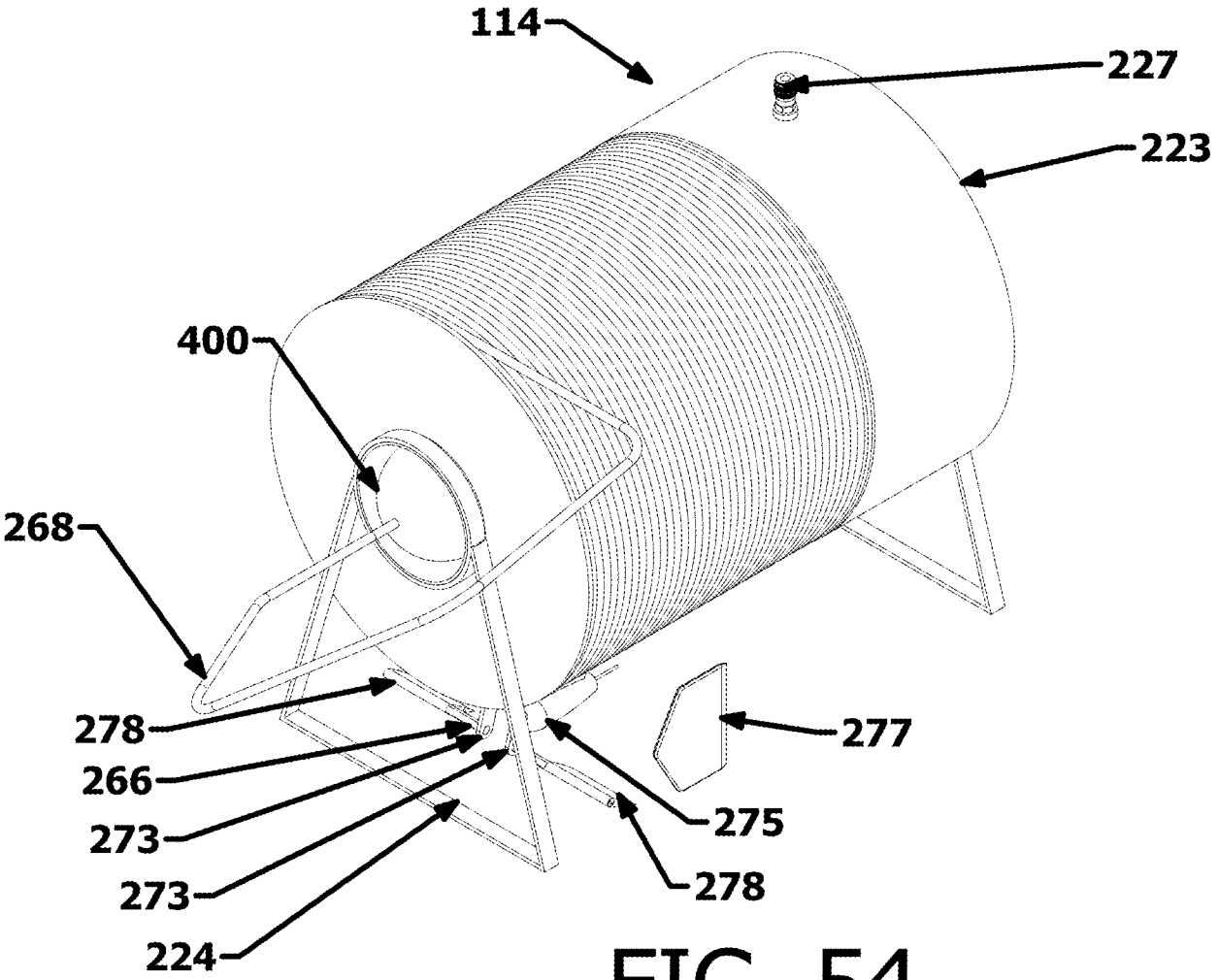
FIG. 54 is a perspective view of a base unit in accordance with an embodiment.
Figure 84:
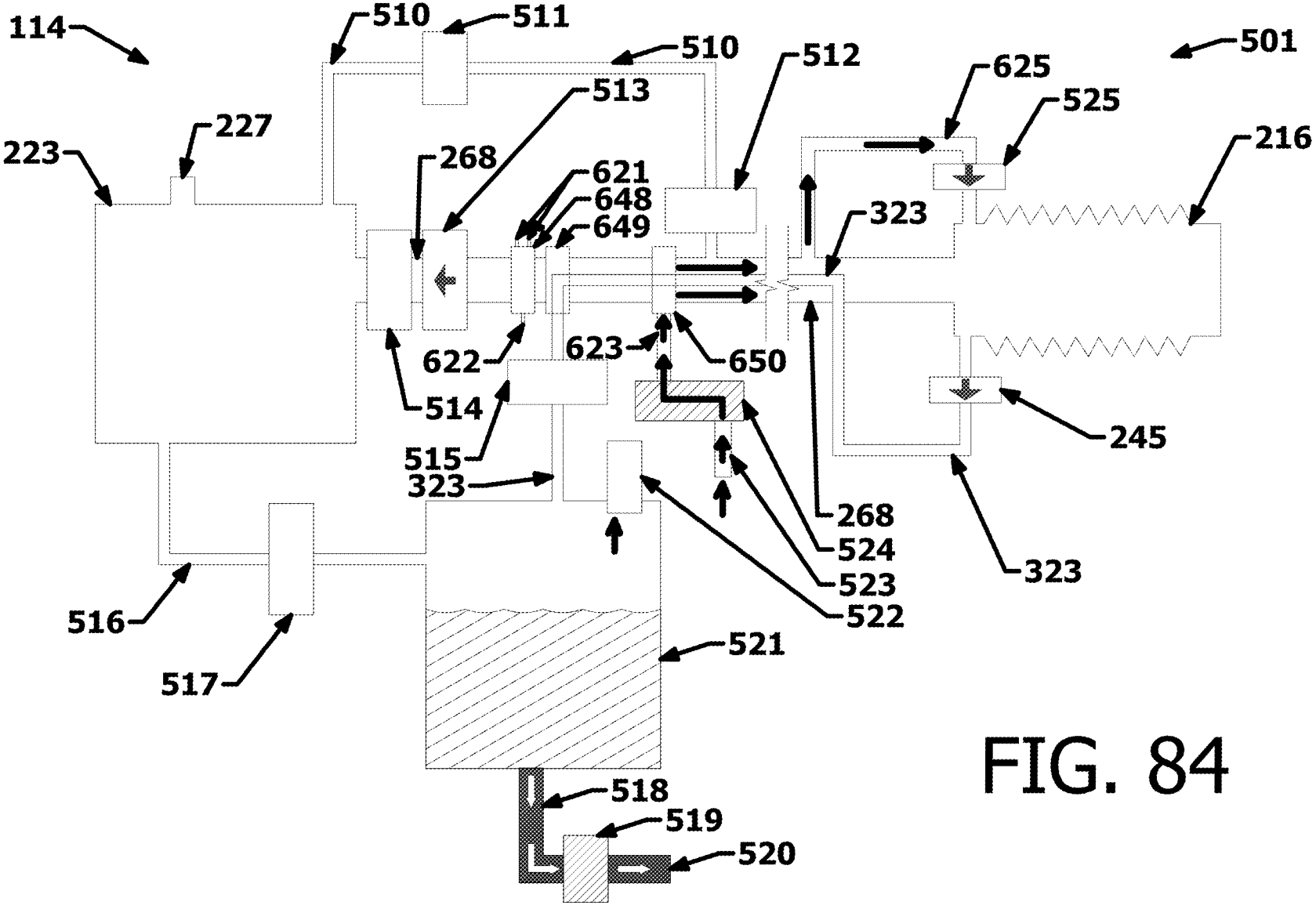
FIG. 84 is a schematic view of a gas circulation path to fill a bellows pipe with ambient air consistent with embodiments.

Referring temporarily to FIG. 54, as the bellows pipe 216, expands, the bellows pipe 216 refills with ambient air from the atmosphere or other over the waterline source, via a check valve 525 FIG. 84 connected to the snorkel tube 268. The contracting of the bellows pipe 216 compresses air inside the bellows pipe 216. The compressed air may be transported to the storage tank 223, via the snorkel tube 268 and check valve 513 FIG. 85. In some embodiments, the storage tank 223 may include an external support frame 224 that may include legs for keeping the tank 223 stable on flat surfaces. The base system 114 may generally be above water can be placed on shore or other solid surface (ground or floating vessel) connected to the housing 402 by snorkel tube 268. In some embodiments, when not in use, the submarine housing 402 may be conveniently stored inside the tank 223. The parts external from the housing 402 may be removable and stored underneath the tank 223. For example, a vertical stabilizer 277 that may have been attached to the housing 402 is shown detached for storage. Some embodiments may include an air release connection valve 227, which may be for example, a connector valve that provides release of the compressed air in the tank 223 to a compressed air application.

Figure 87:
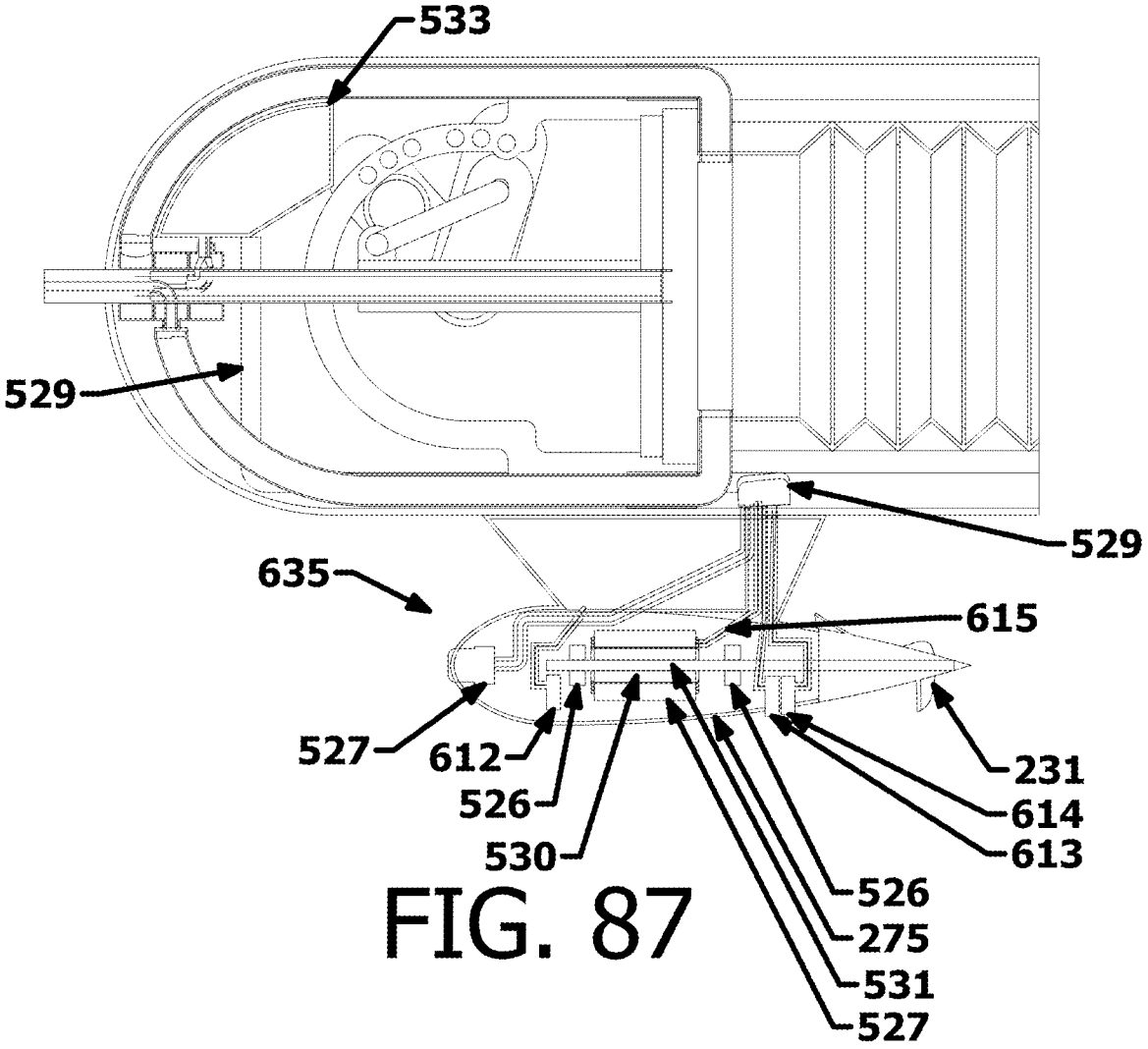
FIG. 87 is an enlarged, internal side view of a ballast system according to an embodiment.
Figure 90:
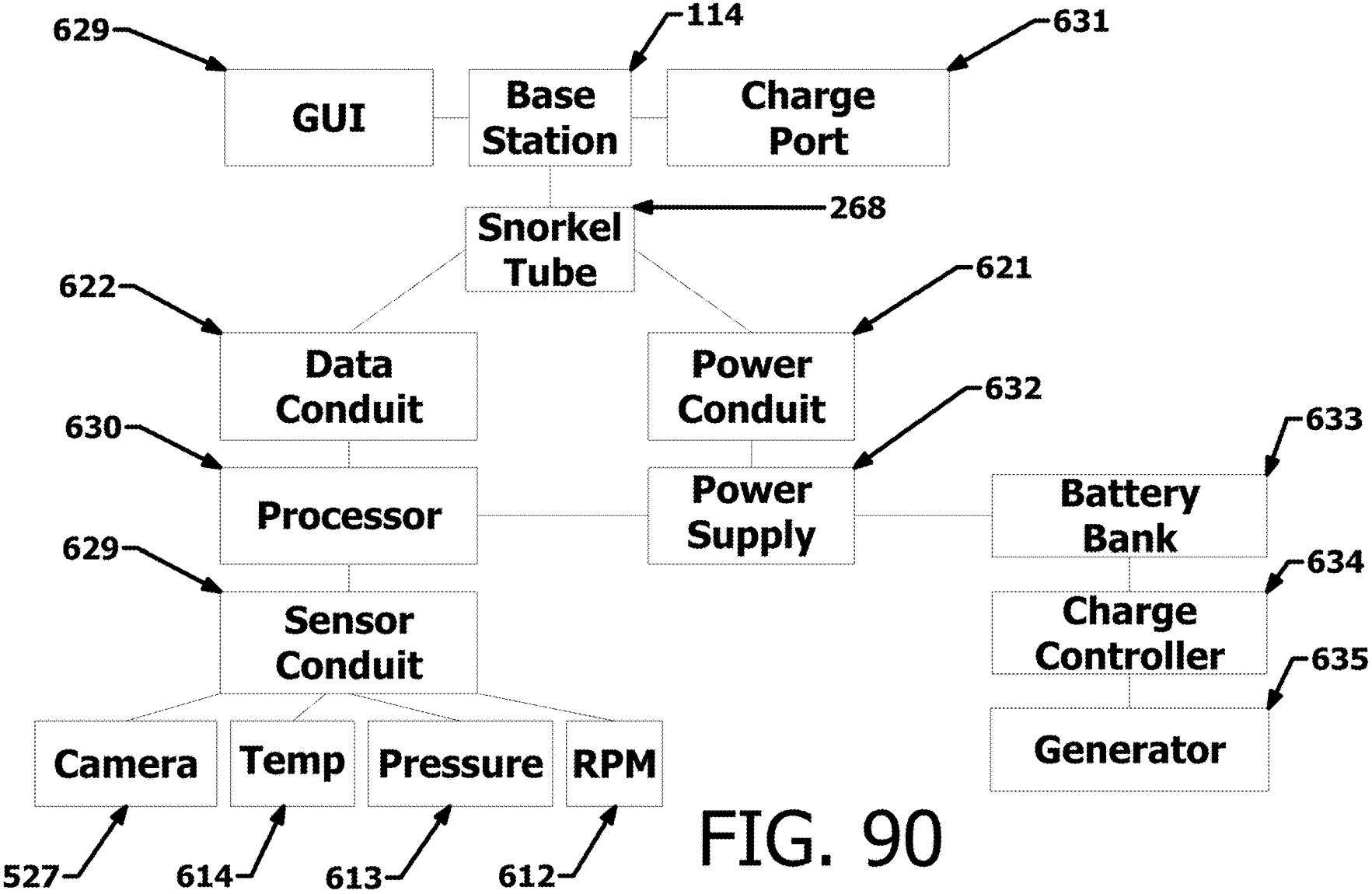
FIG. 90 is a block diagram of an air-water submarine electrical assembly according to an embodiment.
Figure 91:
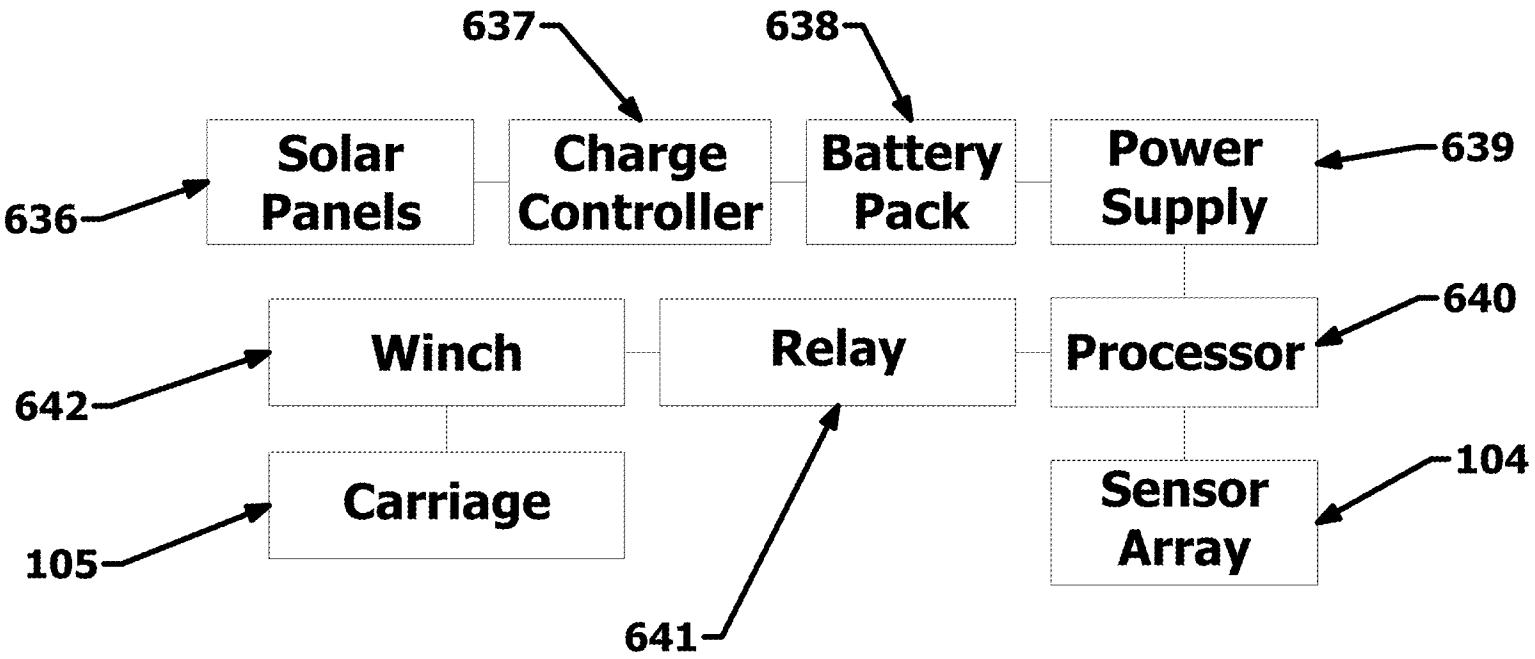
FIG. 91 is a block diagram of a power system architecture according to an embodiment.

In some embodiments, the submarine assembly 400 may include an external ballast 275 (see for example, FIGS. 3, 4, and 87), which may include its own propeller 231 that turns fluid flow around the submarine assembly 400 into rotational energy. This rotational energy may be used to generate electricity onboard the submarine assembly 400. The water passing over submarine assembly 400 will cause blades 231 to rotate. That blades 231 may be attached to a generator shaft 531. Generator assembly 635 may be comprised of a generator shaft 531 may be attached to magnetic rotor 530. A stator coil assembly 527 may be placed closely adjacent to magnetic rotor coil 530 for the purpose of generating an electrical current for use in the AWS system. Magnetic rotor coil 530 may be connected by generator wires 615 which may be routed via snorkel tube 268 to base station 114. Electricity may be used for any purpose at base station 615, for example, powering a graphic user interface that monitors sensors located in ballast 275. Generator assembly 635 may be sized according to the needs of the end user and the system requirements. Ballast 275 may have a camera 527. The ballast 275 may have an RPM sensor 612 that monitors generator shaft 531. The generator shaft 531 may be held in place by generator shaft bearings 526. The ballast 275 may contain a temperature sensor 614 and a depth/pressure sensor 613. All wires from the ballast may connect to electronics bay 533 via a conduit for ballast wires 529. Electronics bay 533 may aggregate all wire connections from ballast 275 into a processor 630 (FIG. 90) into a data line 622 that may also be routed via snorkel tube 268 to base station 114. FIG. 90 depicts an embodiment of an electrical assembly and flow. Base station 114 may monitor the functions of the system via a GUI 629 (Graphic User Interface) that can be powered by the electricity generated from ballast 275. Electricity can be used to power items such as sensors, cameras, etc. The external ballast 275 can also be helpful in keeping the AWS 100 upright relative to gravity.

Forward Actuator Assembly

Referring now to FIGS. 10-15, a forward actuator assembly 300 is shown. The forward actuator assembly 300 puts the submarine assembly 400 in a nose up or nose down attitude in relation to the movement of water. The forward actuator assembly 300 may be connected to the elevators 278 and 235. The actuator assembly 300 may include a forward actuator plate 271, a forward lever 273 coupled to the forward actuator plate 271, a swing arm 301, bracket 302, and a central collar 303. In some embodiments, the central air pipe 322 passes through the sliding pipe 303. The central air pipe 322 can also be hollow to allow compressed air to travel from bellows 216 to snorkel tube 268. Sliding pipe 303 butts up against and attaches to 271. A D shaft 266, positioned transverse to the central air pipe 322, may be coupled to the lever 273.

Figure 31:
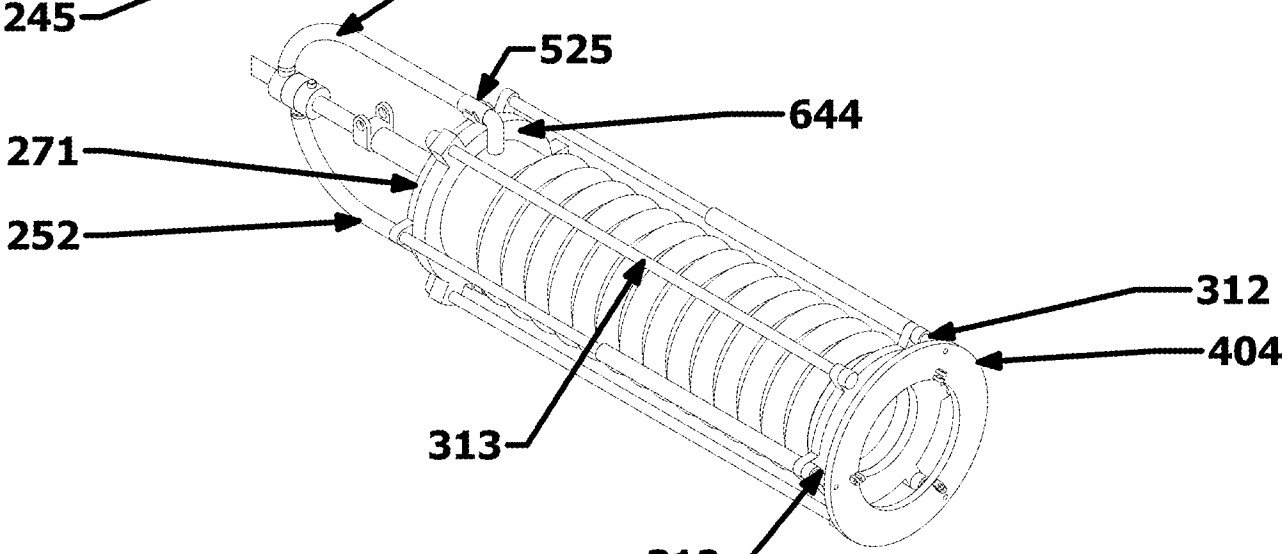
FIG. 31 is a perspective view of the compressible pipe module of FIG. 30.
Figure 32:
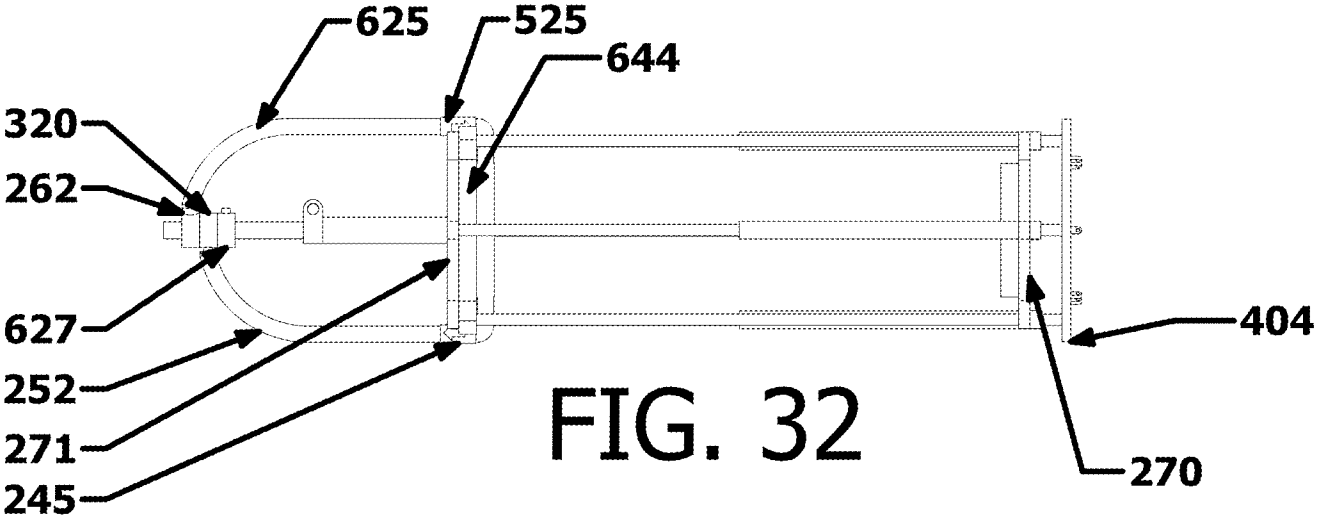
FIG. 32 is a side view of a carriage system in a first state in accordance with an embodiment.
Figure 33:
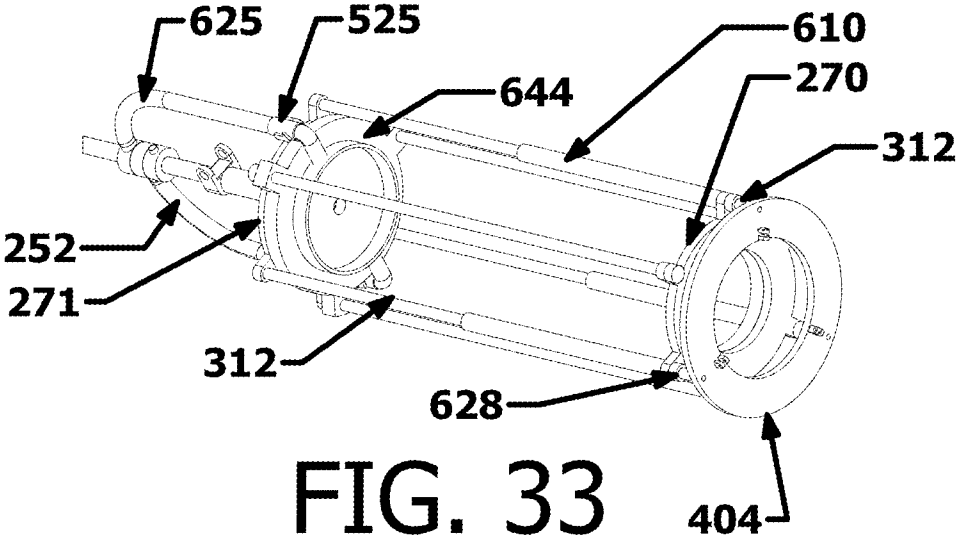
FIG. 33 is a perspective view of the carriage system of FIG. 32.
Figure 34:
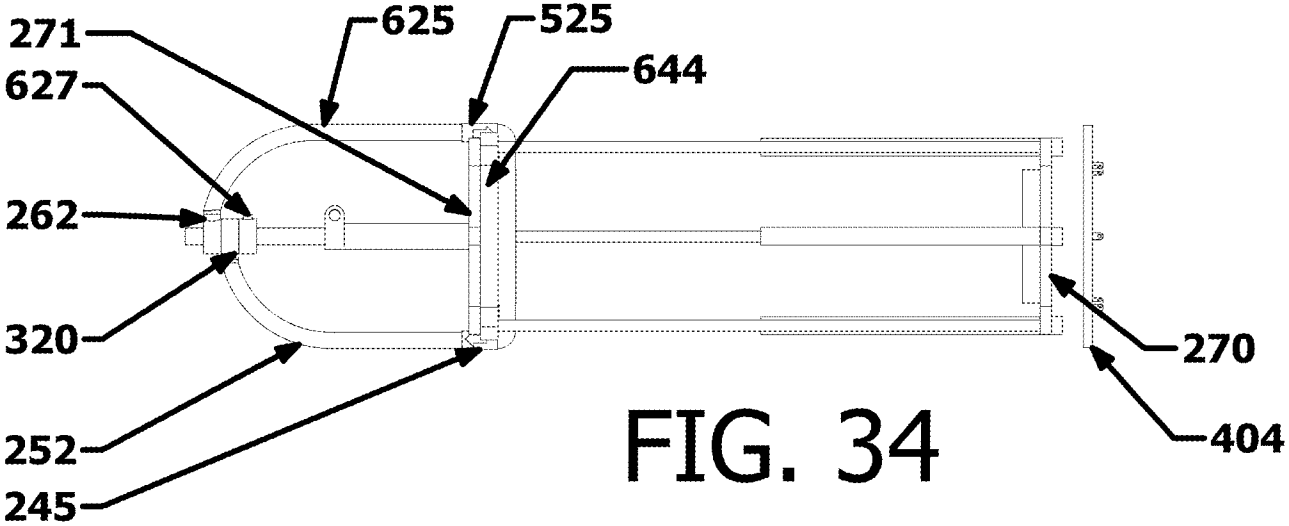
FIG. 34 is a side view of the carriage system of FIG. 31 in a second state.
Figure 35:
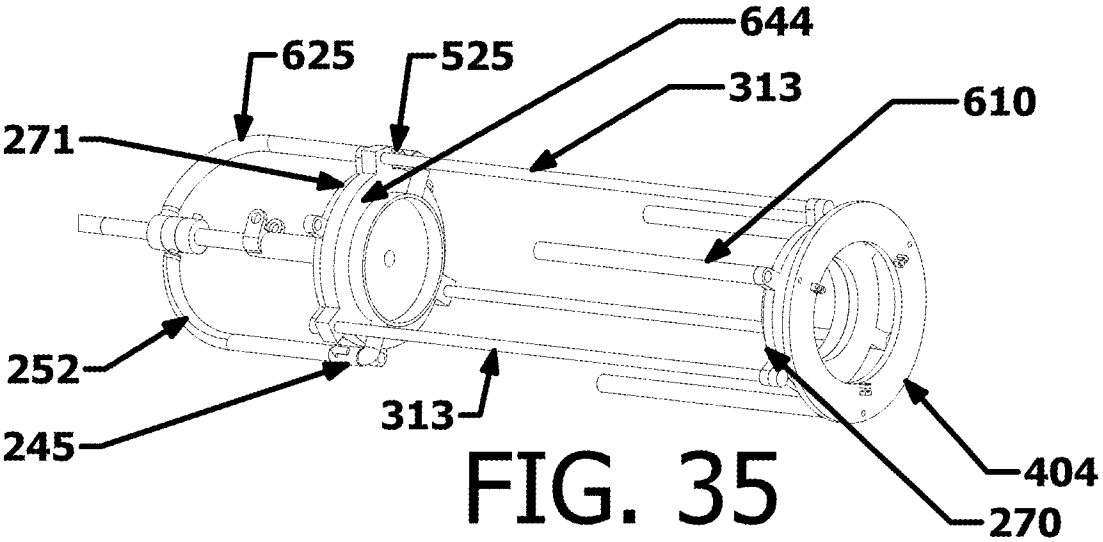
FIG. 35 is a perspective view of the carriage system of FIG. 34.

The bellows pipe 216 may be connected to an actuator plate 270 (See FIGS. 31, 33, and 35). The actuator plate 270 may include tubes 610 and tubes 610 that slide back and forth on actuator rods 312.

Sliding pipe 303 may be attached to forward actuator plate 271. Sliding pipe 303 slides back and forth outside of central air pipe 322 (shown in FIGS. 30, 32, 34, 36, 37). The action of the bracket 302 attached to sliding pipe 303 and to swing arm 301, pulls on forward levers 273 which rotates D shaft 266 (See FIGS. 11, 12, 14, 36, 37). The D shaft 266 turns elevators 278. The elevators 278 connected to control arms 274 also change the angle of flaps 235. The forward actuator assembly 300 may be linked to the aft actuator assembly 408 via actuator rods 312 and rods 313.

AFT Actuator Assembly

Referring now to FIGS. 67, 80, 81, 88, 408 aft actuator assembly. Aft actuator assembly 408 functions to connect transfer plate 404 with blades 206 for the purpose of change the state of blades 206. As propellor blades 260 begin to change angle, at one point the propellor blades 260 will be in a neutral position relative to the flow of water. There may be multiple spring assemblies 117 to assist propellor blades 260 in fully actuating beyond the neutral position.

The Diving Phase

When elevators 235 and 278 are situated as depicted in FIG. 3, the angle of attack of the AWS 100 relative to the flow of fluid will be nose down. When the angle of attack of the AWS 100 is nose down, the top side of dive planes 403 and 276 will have higher pressure than the bottom side due to the relative flow of fluid. This difference in pressure will cause the AWS 100 to dive deeper in the water column.

Due to higher pressures at depth, bellows 216 will begin to compress as the submarine assembly 400 continues to dive. When the bellows pipe 216 compresses the amount of air in the submarine assembly 400 is reduced. The buoyancy will decrease with less air in the bellows pipe 216 which will assist the submarine assembly 400 to dive in the water column.

As the bellows pipe 216 compresses, the actuator plate 270 will begin to move towards the housing nose while sliding along actuator rods 312. Eventually, the tubes 610 connected to actuator plate 270 will make contact with forward actuator plate 271 (See FIG. 88). Forward actuator plate 271 which is connected to sliding tube 303, will pull on bracket 302. Bracket 302 will pull on swing arm 301. Swing Arm 301 will pull forward lever 273. Forward lever 273 will rotate D shaft 266. D shaft 266 rotates Elevator 278. Elevator 278 is connected to elevator(s) 235 by control arms 274. Control arms 274 will cause Elevators 235 and 278 to rotate in unison. After full rotation the elevators will be in the position to ascend as depicted in FIG. 4. When the forward end of actuator rods 312 are permanently affixed to forward actuator plate 271, the rear actuator assembly will simultaneously actuate changing the state of blades 260.

As the forward actuator plate 271 moves forward, it will pull actuator rods 312 forward. Actuator rods 312 will pull on transfer plate 404. Transfer plate 404 will pull on first lever 306. First lever 306 will pull on double levers 405. Double levers 405 will rotate actuator shaft 406. Actuator shaft 406 will rotate secondary lever 305. Secondary lever 305 will pull on contact lever 304. Contact lever 304 will pull on bearing housing 311. Bearing housing 311 will pull on prop shaft 310. A rack gear 209 may be connected to the aft side of prop shaft 310. The rack gear 209 may contact and rotate blade gears 321 and intermediary blade gears 229. The blade gears 321 connected to the base of blades 260 will rotate the blade(s).

When blades 260 are rotated they will deflect water moving over submarine assembly 400 such that the rotation of shaft 253 will reverse. Shaft 253 connected to impeller 247 will cause impeller 247 to reverse rotation. The reverse of impeller 247 will start pumping water outside of submarine assembly 400. When impeller 247 pumps water outside of submarine assembly 400 the pressure inside submarine assembly 400 will decrease causing bellows pipe 216 to expand as submarine assembly 400 continues to ascend in the water column.

The Ascending Phase

When elevators 235 and 278 are situated as depicted in FIG. 4, the angle of attack of the AWS 100 relative to the flow of fluid will be nose up. When the angle of attack of the AWS 100 is nose up, the top side of dive planes 403 and 276 will have lower pressure than the bottom side due to the relative flow of fluid. This difference in pressure will cause the AWS 100 to ascend in the water column.

Due to lower pressures closer to the surface, bellows pipe 216 will begin to expand as the submarine assembly 400 continues to ascend. When the bellows pipe 216 expands the amount of air in the submarine assembly 400 is increased. The buoyancy will increase with more air in the bellows pipe 216 which will assist the submarine assembly 400 to ascend in the water column.

As the bellows pipe 216 expands, the actuator plate 270 will begin to move aft, away from the nose while sliding along actuator rods 312. Eventually, actuator plate 270 will make contact with push rings 628 attached to actuator rods 312 (See FIG. 33). Actuator rods 312 connected to forward actuator plate 271 will start to pull forward actuator plate 271 aft. Forward actuator plate 271 which is connected to sliding tube 303, will push on bracket 302. Bracket 302 will push on swing arm 301. Swing Arm 301 will push forward lever 273. Forward lever 273 will rotate D shaft 266. D shaft 266 rotates Elevator 278. Elevator 278 is connected to elevator(s) 235 by control arms 274. Control arms 274 will cause Elevators 235 and 278 to rotate in unison. After full rotation the elevators will be in the position to descend as depicted in FIG. 3.

When the forward end of actuator rods 312 are permanently affixed to forward actuator plate 271, the rear actuator assembly will simultaneously actuate changing the state of blades 260.

As actuator plate 270 moves aft it will push the push rings 628 aft. As push rings 628 (connected to actuator rods 312) move aft they will push transfer plate 404 aft. Transfer plate 404 will then push on first lever 306. First lever 306 will push on double levers 405. Double levers 405 will rotate actuator shaft 406. Actuator shaft 406 will rotate secondary lever 305. Secondary lever 305 will push on contact lever 304. Contact lever 304 will push on bearing housing 311. Bearing housing 311 will push on prop shaft 310. Rack gear 209 can be connected to the aft side of prop shaft 310. Rack gear 209 can make contact and rotate blade gears 321 and intermediary blade gears 229. Blade gear 321 connected to the base of blades 260 will rotate the blade(s).

When blades 260 are rotated they will deflect water moving over submarine assembly 400 such that the rotation of shaft 253 will reverse. Shaft 253 connected to impeller 247 will cause impeller 247 to reverse rotation. The reverse of impeller 247 will start pumping water inside of submarine assembly 400. When impeller 247 pumps water inside of submarine assembly 400 the pressure inside submarine assembly 400 will increase causing bellows 216 to contract as submarine assembly 400 continues to dive in the water column.

The diving and ascending phase will continue to repeat as described above when water continues to flow over submarine assembly 400.

Figure 61:
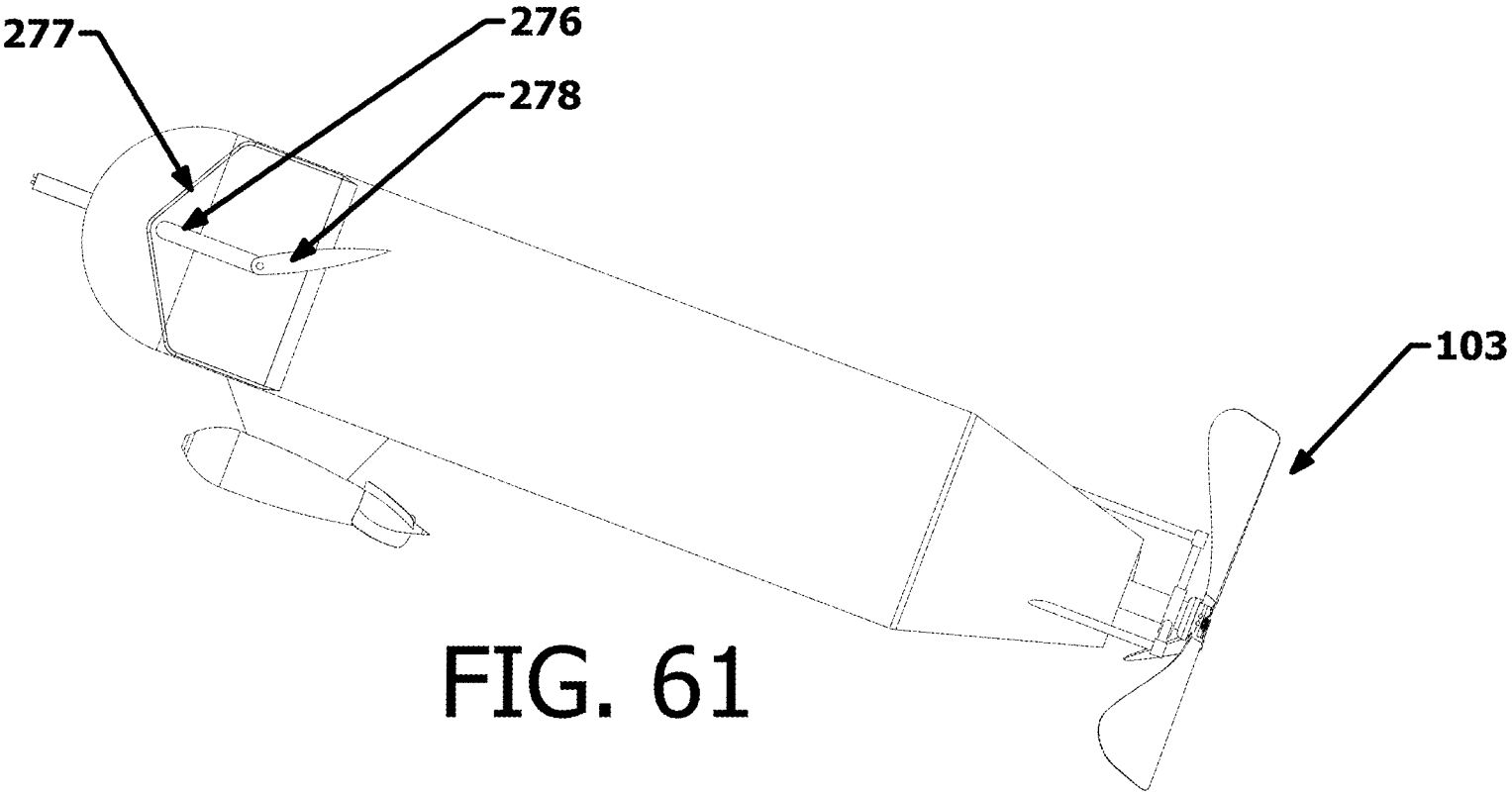
FIG. 61 is a side view of the submarine of FIG. 60, ascending.
Figure 62:
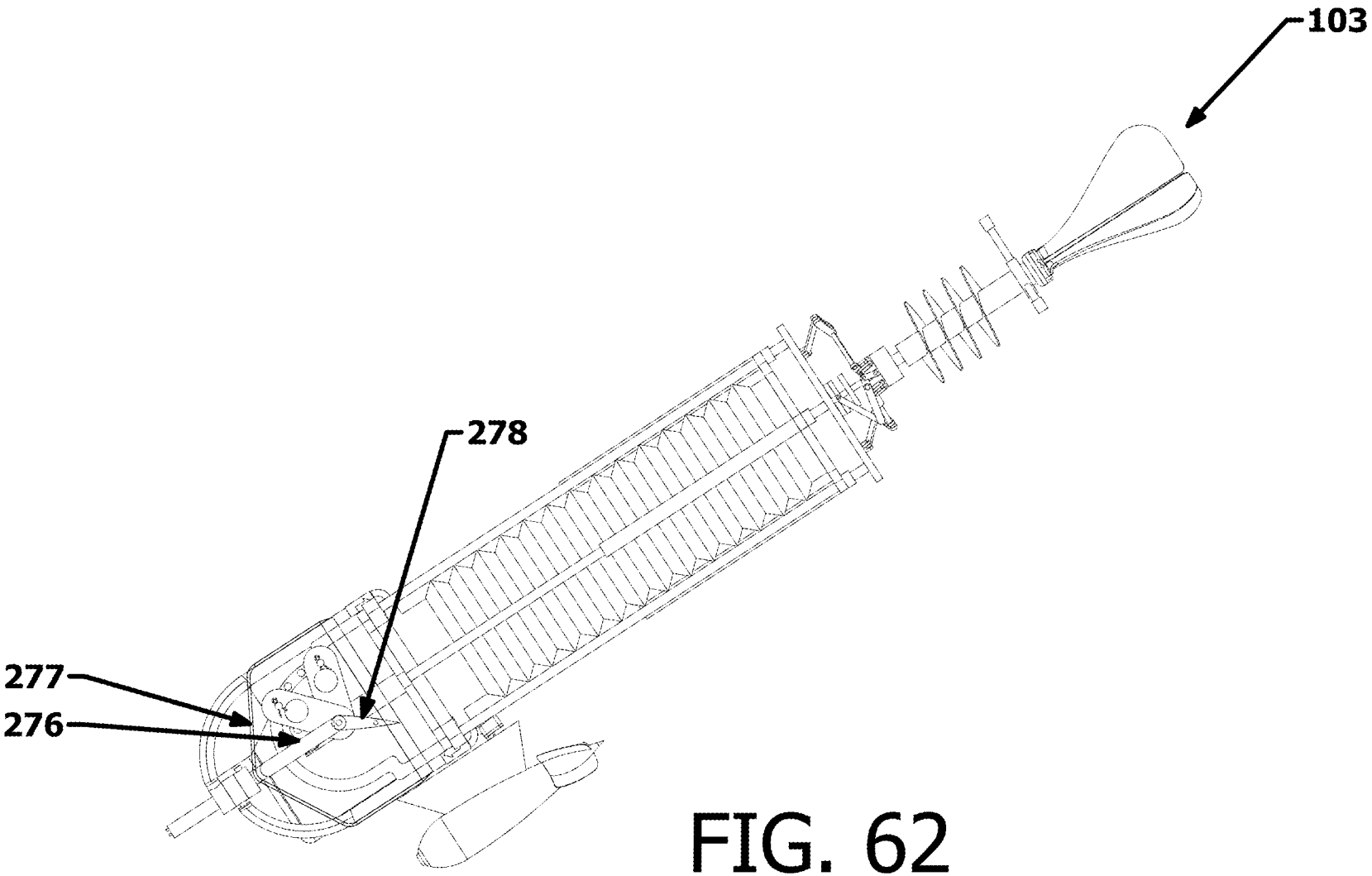
FIG. 62 is a side view of the submarine of FIG. 60, descending.
Figure 63:
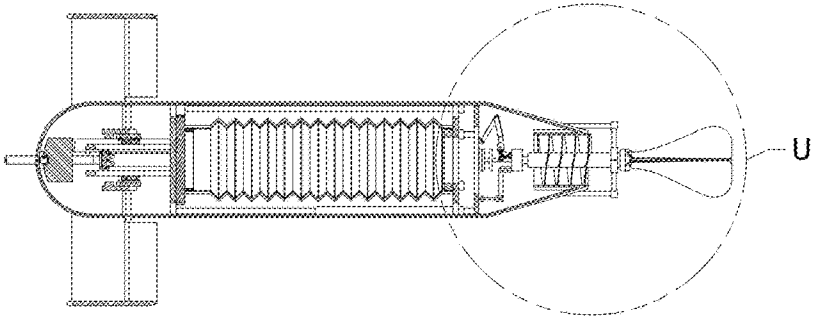
FIG. 63 is a cross-sectional top view taken along the line T-T, showing a compressible pipe in an expanded state.
Figure 64:
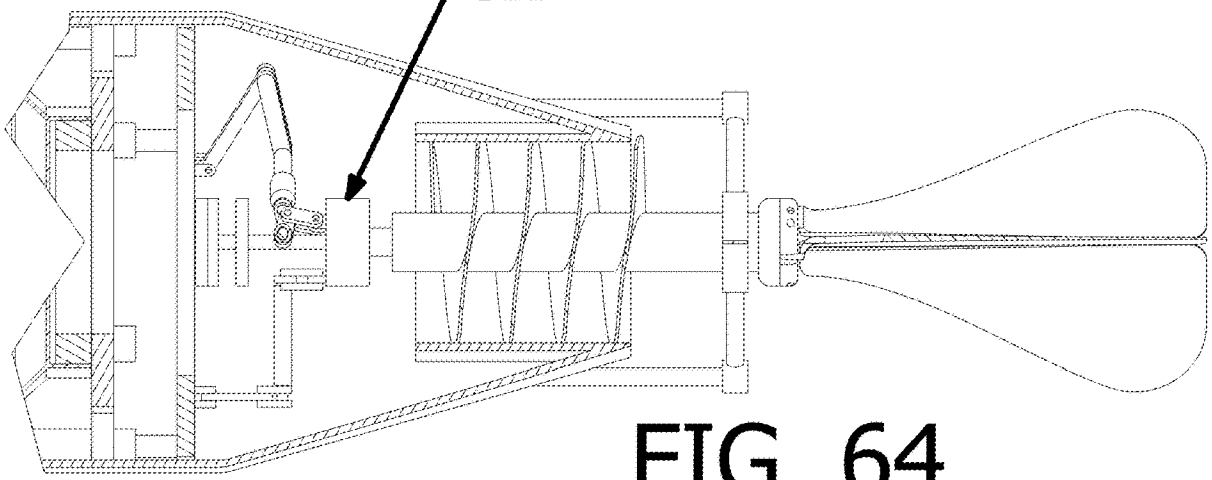
FIG. 64 is an enlarged view of the circle U of FIG. 63.
Figure 65:
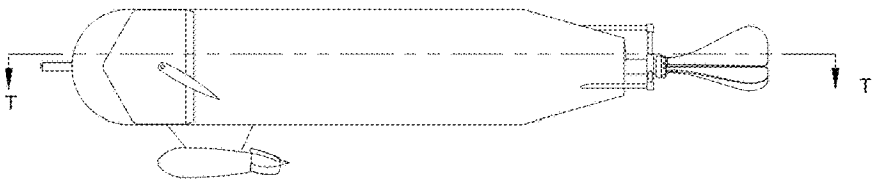
FIG. 65 is a side view of the submarine of FIG. 60.

In some embodiments, the blades 260 may be configured to collapse and unfurl. The action of prop shaft 310 may unfold folding blades 103 from a collapsed state (compare FIG. 61 to FIG. 62).

The forward end of shaft 310 can have a flange that holds it inside bearing housing 311. Bearing housing 311 can contain bearings 645 on both sides of the flange on 310 to facilitate rotation of shaft 311.

FIGS. 69-72 show an embodiment of a rear propeller that can unfurl from one state to another. The action of propellor shaft 310 connected to linear gears 652 unfurls folding blades 103. Linear gears 652 on the tail of propellor shaft 310 may interact with folding blade gears 308. In the embodiment shown, folding blades 103 can fold back during the decent. When folded, there is less drag on the AWS 100. When the AWS 100 is being pulled by a boat, reducing drag may be a desired benefit. One function of the propellor is to turn the motion of the water into rotation during the ascent. This rotation during the ascent helps to pump water out of submarine assembly 400. When water is pumped out of submarine assembly 400, bellows pipe 216 will begin to expand. The non-folding style propellor 260 will rotate in both the dive and ascent phase. Propellor 260 functions to add pressure inside submarine assembly 400 during the descent and decrease pressure inside submarine assembly 400 during the ascent.

Folding blades 103 may remain in the folded position when the AWS 100 is in diving mode. Folding blades 103 may be unfolded during the ascent of the AWS 100 to pump water outside of submarine assembly 400, to expand bellows pipe 216.

Bellows Pipe Operation

Referring now to FIGS. 40-57, an illustrative operation of the bellows pipe 216 is provided. The base of bellows pipe 216 can be held secure when attached and sealed around pipe section 646. Pipe section 646 can be part of stationary bracket 644. Stationary bracket 644 can be affixed to the submarine assembly housing 402. The interior of bellows pipe 216 will seek to maintain the same pressure as the water inside 402 and outside of the bellows pipe 216. When the water in that space is a higher pressure than inside the bellows pipe 216, then the bellows pipe 216 will contract. When the water pressure in that space is less than the bellows pipe 216, then the bellows pipe 216 will expand. When the rotation of shaft 310/253 reverses, the reverse rotation will begin to create lower pressure inside housing 402 causing bellows pipe 216 to expand. As propeller blades 260 begins to change angle, at one point the propeller blades 260 will be in a "neutral" position relative to the flow of water. There may be multiple spring assemblies 117 which include springs 246 and 293. The springs 246 and 293 store energy needed to push propeller blades 260 passed the neutral position and into the opposite angle. Energy in the springs 246 and 293 is stored then released at once to help fully change the angle of propeller blades 260 passed the neutral position. Spring 293 becomes compressed and stores energy as the bellows pipe 216 compresses. The energy in spring 293 is released when the bellows pipe 216 expands. The spring 246 becomes compressed as the bellows pipe 216 expands. The energy in spring 246 is released when the bellows pipe 216 moves toward compression.

The angle of propeller blades 260 may be considered "one of" the driving forces effecting bellows pipe 216. The other driving force effecting bellows pipe 216 is the pressure of the surrounding water. The deeper the AWS dives into water, the more pressure there is on bellows pipe 216. The spring mechanisms 246 and 293 may help to change the blade angle of propeller blades 260 more effectively than the pressure of the ocean alone.

Figure 42:
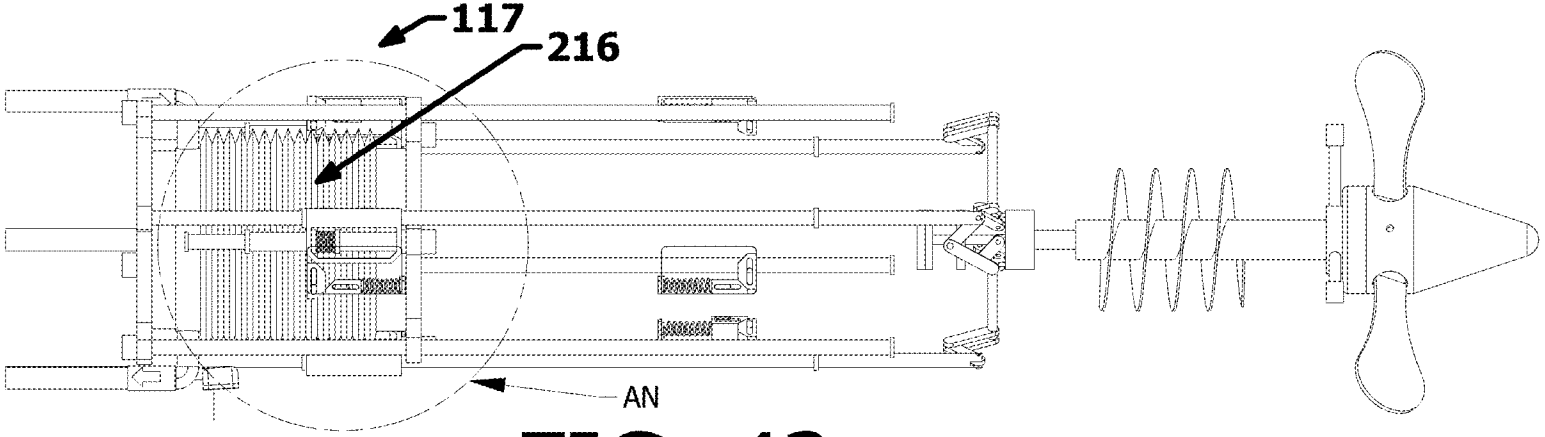
FIG. 42 shows an internal side view of the bellows system of FIG. 40, in a further compressed state.
Figure 43:
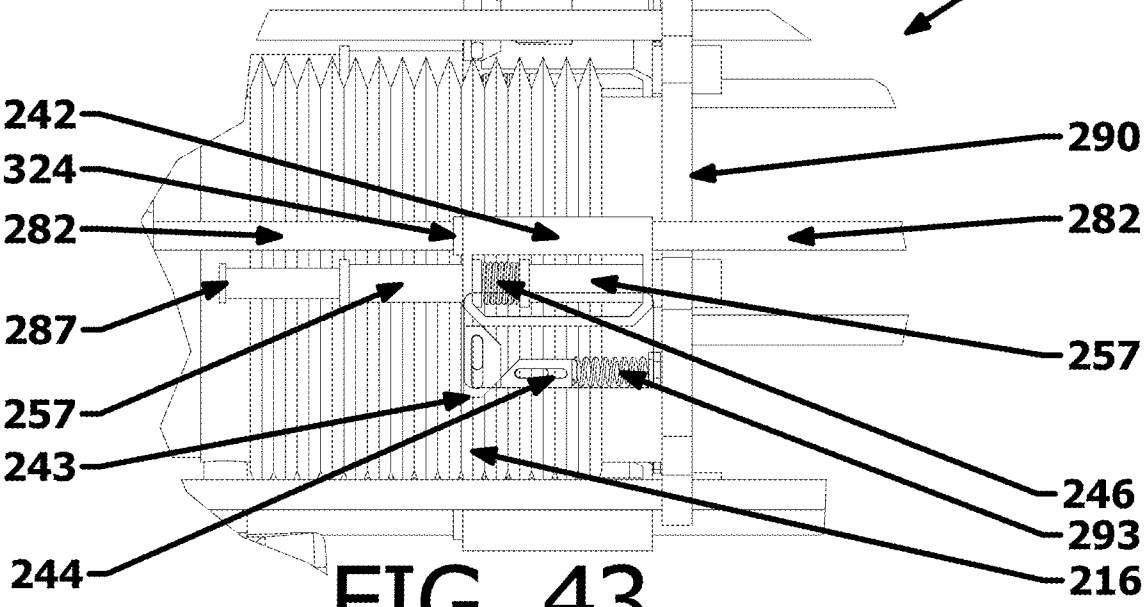
FIG. 43 is an enlarged view of the circle AN in FIG. 42.
Figure 44:
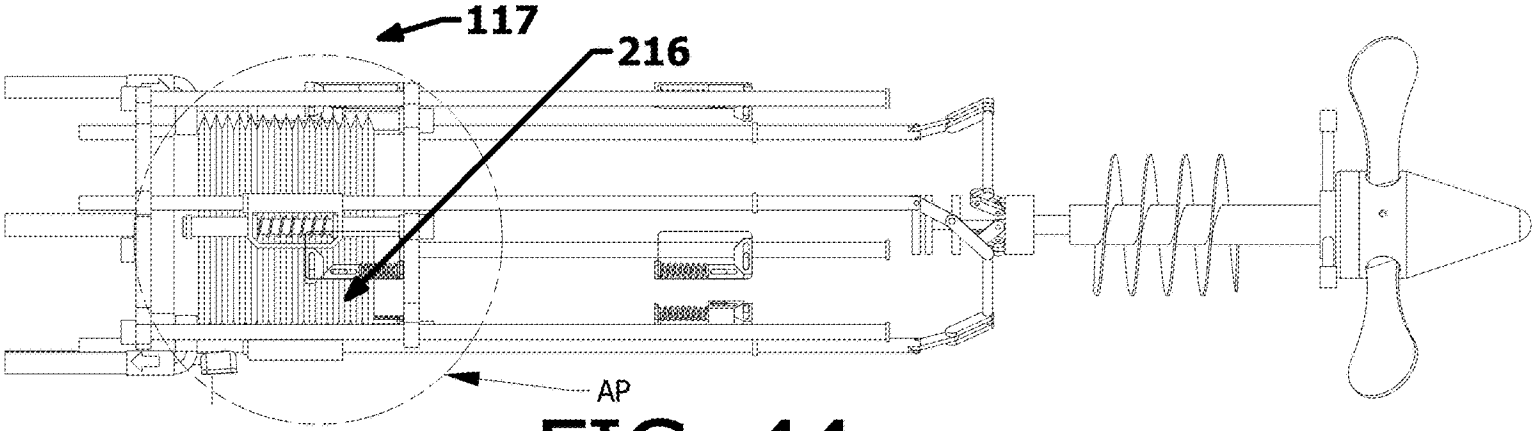
FIG. 44 shows the bellows system of FIG. 42 with a spring system releasing energy according to an embodiment.
Figure 45:
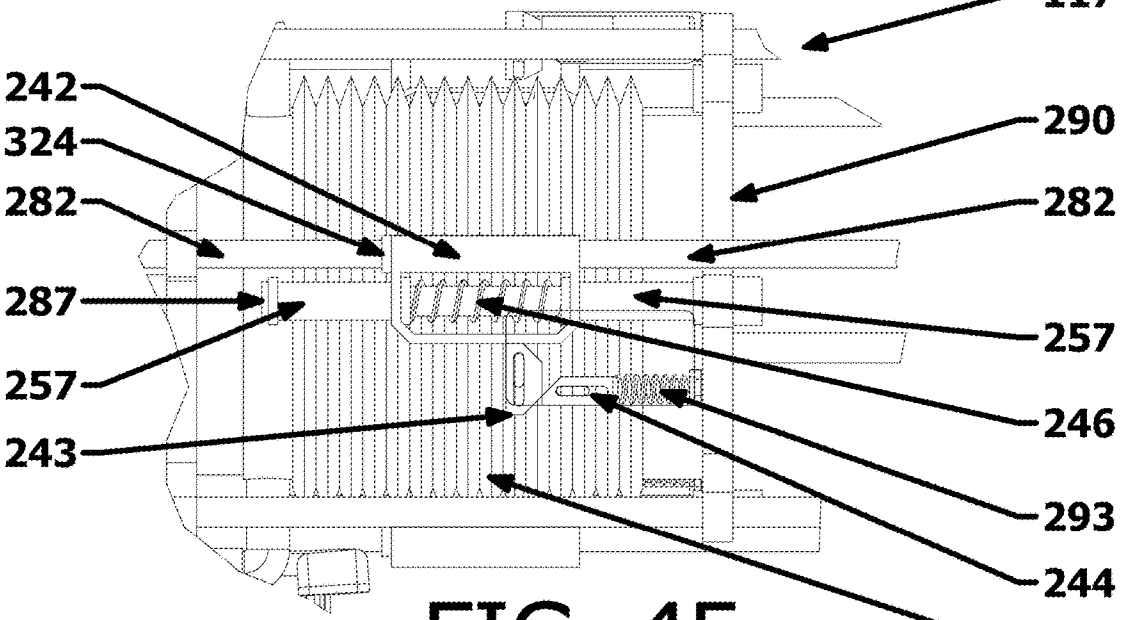
FIG. 45 is an enlarged view of the circle AN in FIG. 44.
Figure 46:
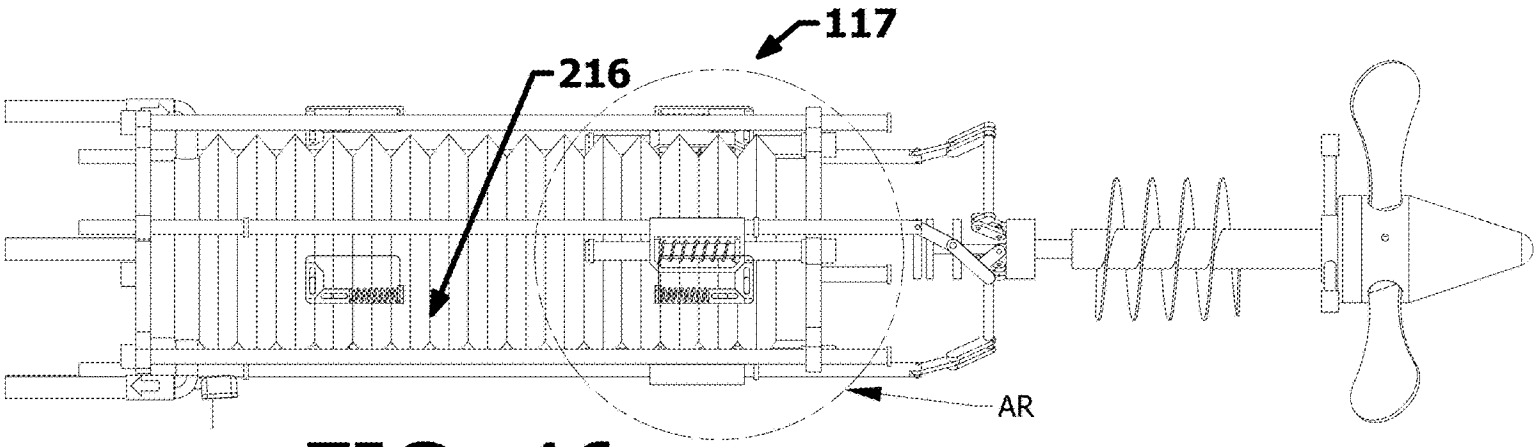
FIG. 46 shows the bellows system of FIG. 44 in a state of expansion according to an embodiment.
Figure 47:
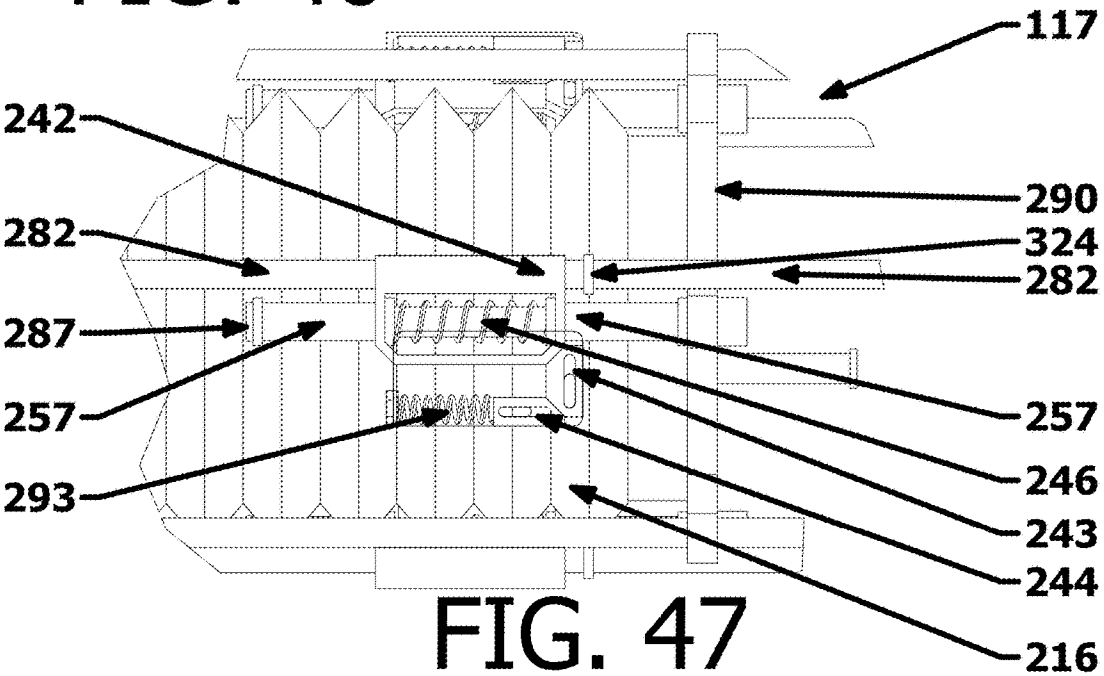
FIG. 47 is an enlarged view of the circle AR in FIG. 46.

FIGS. 42 and 43 show the bellows pipe 216 continuing to contract, building up stored energy in the springs 246. In FIGS. 44 and 45, the spring energy in spring 246 was released causing propeller blades 260 to change angles. In FIGS. 46 and 47, the changing angle of propeller blades 260, changes the rotational direction of shaft 310/253, which has caused impeller 247 to pump water out of submarine assembly 400. With a decrease in pressure from the evacuation of water, the bellows pipe 216 decompresses to a nearly fully expanded state. As bellows pipe 216 continues to expand it will begin to trigger a serious of events that causes propeller blades 260 to reverse angles again, which reverses the rotation of shaft 310/253.

Figure 48:
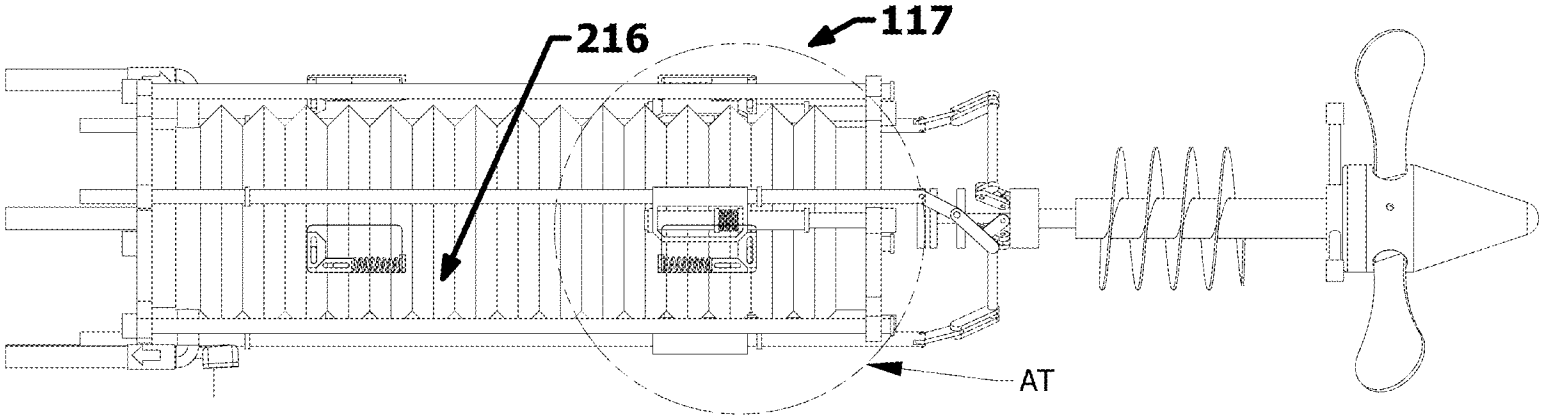
FIG. 48 shows the bellows system of FIG. 46 in a state of further expansion, building pressure in springs, according to an embodiment.
Figure 49:
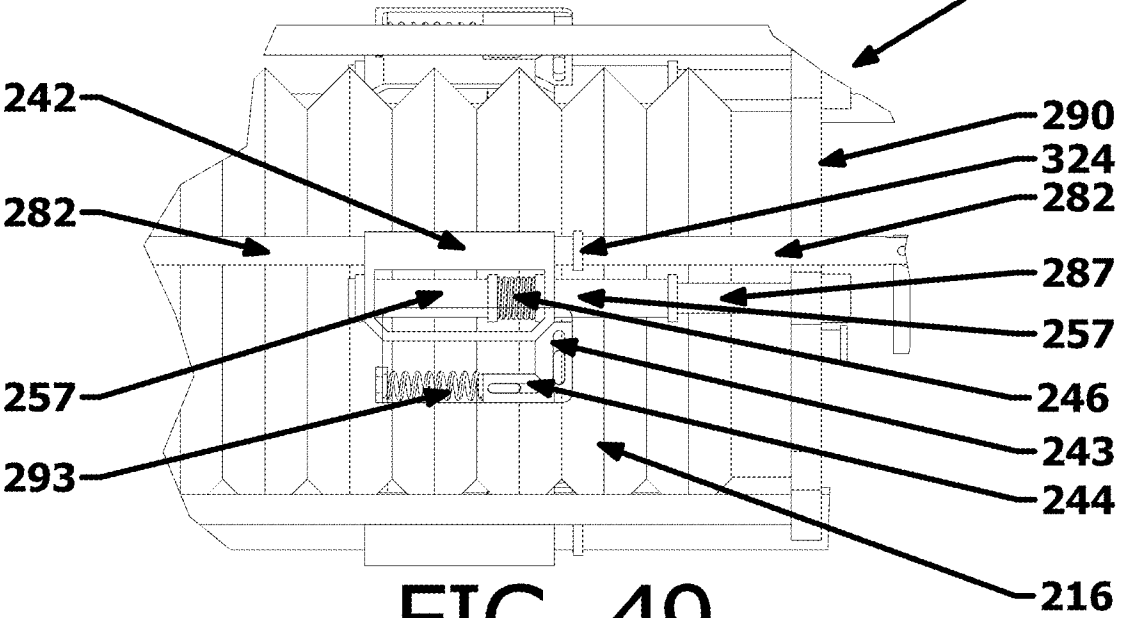
FIG. 49 is an enlarged view of the circle AT in FIG. 48.
Figure 50:
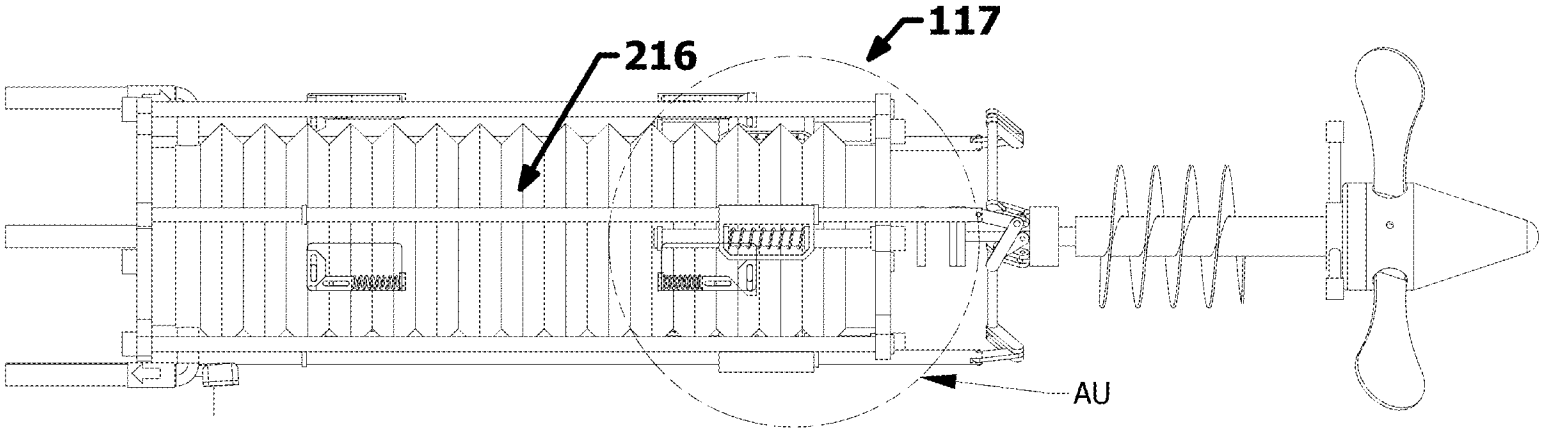
FIG. 50 shows the bellows system of FIG. 48, releasing the pressure in springs, according to an embodiment.
Figure 51:
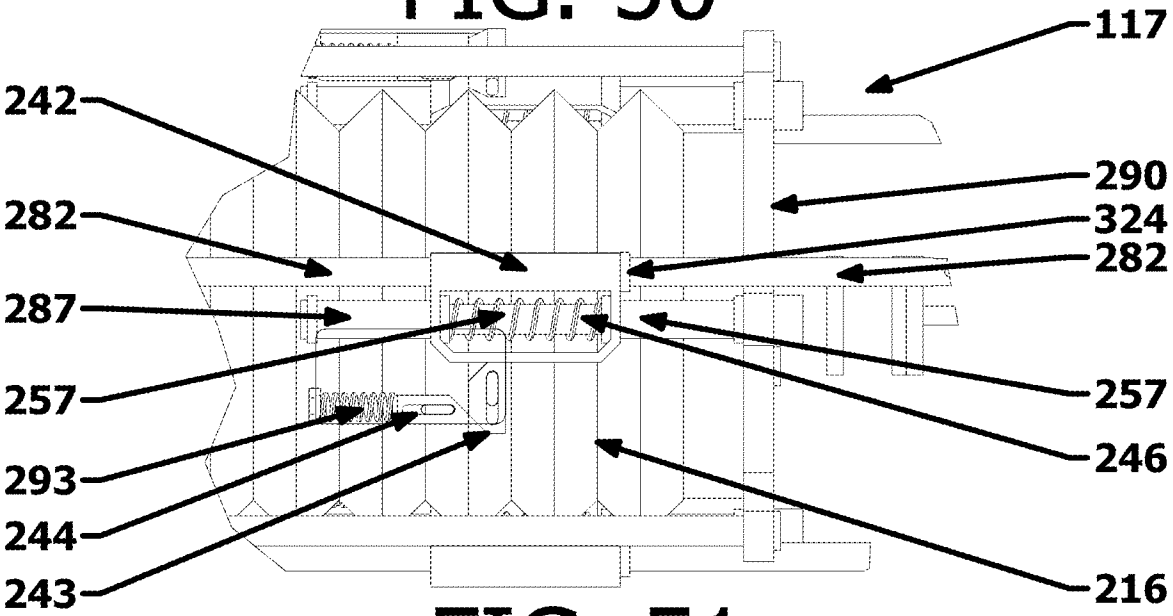
FIG. 51 is an enlarged view of the circle AU in FIG. 50.
Figure 52:
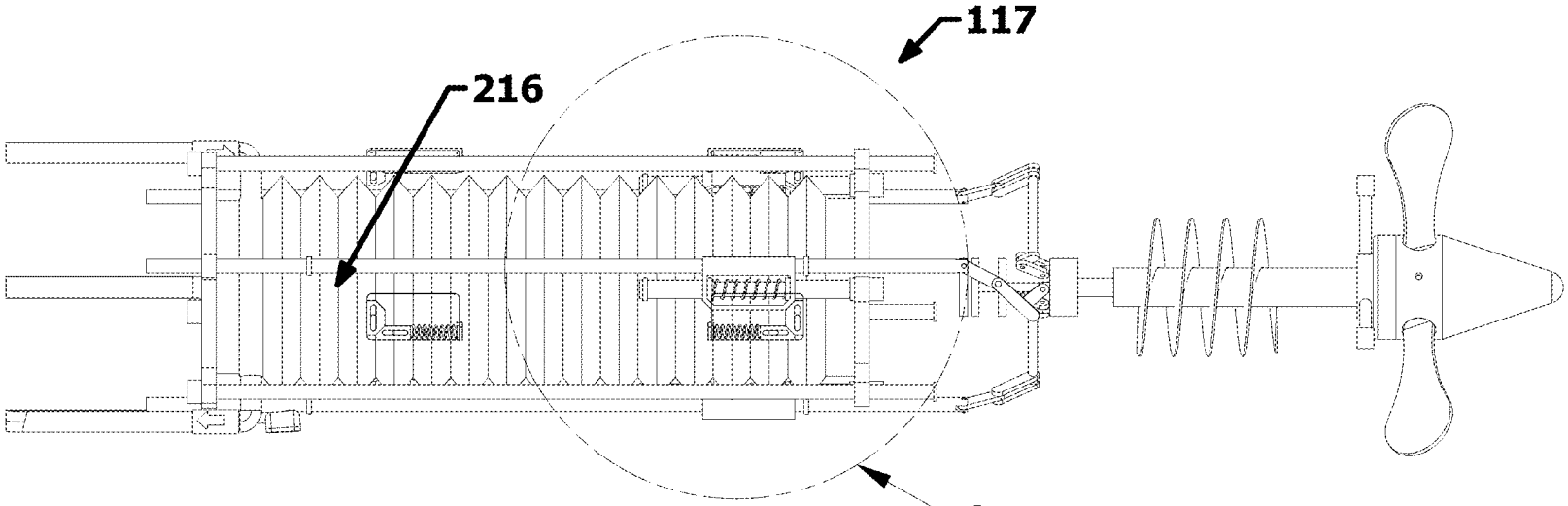
FIG. 52 shows the bellows system of FIG. 50, re-engaging a compression cycle, according to an embodiment.
Figure 53:
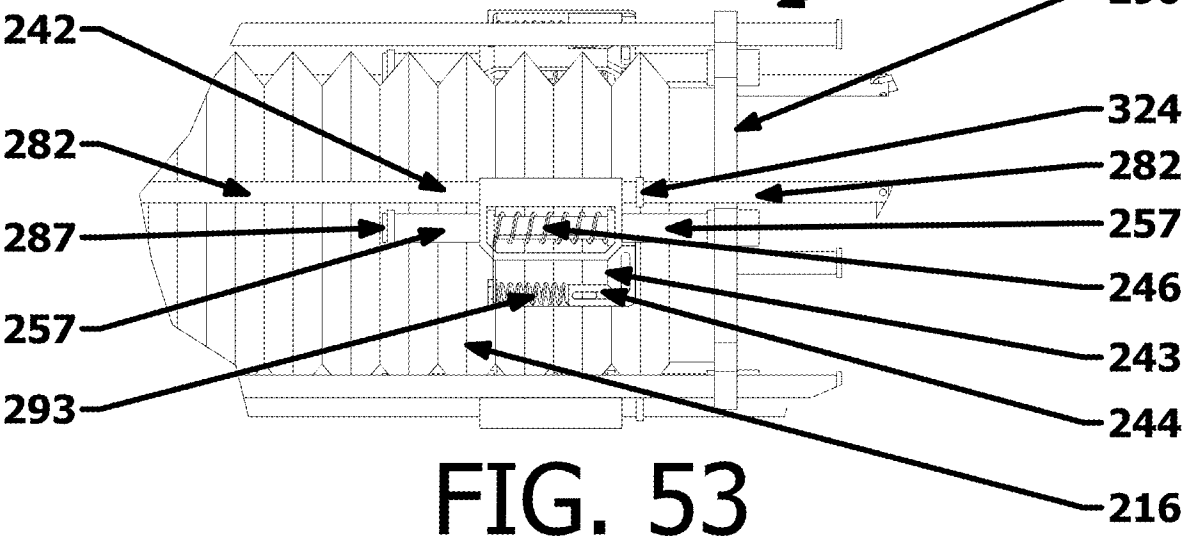
FIG. 53 is an enlarged view of the circle J in FIG. 52.

FIGS. 48 and 49 show the bellows pipe 216 in further expansion creating pressure to build up in the springs 293. FIGS. 50 and 51 show the spring energy was released causing propeller blades 260 to change angles. In FIGS. 52 and 53, now that propeller blades 260 has changed angles, bellows pipe 216 has begun the compression cycle.

Figure 57:
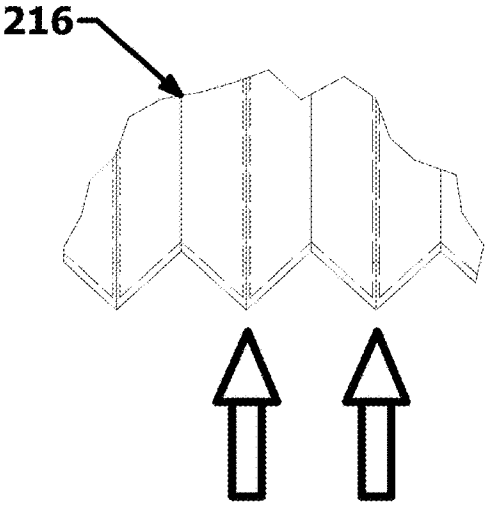
FIGS. 56 and 57 are enlarged partial views of the circle P of FIG. 59.
Figure 56:
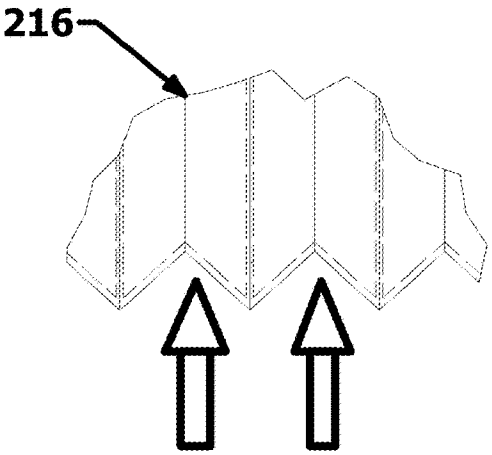
Figure 59:
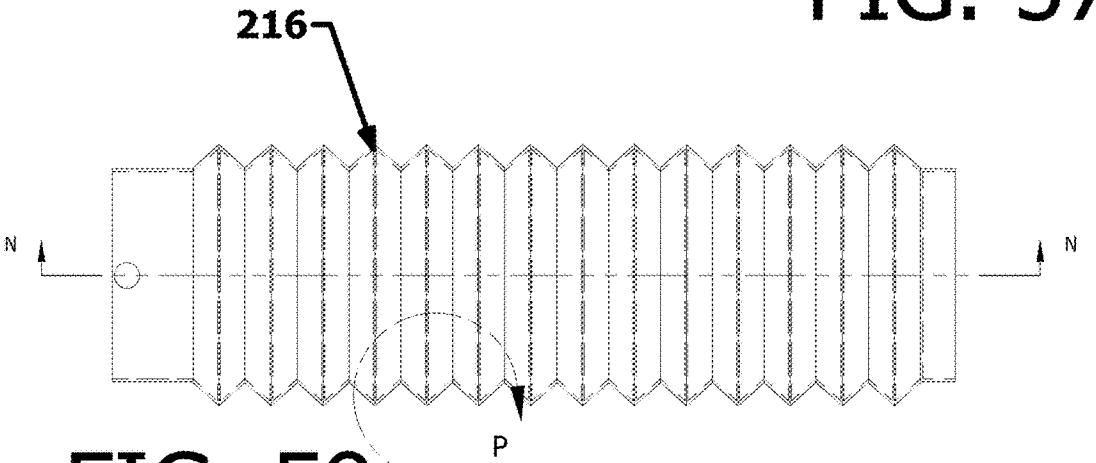
FIG. 59 is a side view of the bellows pipe of FIG. 58 in an extended state consistent with an embodiment.
Figure 58:
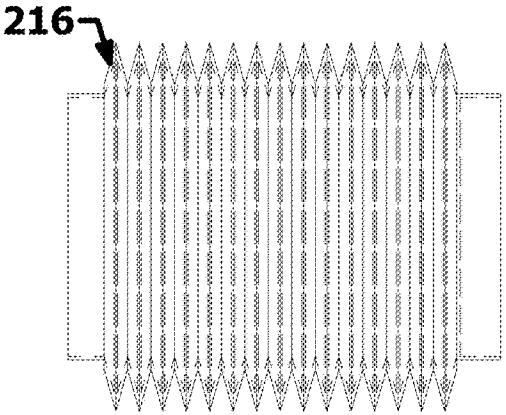
FIG. 58 is a side view of a bellows pipe in a compressed state consistent with an embodiment.
Figure 60:
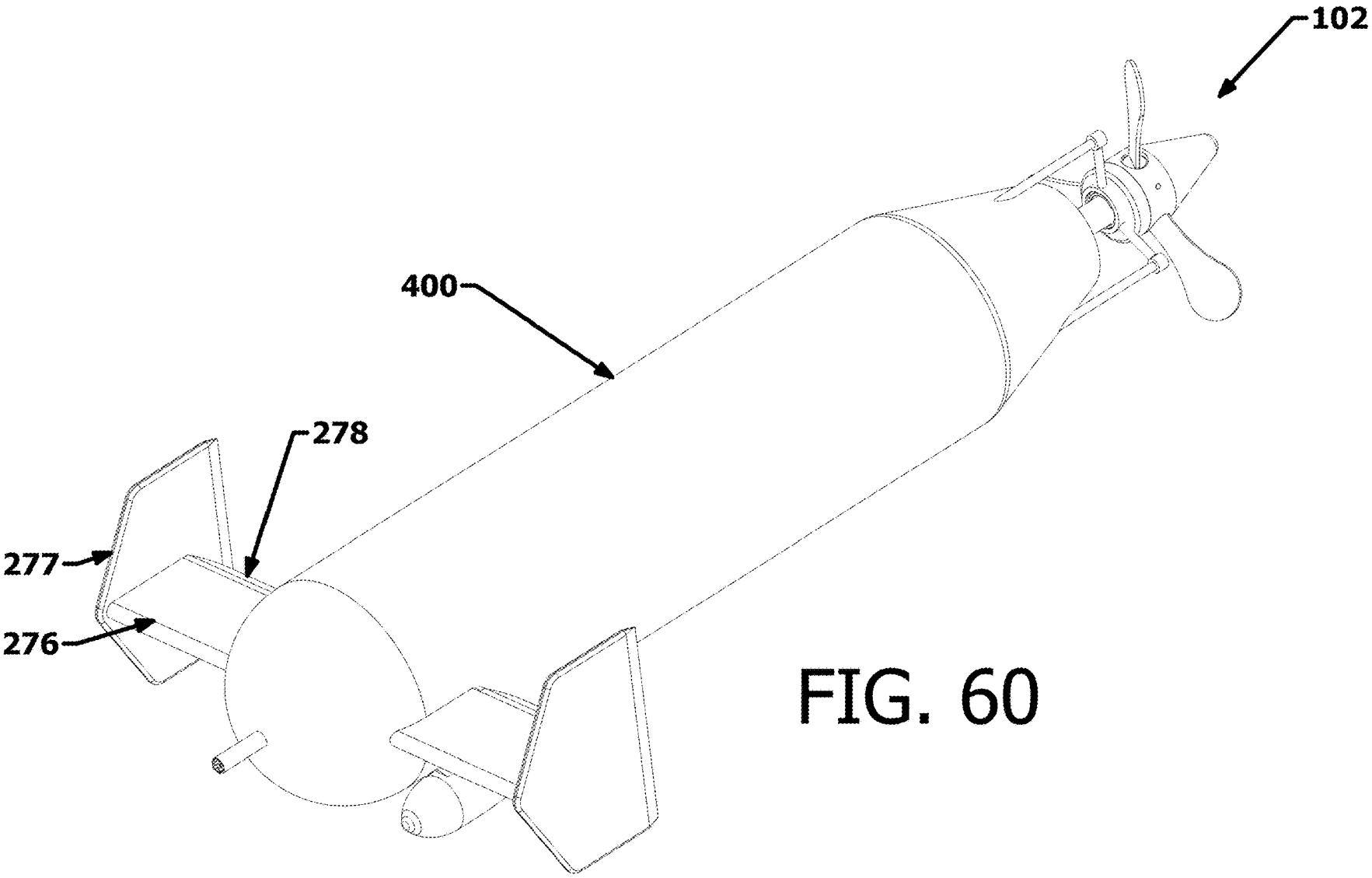
FIG. 60 is a top, front perspective view of an air water submarine in accordance with an embodiment.

FIGS. 55-59 show details of the bellows pipe 216 according to an embodiment. The bellows pipe 216 may be a longitudinal hollow body that includes pleats configured to compress and expand based on pressure exerted on the body. In FIGS. 56 and 57, arrows represent pressure applied to the pipe body. For example, when the water pressure surrounds bellows pipe 216, the rigid rings inside pipe 216 (where arrows are pointing to in FIG. 57) reinforce the body to help pipe 216 hold its shape. The pressure from the ocean is allowed to push bellows pipe 216 from the sides at the location(s) of the arrow in FIG. 56. The manner in which bellows pipe 216 contracts and expands may be controlled. A controlled contraction is depicted in FIG. 58. A controlled expansion is depicted in FIG. 59. FIG. 55 depicts the inner rings highlighted from the exterior of bellows pipe 216 by the arrows in FIG. 57.

Forces Effecting Dive Depth

Prior to the first dive of the AWS 100 the pressure tank 223 should have about the same pressure as the ambient air outside of base station 114. For this reason, the bellows pipe 216 will have the least amount of resistance in the contraction phase during the first dive. Given little resistance during the first dive the AWS 100 will dive to a least amount of depth compared to subsequent depths needed to change the state of elevator 278 and blades 260 into an ascension state. With each dive the pressure in tank 223 will increase. The increase in back pressure from 223 will cause bellows 216 to resist contraction. AWS 100 will need to dive deeper with every subsequent dive where the water pressure at depth will overcome this resistance. At some point AWS 100 will reach its maximum depth and will no longer ascend. The ascension and dive phases can continue if snorkel tube 268 is extended or if pressure is released from pressure tank 223.

Latch Mechanism

Figure 36:
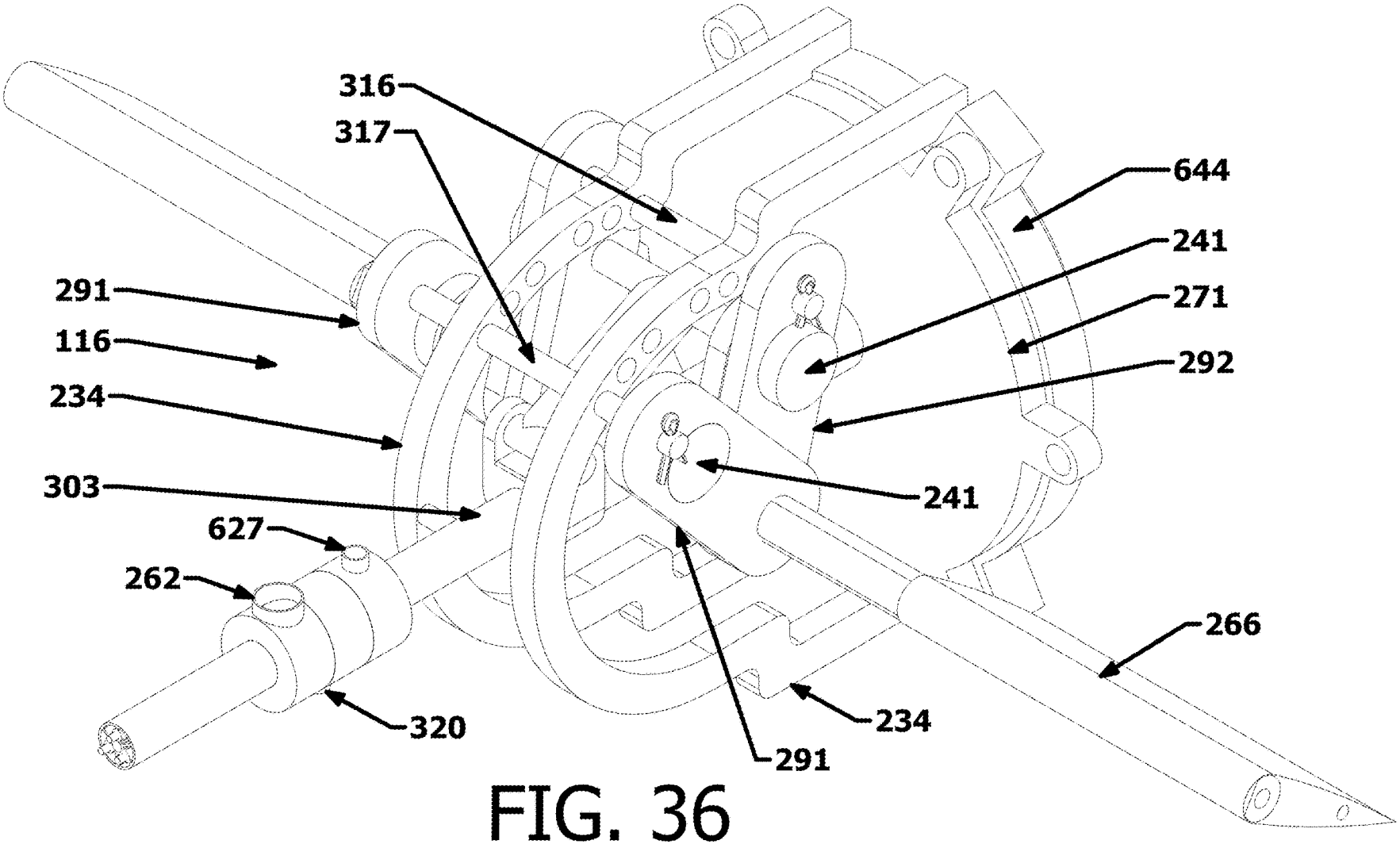
FIG. 36 is a perspective view of an actuation assembly in accordance with an embodiment.
Figure 37:
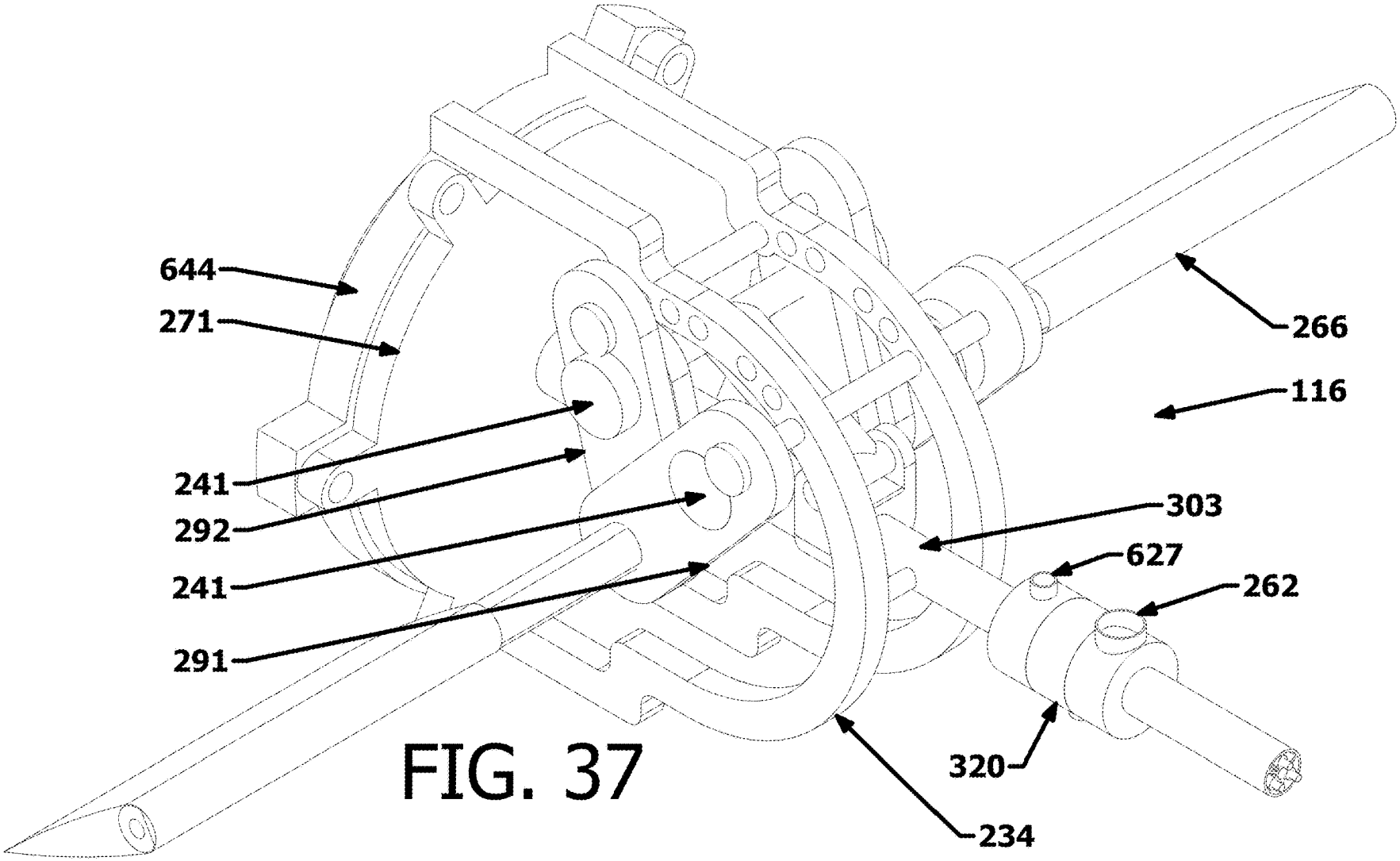
FIG. 37 is a perspective view of the actuation assembly of FIG. 36.
Figure 38:
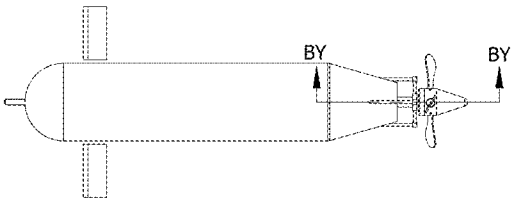
FIG. 38 is a side view of a submarine consistent with embodiments.
Figure 39:
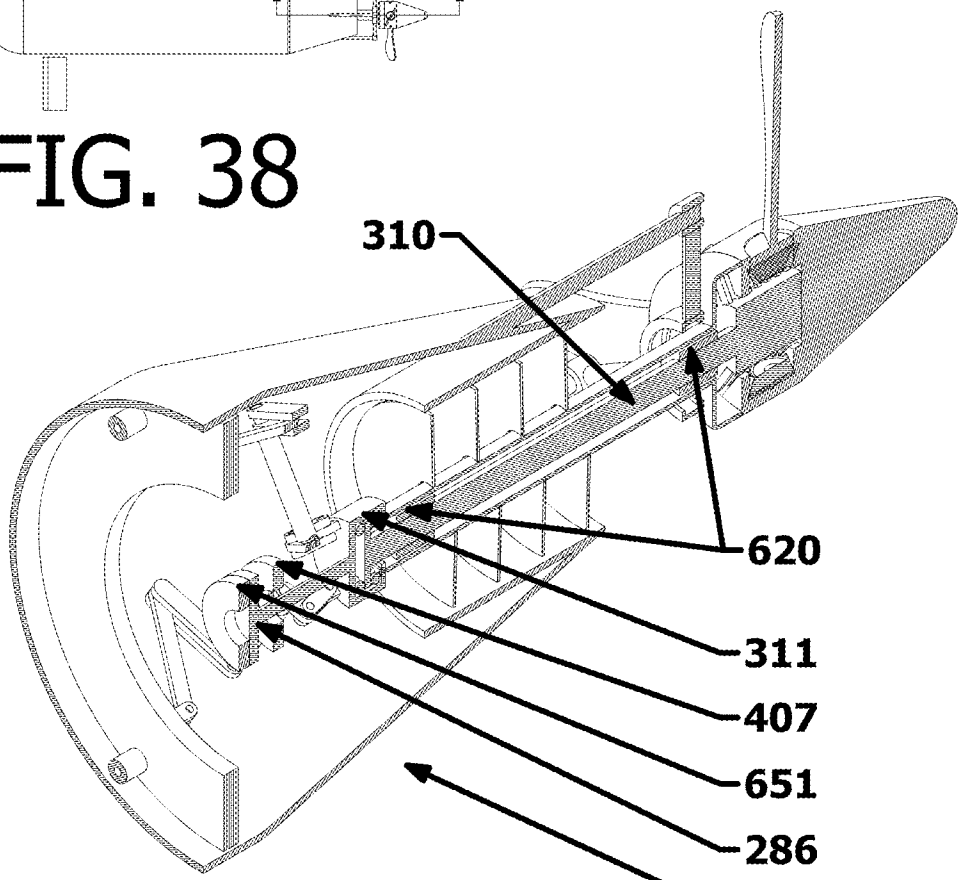
FIG. 39 is a cross-sectional view taken along line BE-BE of FIG. 38.
Figure 40:
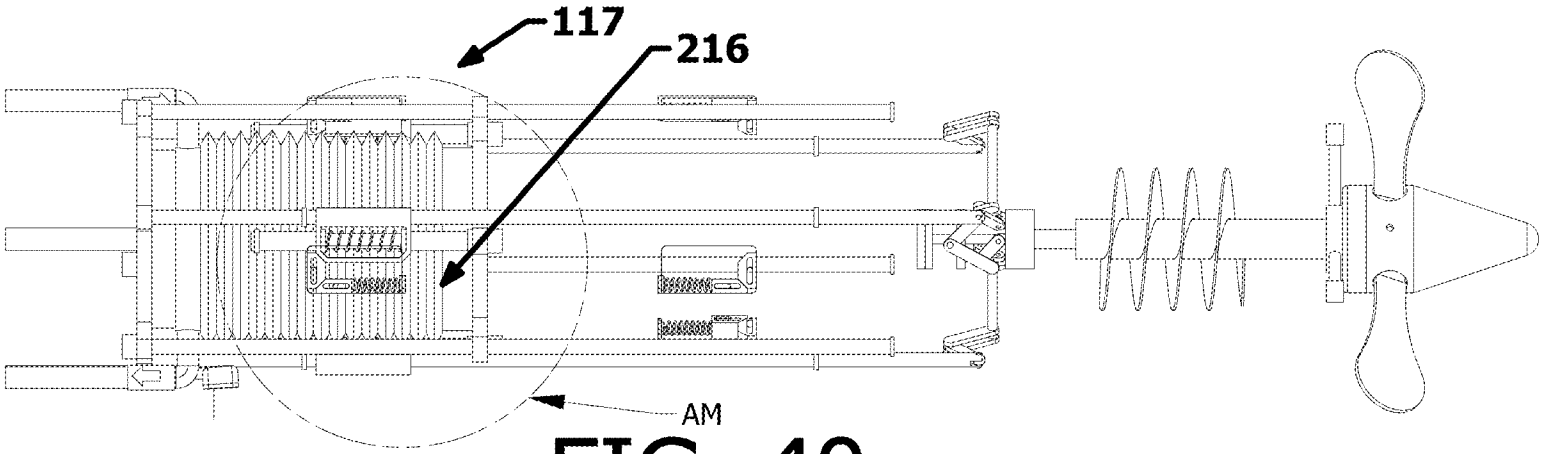
FIG. 40 shows an internal side view of a bellows system in a compressed state in a sequence that changes an angle of a blade system according to an embodiment.
Figure 41:
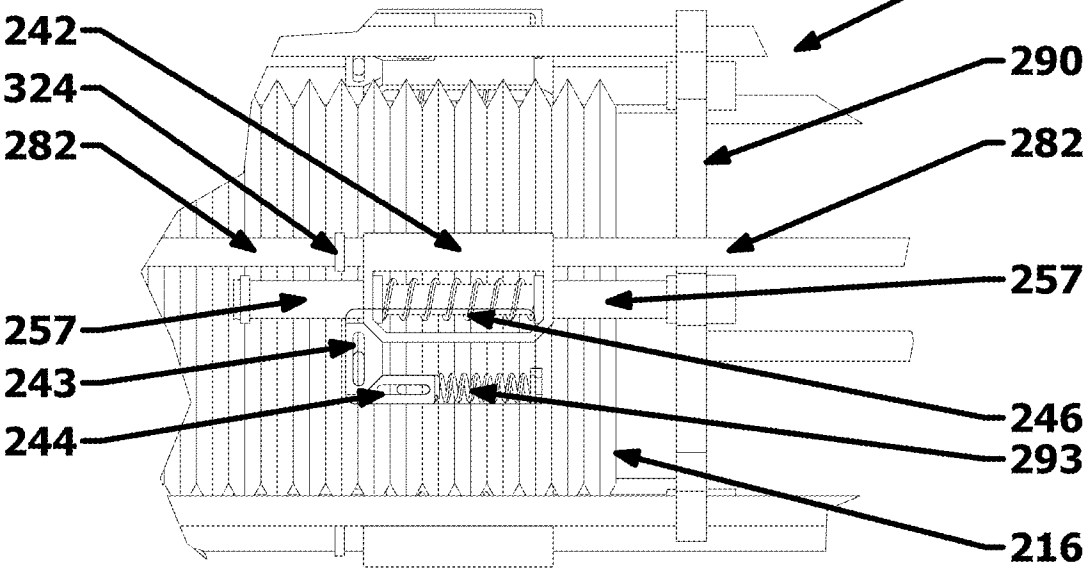
FIG. 41 is an enlarged view of the circle AM in FIG. 40.

Referring to FIGS. 36 and 37 unless otherwise stated, the AWS control surfaces may be held in a diving or ascending state by the use of one or more magnetic latches as depicted in forward latch assembly 116 and rear latch assembly 118 (shown in FIG. 39). The forward latch assembly 116 may align magnets with forward levers 273 (seen in FIGS. 10, 12, 13, and 15). Forward latch magnets 241 may be embedded in latch arms 291 and 292. Latch arms 291 and 292 may be made from ferromagnetic metal so they will stay aligned with latch magnets 241. The position of latch arms 291 and 292 will control the pitch angle of elevator 235 and 278. The position of forward latch magnets 241 can be altered by adjusting pin 317 that holds latch arms 291 and 292 in place relative to U-bracket 234.

Referring now to FIG. 39, the rear latch assembly 118 may include rear latch magnets 651 and 407. Latch arm 286 may be connected to bearing housing 311. The bearing housing 311 may be connected to prop actuator shaft 310. As prop actuator shaft 310 moves forward and aft, it can be held in place by the attractive force of latch magnets 651 and 407 to latch arm 286. The latch arm 286 may be made from ferromagnetic metal to attract to the latch magnets 651 and 407.

The Ocean Environment

Figure 73:
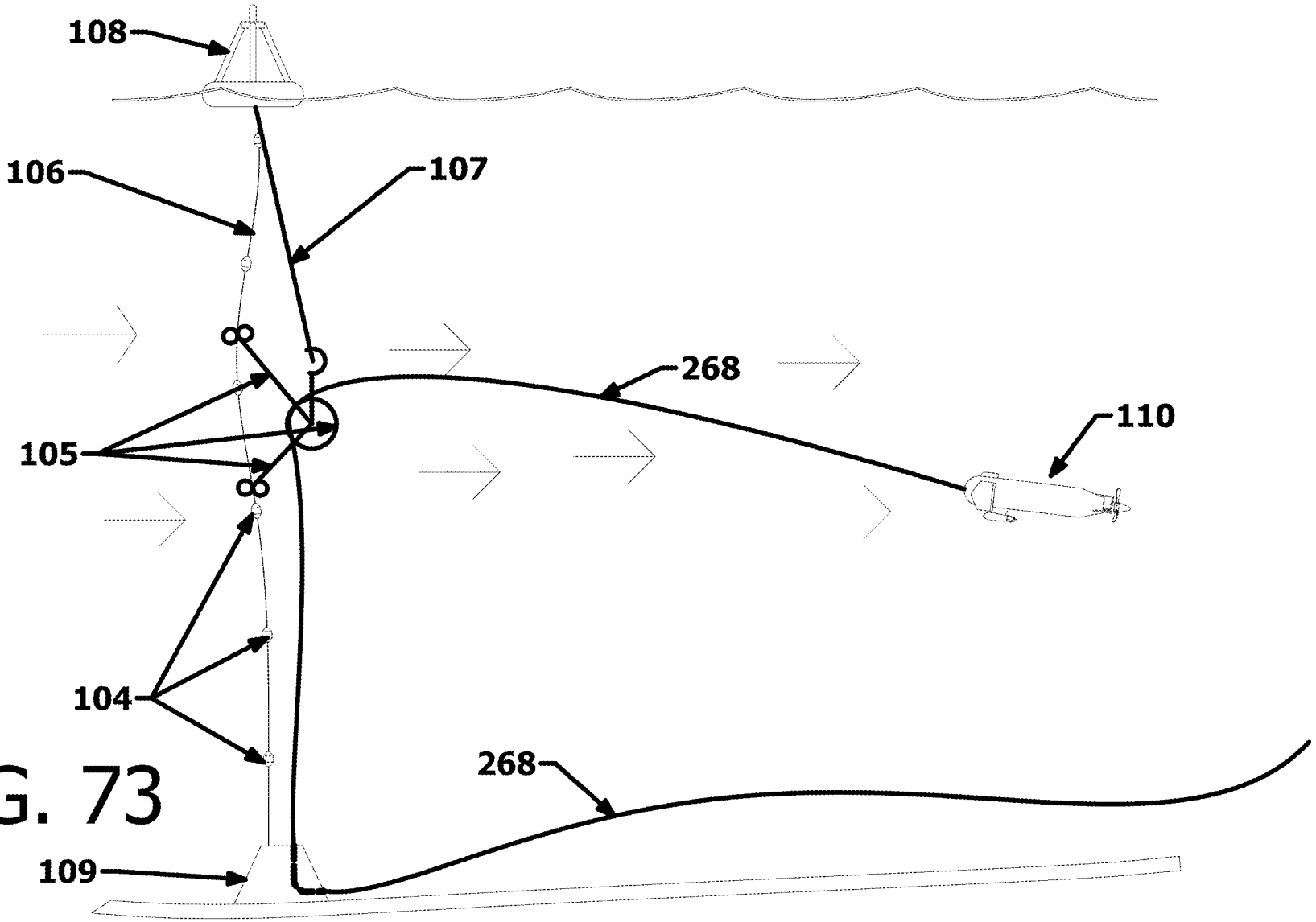
FIG. 73 is a diagrammatic view of an air water submarine in operation consistent with embodiments of the disclosure.

Referring to FIG. 73, in one application, the AWS 100 can be attached to a buoy line 106. The buoy line 106 may have an array of sensors 104 to measure depth, temperature and current. A processor (not shown) on buoy 108 may determine the ideal depth of the AWS 100 where currents and/or temperatures are ideal. Buoy 108 may raise or lower a carriage 105 connected to a line 107 via a winch (not depicted) so that the AWS 100 is at an ideal dept. The buoy 108 may be attached to an anchor 109 that is stationary on the ocean floor. The snorkel tube 268 may be connected to multiple systems on different buoys (not depicted) and routed via a common snorkel tube 268 to a shore-based location (not depicted) to base station 114, FIG. 54.

Multiple Systems

Figures 77, 78:
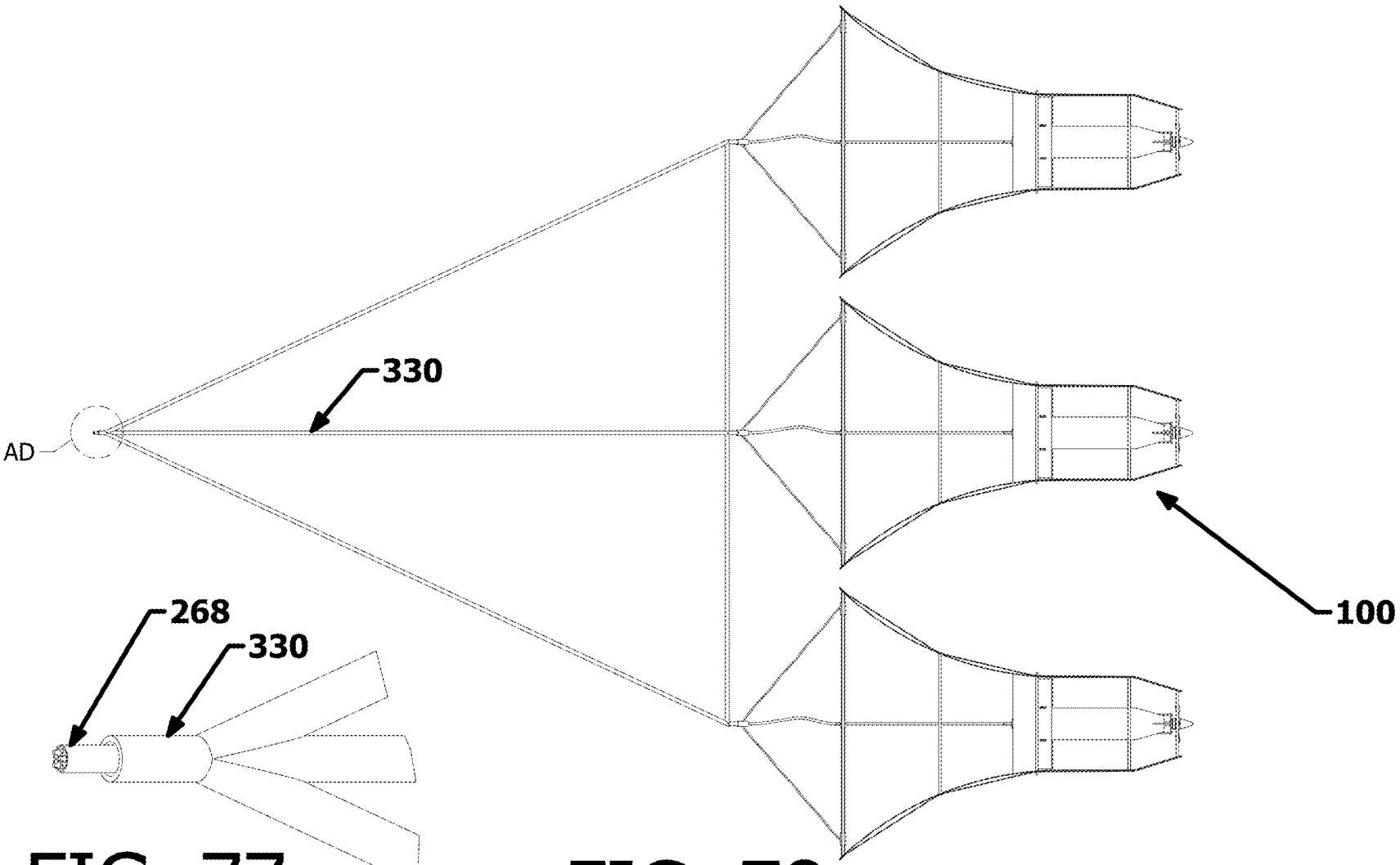
FIG. 77 is a perspective, partial view of a frame section for use in an embodiment.
FIG. 78 is a top view of a system of connected air water submarines in accordance with an embodiment.
Figure 79:
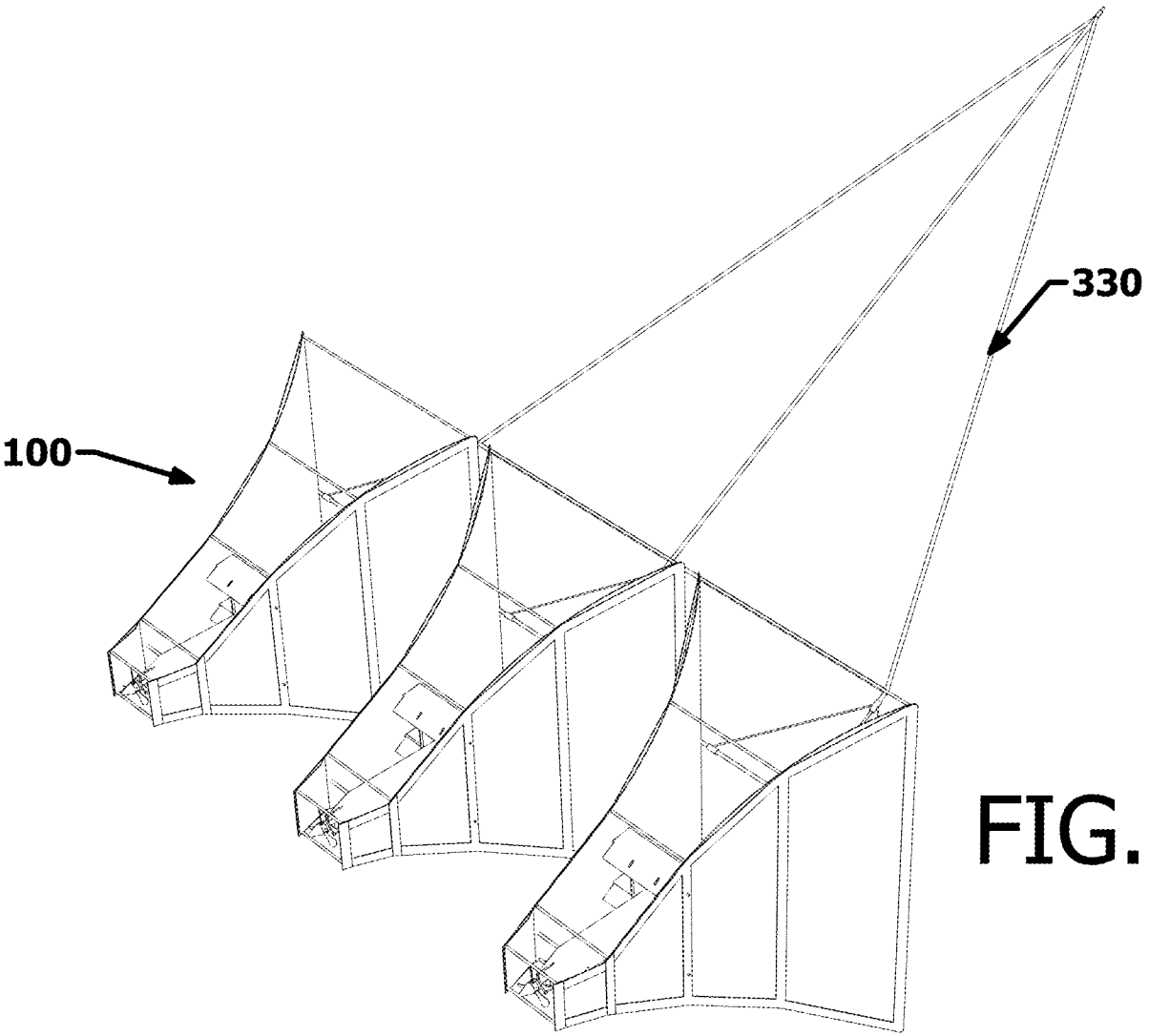
FIG. 79 is a perspective view of the system of FIG. 78.
Figure 80:
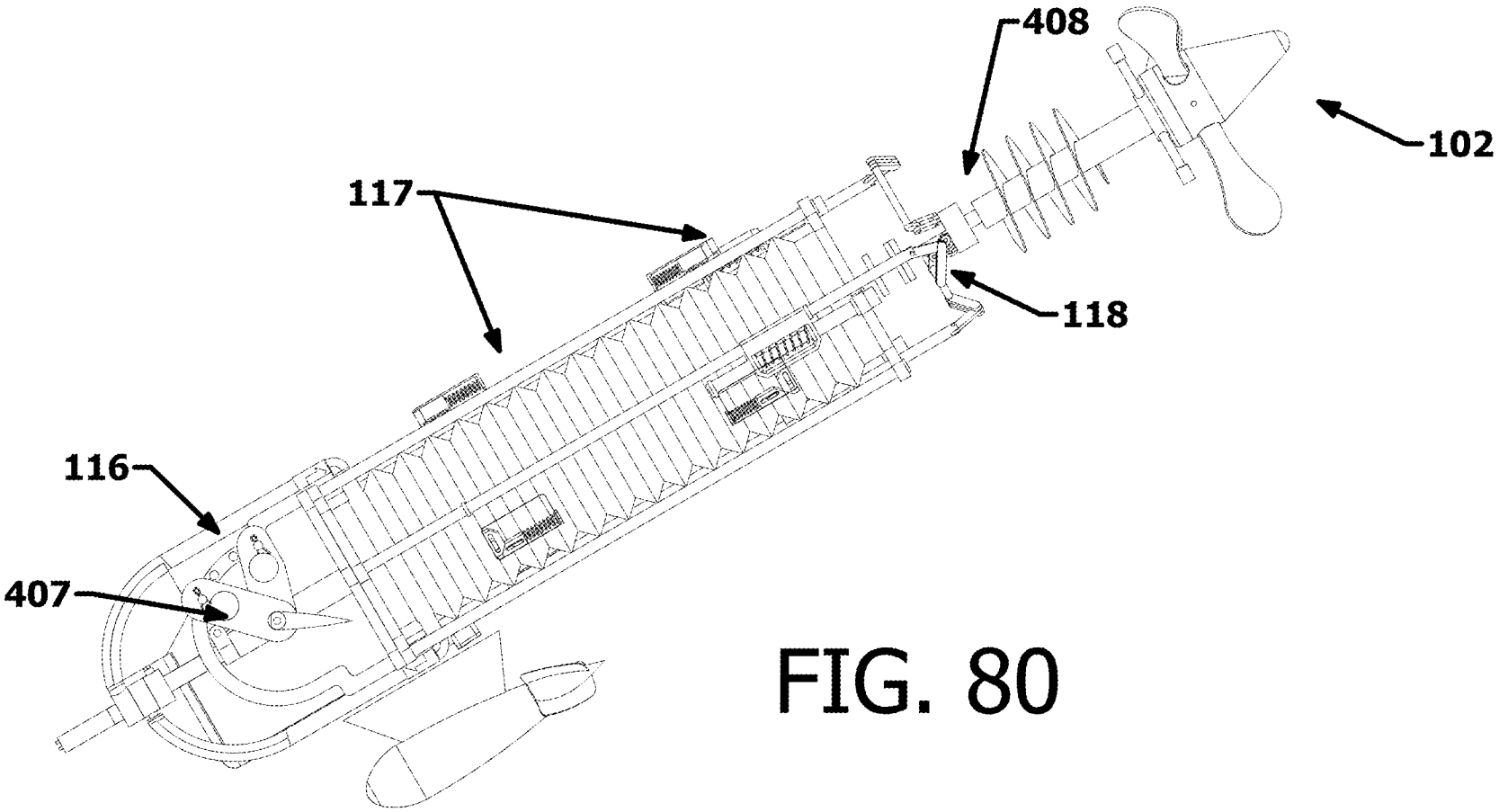
FIG. 80 is a side internal view of a compression system in a decompressed state, according to an embodiment.
Figure 81:
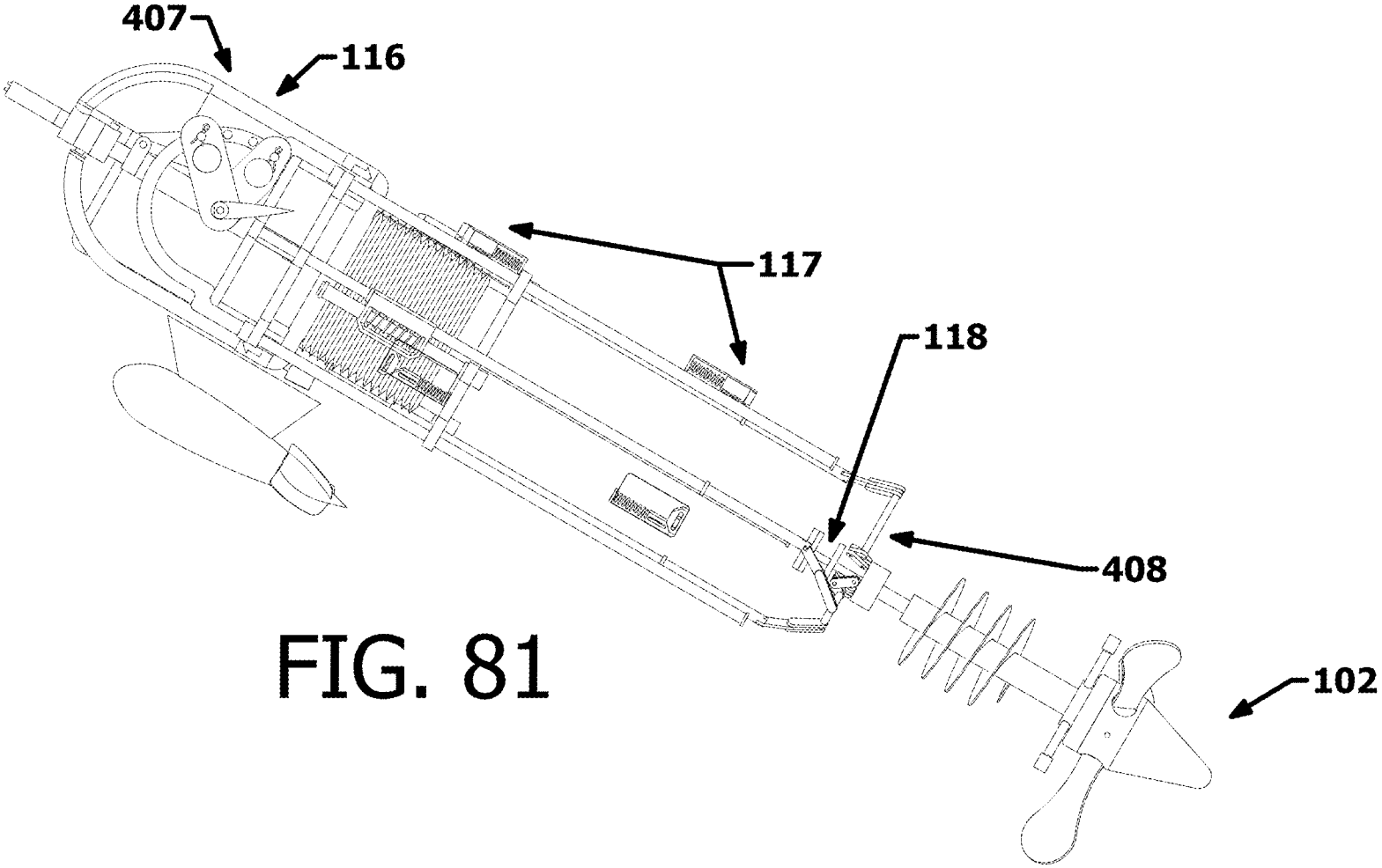
FIG. 81 is a side internal view of the compression system of FIG. 80 in a compressed state, according to an embodiment.

Referring now to FIGS. 77, 78, and 79, an embodiment that includes multiple AWS 100 assemblies to a shared snorkel tube 268 is shown. Multiple AWS 100 systems may be connected together by a common frame assembly 330.

When the AWS 100 is in dive mode, gravity will cause water in bellows pipe 216 to move forward where it can drain into conduit 252 (see for example, FIGS. 3, 4, 30, 32, 34). Conduit 252 may have a check valve 245. The check valve 245 can stop water from flowing back into bellows 216 upon ascending.

River or Irrigation Canals

Figure 75:
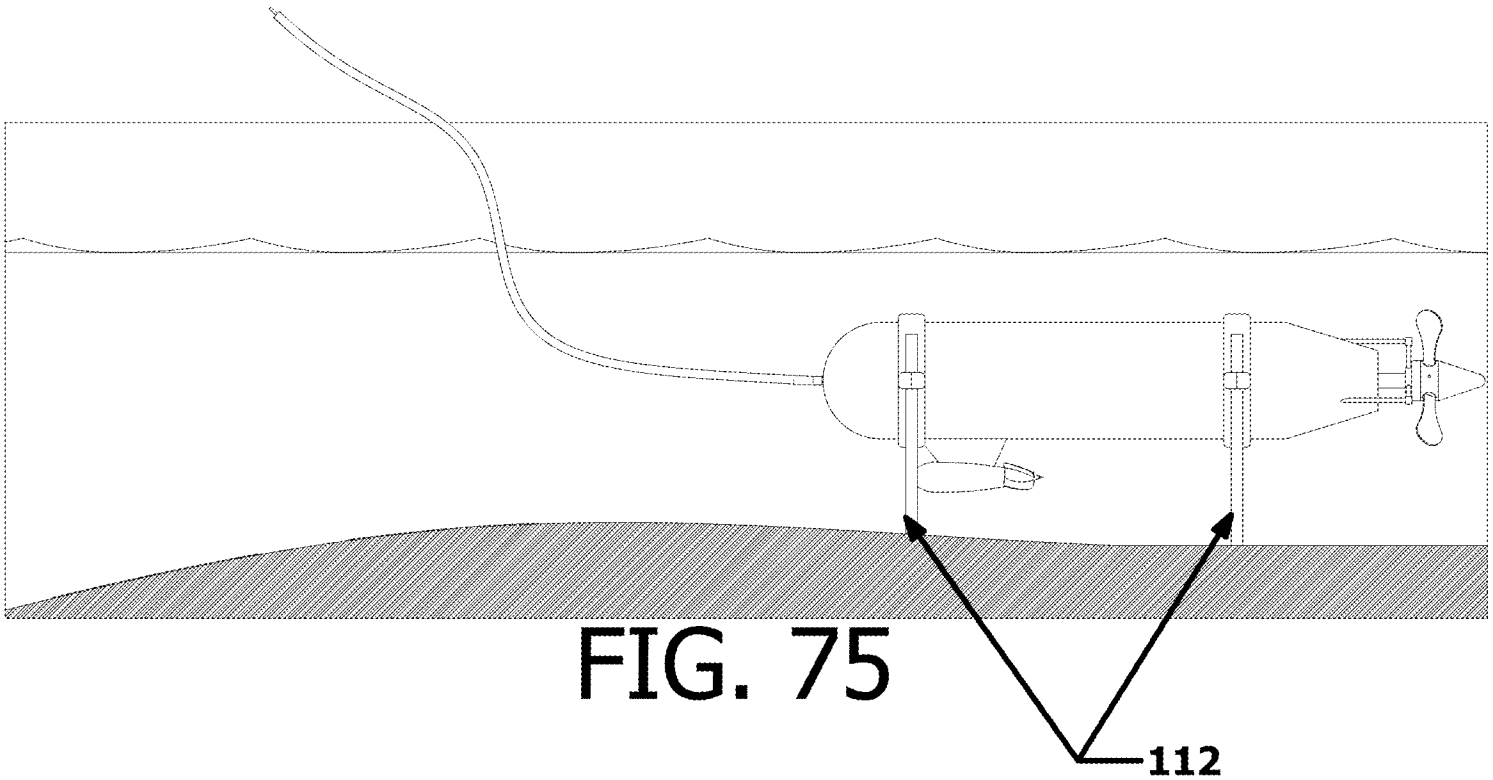
FIG. 75 is a diagrammatic view of an air water submarine in an affixed use consistent with embodiments of the disclosure.
Figure 76:
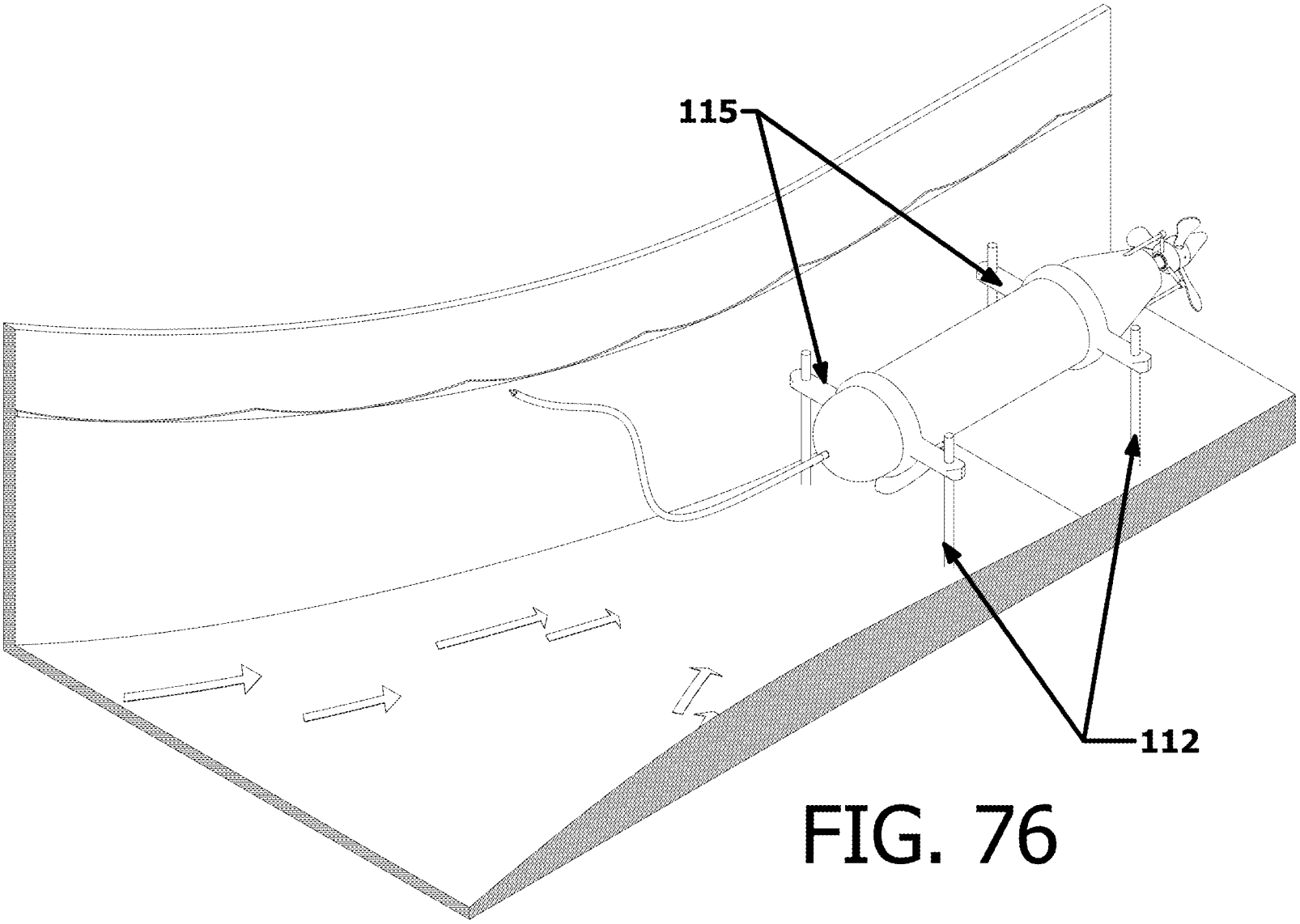
FIG. 76 is a perspective view of the submarine of FIG. 75, illustrating water flow.

In some applications, the AWS 100 may operate without diving or ascending. The AWS 100 may operate when permanently affixed to a natural or manmade environment as depicted in FIGS. 74, 75, and 76. In this scenario the AWS 100 may function within the relative movement of water passing over the features of the submarine assembly 400. The AWS 100 may be attached to a fixed point with brackets 115 and spikes 112. The speed of the water around the AWS 100 can be increased by a natural or manmade structure 111 that funnels water towards the AWS 100 as depicted in FIG. 74.

The AWS 100 may function while rigidly affixed outside of a moving boat, without diving or ascending, operating by relative movement of the water alone.

Independent Actuation

Figure 67:
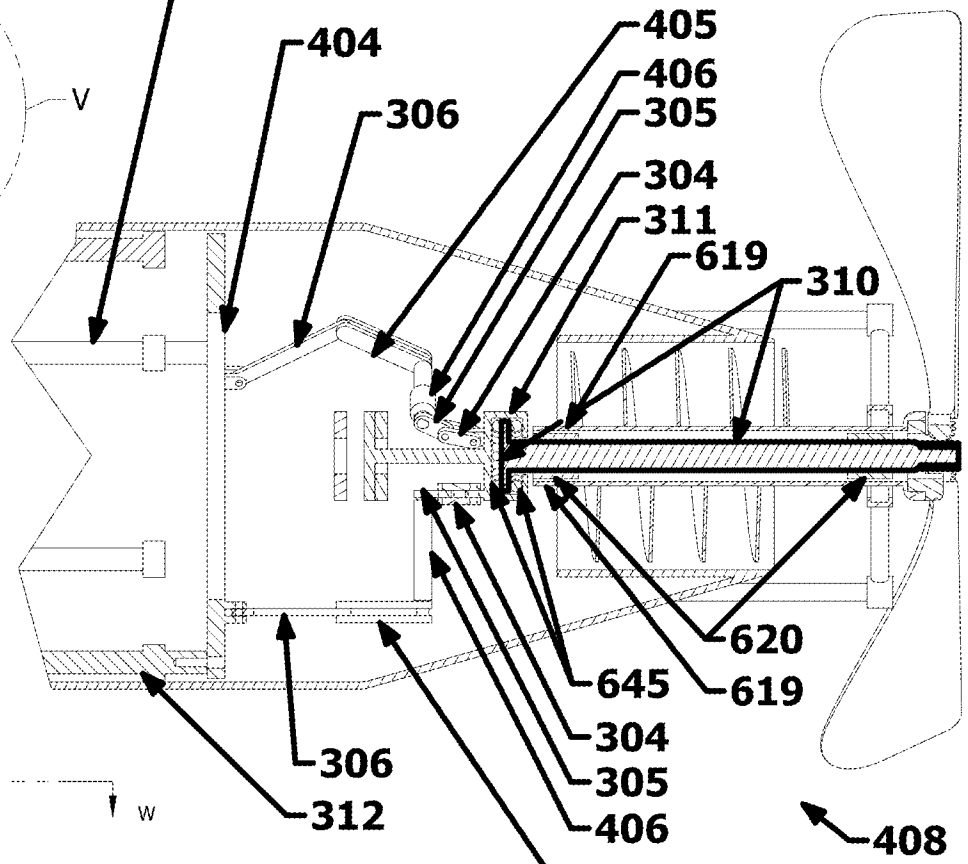
FIG. 67 is an enlarged view of the circle V of FIG. 66.
Figure 66:
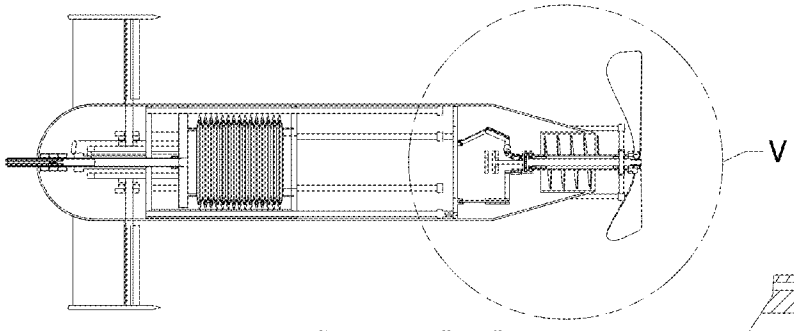
FIG. 66 is a cross-sectional top view taken along the line W-W, showing a compressible pipe in an extended state.
Figure 68:
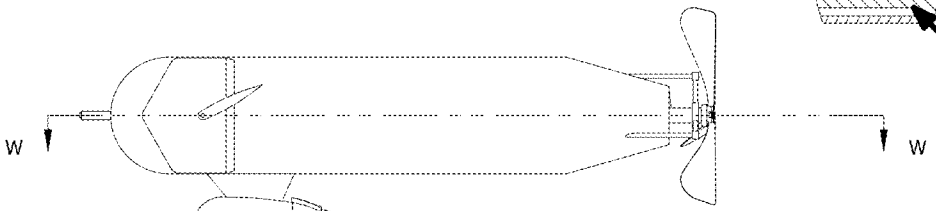
FIG. 68 is a side view of the submarine of FIG. 60.
Figure 70:
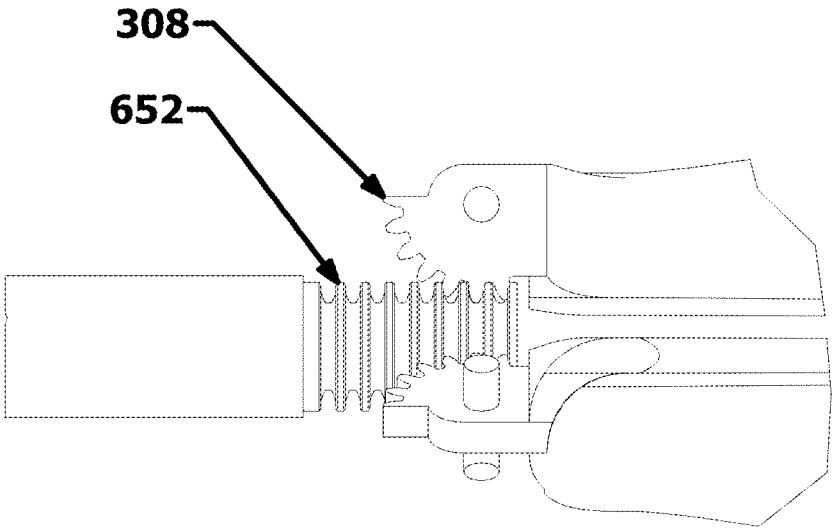
FIG. 70 is an enlarged view of the circle AA of FIG. 69.
Figure 69:
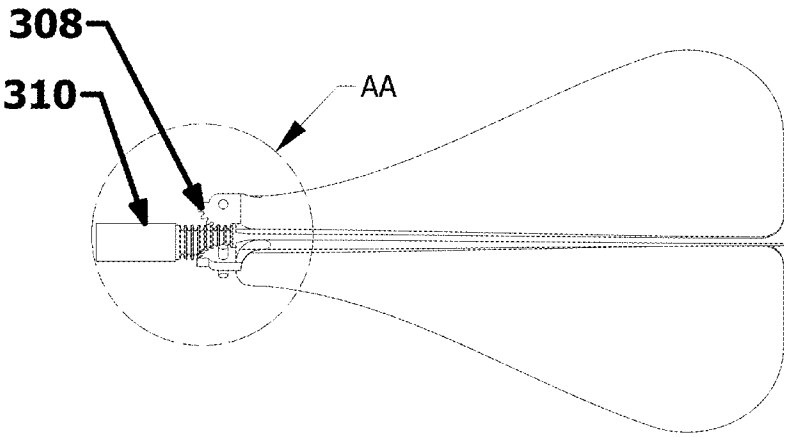
FIG. 69 is an enlarged view of a propeller according to another embodiment.
Figure 72:
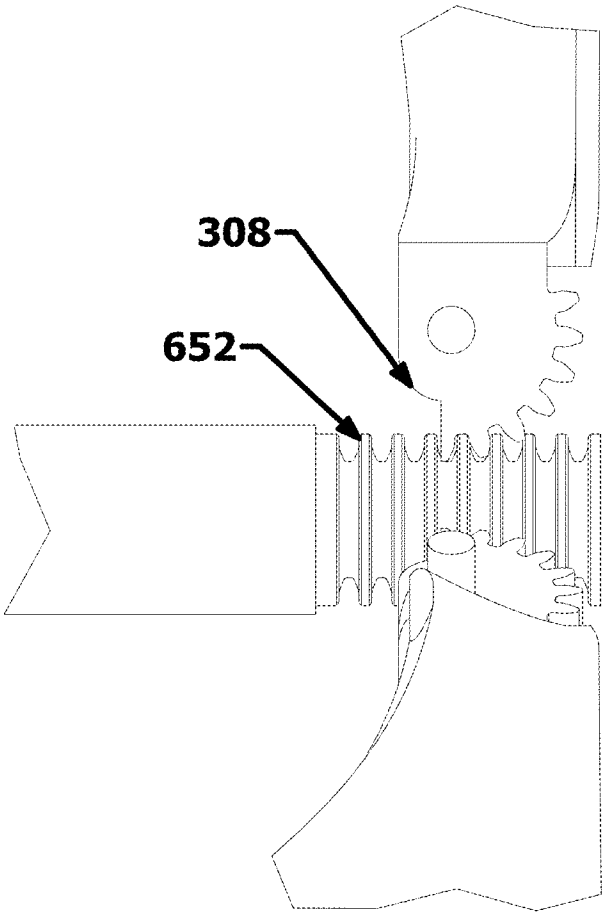
FIG. 72 is an enlarged view of the circle BF of FIG. 71.
Figure 71:
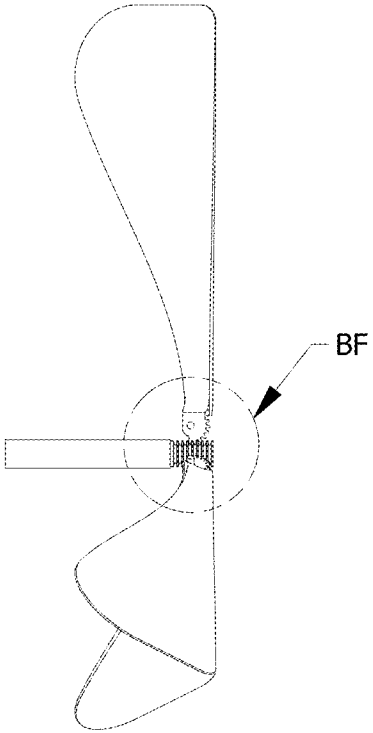
FIG. 71 is a side view of the propellor of FIG. 69, in an unfurled state, according to an embodiment.

Referring now to FIGS. 40-53, detail of the operation of an actuator system that can operate with or without dive planes is shown according to an illustrative embodiment. Spring shuttle 242 travels along actuator shaft 282 and secondary rod 287. As bellows 216 compresses or decompresses, it will push or pull sliding tube 257 which slides on secondary rod 287, which pushes on actuator spring 246, which in turn pushes on spring shuttle 242. Secondary rod 287 is attached to plate 290 and moves forward or aft with the motion of the bellows 216. The spring shuttle 242 will eventually come into contact with motion transfer fitting one 243. Motion transfer fitting one will move perpendicular to spring shuttle 242 and immediately transfer motion to motion transfer fitting two 244. The movement of motion transfer fitting two 244 will be resisted by spring 293. Spring 293 resists the motion of spring shuttle 242. This resistance will cause spring 246 to begin compression. As the bellows pipe 216 continues to compress or decompress, spring shuttle 242 will eventually overcome motion transfer fitting one by pushing it away from the angled part of motion transfer fitting one 243. Once the motion of spring shuttle 242 is no longer facing resistance from motion transfer fitting one 243, the pressure from spring 246 can rapidly release energy. This rapidly releasing energy will cause spring shuttle 242 to impact the ring 324 located on actuator rod 282. Referring to FIG. 67, actuator rod 282 can connect to transfer plate 404 in the same way actuator rod 312 is connected. Transfer plate 404 may transfer motion to first lever 306. First lever 306 may connect to double levers 405. Double levers may rotate actuator shaft 406. Actuator shaft may rotate to turn secondary lever 305. Secondary lever 305 may turn contact lever 304. Contact lever may connect to bearing housing 311. Bearing housing 311 contains a rotating flange that is part of shaft 310 which is inside bearing 311. When contact lever pushes or pulls on bearing house 311 it will engage the gears that change the state of the blade. The blade configuration may configured be as depicted in 102 FIG. 24, 26, 27, 29, 60, 80, 81, or 103 FIG. 61, 62. Changing the blade 260 angle will change the direction of rotation of shaft 253, which causes impeller 247 to change direction. This reversal will cause water to be pumped out of submarine assembly 400, expanding bellows 216. As the bellows 216 expands, spring shuttle 242 will travel the other direction as depicted in FIGS. 56-63. The blades 260 will change direction by the pushing of actuator rod 282 in the same manner as described above.

Alternate Dive Plane

Figure 82:
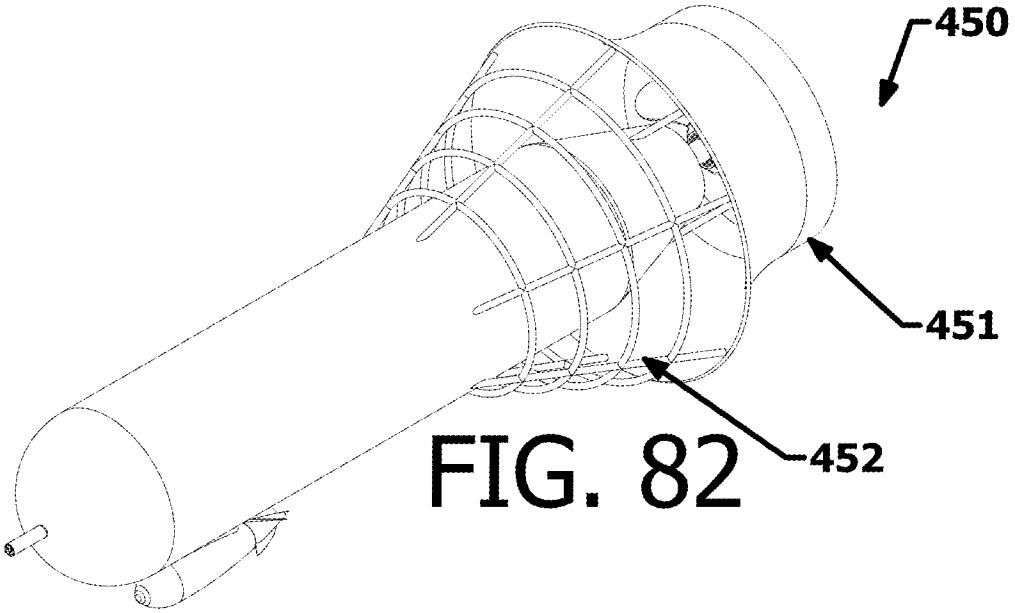
FIG. 82 is a perspective view of an air-water submarine system according to another embodiment.
Figure 83:
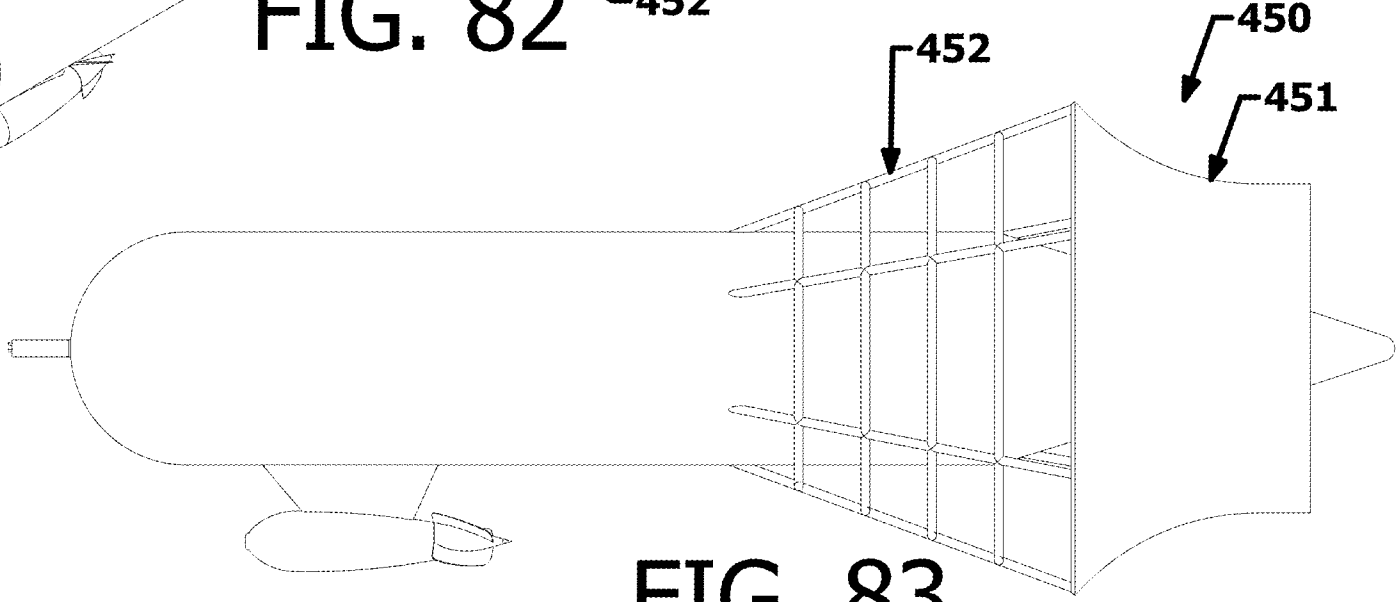
FIG. 83 is a side view of the air-water submarine system of FIG. 82.

FIGS. 82 and 83 show an AWS 100 incorporating a blade funnel assembly 450 that surrounds the aft section and propellor blades 260. The assembly 450 may include a pipe section 451 and a blade screen 452. The propellor blades 260 may include a cover that funnels water towards blade. Pipe section 451 can be wider in the forward section and narrow aft. This configuration can increase the speed of water over blades 260 which in turn increases performance. The blade funnel assembly 450 can have a blade screen 452 to protect marine life from blades 260.

Fluid Circulation Systems

FIG. 84 depicts the route ambient enter enters to fill bellows pipe 216. Under this configuration, shut off valves 517, 512, 515 are closed. Shut off valve 514 is open. These valves can be manually operated from the base station 114. As bellows pipe 216 is in the expansion phase it will pull ambient air from the base station 114 via air filter inlet 523, then air filter 524, check valve 525, snorkel tube 268 into bellows pipe 216.

Figure 85:
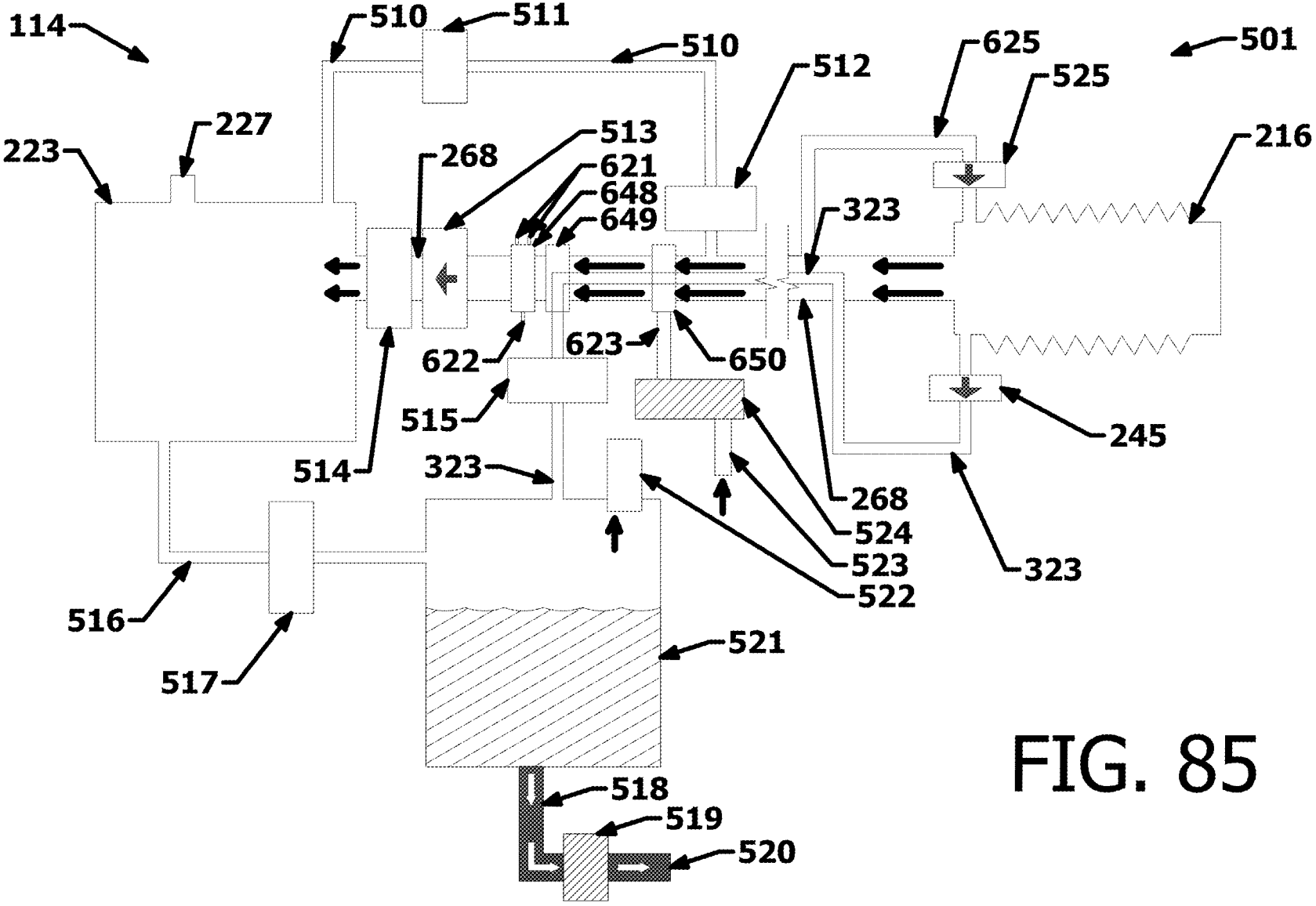
FIG. 85 is a schematic view of a gas circulation path to fill a gas tank with compressed air from the bellows pipe consistent with embodiments.

FIG. 85 depicts the route compressed air travels from bellows pipe 216 into pressure tank 223. Under this configuration, shut off valves 517, 512, 515 are closed. Shut off valve 514 is open. These valves can be manually operated from the base station. As bellows pipe 216 is in the contraction phase it will push air out from 216 into snorkel tube 268, will pass through check valve 513, through shut off valve 514 (currently open). Into pressure tank 223.

Figure 86:
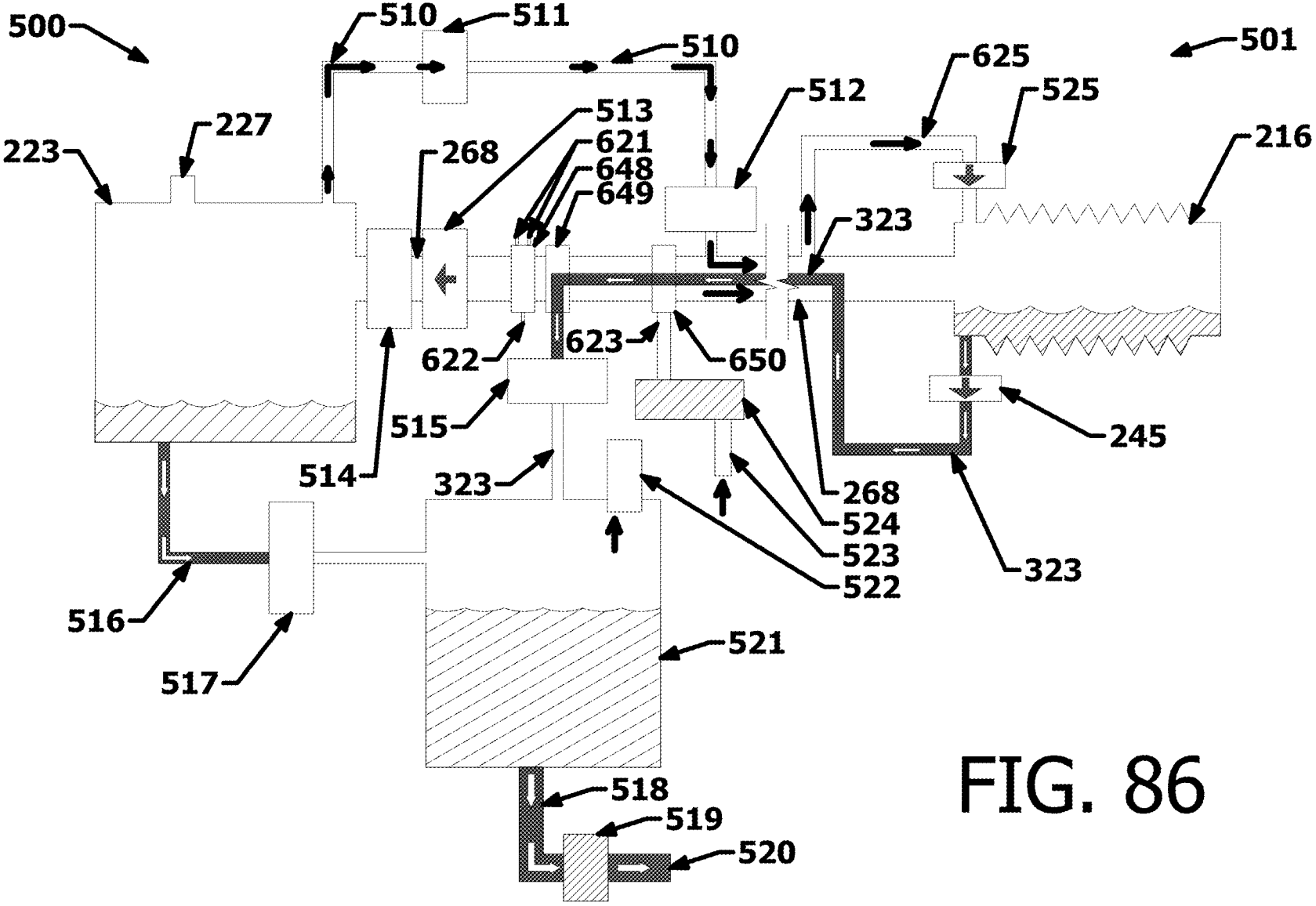
FIG. 86 is a schematic view of the gas circulation path of FIG. 85 in a state of water accumulation and a flow path for transferring water to a water tank consistent with embodiments.

FIG. 86 depicts how water will eventually accumulate in both pressure tank 223 and bellows pipe 216. This figure also depicts the route water can be transferred into water tank 521 located at the base station 114.

Transferring Water from the Pressure Tank to the Water Tank

Shut off valves 512, 515 are closed. Shut off valve 514 can remain open. The water in pressure tank 223 can be drained by opening shut off valves 517 and 522. The air pressure inside 223 will begin to force water out of pressure tank 223 via water drain conduit 516, shut off valve 517 and into water tank 521. Gravity will cause water to settle at the bottom of tank 521. The decompressing air can escape the water tank via shut off valve 522. Once the water is completely drained from pressure tank 223 shut off valve 522 can be closed. Additional compressed air can be allowed to escape pressure tank 223 into water tank 521 (which may be inside storage tank 223 for example). Doing so will pressurize water inside water tank 521 which will help facilitate flow from water tank 521 into a local tap water system for later use. Once water tank is adequately pressurized shut off valve 517 can be closed.

Transferring Water from the Bellows Pipe to the Water Tank

Valve configuration in order to transfer water from bellows pipe 216 to water tank 521: Shut off valves 517, 514 closed. Shut off valves 512, 515, 522 open.

Compressed air bleed 510 may include a regulator 511 to control the flow of compressed air used. Under this configuration compressed air will exit pressure tank 223 via compressed air bleed 510, via regulator 511, via shut off valve 512, via snorkel tube 268, into bellows pipe 216 causing compressed air to build up in bellows pipe 216. This will begin to force water settled inside bellows pipe 216 to the low point and via check valve 245, via inner conduit 323, via shut off valve 515 and finally into water tank 521. Gravity will cause water to settle in the bottom of the water tank 521. Decompressing air can exit from shut off valve 522. Once bellows pipe 216 has been emptied, shut off valves 512, 515, 522 can be closed. Shut off valve 514 can be opened. The pressure in water tank 521 can be repressured as previously described via conduit 516 and shut off valve 517. Water from tank 521 can be delivered for use via water tank outlet 518, through water filter 519, via water tank outlet 520 as drinking water.

Those of skill in the art would appreciate that various components and blocks may be arranged differently (e.g., arranged in a different order, or partitioned in a different way) all without departing from the scope of the subject technology.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An air-water submarine, comprising:

a buoyant submersible housing;

a dive plane attached to the buoyant submersible housing;

a propellor system attached to an end of the submersible housing:

a bellows pipe positioned inside the submersible housing and coupled to the propellor system, wherein the bellows pipe changes from an expanded state to a contracted state in response to a change in pressure on the submersible housing;

a first tube connected to the bellows pipe, wherein air inside the bellows pipe is inhaled from ambient air above the surface of the water in the expanded state, and expelled from the bellows pipe in the contracted state; and a second tube connected to the bellows pipe, disposed to collect condensation that forms in response to the bellows pipe changing between the expanded state and the contracted state.

2. The air-water submarine of claim 1, further comprising:

a ballast coupled externally of the buoyant submersible housing;

a generator assembly coupled to the ballast, wherein a movement of the buoyant submersible housing in surrounding water generates electricity in the generator assembly.

3. The air-water submarine of claim 2, further comprising a conduit connecting the generator assembly to one or more power systems in the buoyant submersible housing.

4. The air-water submarine of claim 2, further comprising a temperature sensor housed in the ballast.

5. The air-water submarine of claim 2, further comprising a camera housed in the ballast.

6. The air-water submarine of claim 2, further comprising a depth or pressure sensor housed in the ballast.

7. The air-water submarine of claim 1, wherein the dive plane is configured to rise and lower in a current of water surrounding the buoyant submersible housing.

8. The air-water submarine of claim 1, further comprising a plenum frame coupled to an exterior of the buoyant submersible housing, wherein the plenum frame is positioned surrounding the buoyant submersible housing and disposed to funnel water around the buoyant submersible housing.

9. The air-water submarine of claim 1, further comprising folding blades in the propellor system.

10. The air-water submarine of claim 9, wherein the folding blades are configured to fold back during a decent of the buoyant submersible housing into a surrounding water.

11. The air-water submarine of claim 9, wherein the folding blades are configured to unfold during an ascent of the buoyant submersible housing into a surrounding water, to pump water outside of the buoyant submersible housing, and to expand the bellows pipe.

12. The air-water submarine of claim 1, further comprising blades in the propeller system, wherein a blade angle of the blades is changeable.

13. The air-water submarine of claim 1, further comprising a chamber in the buoyant submersible housing, wherein the bellows pipe is positioned longitudinally in the chamber.

14. The air-water submarine of claim 13, further comprising an impeller coupled to the chamber, wherein the impeller is configured to pump ambient water into and out of the buoyant submersible housing.

15. The air-water submarine of claim 14, wherein the chamber is spaced from an interior wall of the buoyant submersible housing and the water pumped by the impeller fills a space surrounding the chamber.

16. The air-water submarine of claim 1, further comprising a storage tank coupled to the second tube, wherein the condensation is routed to the storage tank through the second tube.

17. The air-water submarine of claim 1, further comprising:

one or more electrical conduits housed in the first tube.

18. The air-water submarine of claim 1, wherein the dive plane is configured to move in response to a current flowing around the buoyant submersible housing and wherein the buoyant submersible housing ascends and descends in response to the dive plane moving in the current.

* * * * *